US010235938B2

(12) United States Patent
Takahara et al.

(10) Patent No.: US 10,235,938 B2
(45) Date of Patent: Mar. 19, 2019

(54) GATE DRIVER CIRCUIT INCLUDING VARIABLE CLOCK CYCLE CONTROL, AND IMAGE DISPLAY APPARATUS INCLUDING THE SAME

(71) Applicant: JOLED INC., Tokyo (JP)

(72) Inventors: Hiroshi Takahara, Osaka (JP); Hirofumi Nakagawa, Tokyo (JP)

(73) Assignee: JOLED INC., Tokyo (JP)

( * ) Notice: Subject to any disclaimer, the term of this patent is extended or adjusted under 35 U.S.C. 154(b) by 185 days.

(21) Appl. No.: 14/904,790

(22) PCT Filed: Jul. 3, 2014

(86) PCT No.: PCT/JP2014/003554
§ 371 (c)(1),
(2) Date: Jan. 13, 2016

(87) PCT Pub. No.: WO2015/008447
PCT Pub. Date: Jan. 22, 2015

(65) Prior Publication Data

US 2016/0171933 A1 Jun. 16, 2016

(30) Foreign Application Priority Data

Jul. 18, 2013 (JP) ..... 2013-149857

(51) Int. Cl.
*G09G 3/30* (2006.01)
*G09G 3/10* (2006.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3225; G09G 3/3266; G09G 3/3233; G09G 3/3258; G09G 3/3291
(Continued)

(56) References Cited

U.S. PATENT DOCUMENTS 6,985,141 B2 1/2006 Abe et al.
7,068,253 B2 6/2006 Kudo et al.
(Continued)

FOREIGN PATENT DOCUMENTS

JP 11-311980 11/1999
JP 2001-100696 4/2001
(Continued)

OTHER PUBLICATIONS

International Search Report (ISR) from International Searching Authority (Japan Patent Office) in International Pat. Appl. No. PCT/JP2014/003554, dated Sep. 30, 2014.

*Primary Examiner* — Adam J Snyder
(74) *Attorney, Agent, or Firm* — Greenblum & Bernstein, P.L.C.

(57) ABSTRACT

A gate driver IC (i.e., gate driver circuit), when set to a first mode by a logic signal of the terminal FNC*, shifts data in the gate driver IC in synchronization with one clock cycle of a clock inputted to the terminal CLK** (clock input terminal), and outputs a selection voltage or a non-selection voltage based on a data position in the gate driver IC; and when set to a second mode by a logic signal of the terminal FNC*, shifts data in the gate driver IC in synchronization with n clock cycles (n is an integer of at least 2) of a clock inputted to the terminal CLK**, and outputs the selection voltage or the non-selection voltage based on the data position in the gate driver IC.

19 Claims, 35 Drawing Sheets

(51) Int. Cl.
*G09G 3/3258* (2016.01)
*G09G 3/3233* (2016.01)
*G09G 3/3266* (2016.01)
*G09G 3/3291* (2016.01)

(52) U.S. Cl.
CPC ... *G09G 3/3291* (2013.01); *G09G 2300/0452* (2013.01); *G09G 2300/0842* (2013.01); *G09G 2300/0852* (2013.01); *G09G 2300/0861* (2013.01); *G09G 2310/0286* (2013.01); *G09G 2310/0291* (2013.01); *G09G 2310/08* (2013.01)

(58) Field of Classification Search
USPC ..... 345/76; 315/169.3
See application file for complete search history.

(56) References Cited

U.S. PATENT DOCUMENTS 7,119,767 B1 10/2006 Komiya et al.
7,292,236 B2 11/2007 Abe et al.
7,425,937 B2 9/2008 Inukai
7,453,433 B2 11/2008 Kudo et al.
7,868,865 B2 1/2011 Shin et al.
8,130,190 B2 3/2012 Kudo et al.
8,305,309 B2 11/2012 Tomida et al.
8,421,829 B2 4/2013 Kudo et al.
8,553,023 B2 10/2013 Yoshizaki et al.
8,587,566 B2 11/2013 Ono et al.
8,823,627 B2 9/2014 Kudo et al.
8,933,870 B2 1/2015 Higashijima et al.
9,595,222 B2 * 3/2017 Takahara ..... G09G 3/3225
2002/0015016 A1 2/2002 Kudo et al.
2003/0016189 A1 1/2003 Abe et al.
2004/0041754 A1 3/2004 Inukai
2005/0168491 A1 * 8/2005 Takahara ..... G09G 3/3241 345/690
2005/0231498 A1 10/2005 Abe et al.
2005/0243051 A1 11/2005 Kudo et al.
2006/0001621 A1 1/2006 Ono et al.
2006/0114196 A1 * 6/2006 Shin ..... G09G 3/3233 345/76
2006/0152459 A1 * 7/2006 Shin ..... G09G 3/3266 345/94
2007/0222718 A1 * 9/2007 Takahara ..... G09G 3/2011 345/76
2008/0143650 A1 6/2008 Tomida et al.
2009/0085857 A1 4/2009 Kudo et al.
2010/0289788 A1 * 11/2010 Yoshizaki ..... G09G 3/3233 345/211
2012/0075282 A1 * 3/2012 Higashijima ..... G09G 3/3677 345/212
2012/0105423 A1 * 5/2012 Chung ..... G09G 3/3266 345/212
2012/0154465 A1 6/2012 Kudo et al.
2013/0002642 A1 1/2013 Tomida et al.
2013/0207959 A1 8/2013 Kudo et al.
2014/0204004 A1 7/2014 Tomida et al.
2014/0361961 A1 12/2014 Takahara
2015/0255015 A1 9/2015 Takahara
2015/0262528 A1 9/2015 Takahara
2015/0279272 A1 10/2015 Takahara

FOREIGN PATENT DOCUMENTS

JP 2004-077567 3/2004
JP 2006-011095 1/2006
JP 2006-058352 3/2006
JP 2006-154822 6/2006
JP 2006-209152 8/2006
JP 2008-152096 7/2008
JP 2010-170144 8/2010
JP 2010-266715 11/2010
JP 2012-068592 4/2012

* cited by examiner (a) Selecting circuit operation

| a | b | Selection |
|---|---|---|
| 0 | 0 | Voff1 |
| 0 | 1 | Voff2 |
| 1 | 0 | Von |
| 1 | 1 | Von |

GATE DRIVER CIRCUIT INCLUDING VARIABLE CLOCK CYCLE CONTROL, AND IMAGE DISPLAY APPARATUS INCLUDING THE SAME

TECHNICAL FIELD

The present disclosure relates to an image display apparatus of an active-matrix type which includes a display screen in which pixels are disposed in a matrix, and a gate driver circuit for use in the image display apparatus.

BACKGROUND ART

An electroluminescence (EL) display apparatus involves various pixel configurations, and the total number of gate signal lines per pixel varies. For that reason, there has been a need to develop gate driver integrated circuits (ICs) (i.e., gate driver circuits) respectively complying with the pixel configurations.

Each of the pixels includes a plurality of transistors. Furthermore, each of the pixels includes gate signal lines of different types for controlling each of the transistors in a pixel circuit. These gate signal lines include some with high load capacity and others with relatively low load capacity.

Furthermore, slew rates required of control signals to be applied to the respective gate signal lines also differ. For example, while the gate signal line through which a video signal voltage is supplied to a pixel requires a high slew rate, a relatively low slew rate is sufficient for the gate signal line that controls current which flows through the EL element.

For example, Patent Literature (PTL) 1 discloses an image display apparatus which includes two gate signal lines resulting from dividing a single gate signal line around the center thereof, and drives each of the gate signal lines by a corresponding driving circuit, which is a method of driving a gate signal line with high load capacity at a high slew rate. In addition, PTL 2 discloses an image display apparatus in which driving of gate signal lines is divided by gate driver circuits.

CITATION LIST

Patent Literature

[PTL 1] Japanese Unexamined Patent Application Publication No. 2006-154822

[PTL 2] Japanese Unexamined Patent Application Publication No. 2006-011095

SUMMARY OF INVENTION

Technical Problem

The present disclosure provides a gate driver IC (i.e., gate driver circuit) which is highly versatile and can be used irrespective of the number and arrangement of the gate signal lines and irrespective of the specification or the like of the image display apparatus, and an image display apparatus which includes the gate driver IC.

Solution to Problem

A gate driver circuit according to an aspect of the present disclosure is a gate driver circuit included in an image display apparatus that includes a display screen in which pixels are disposed in a matrix, the gate driver circuit including: a clock input terminal; a data input terminal; a plurality of output terminals connected to gate signal lines of the image display apparatus; and a setting circuit for setting a first mode or a second mode, wherein a selection voltage or a non-selection voltage output from an arbitrary one of the plurality of output terminals is applied to a corresponding one of the gate signal lines, data set at the data input terminal is provided to the gate driver circuit according to a clock inputted to the clock input terminal, the data is shifted in the gate driver circuit in synchronization with the clock inputted to the clock input terminal, the arbitrary one of the plurality of output terminals outputs the selection voltage or the non-selection voltage based on a data position in the gate driver circuit, when the setting circuit is set to the first mode, the data is shifted in the gate driver circuit in synchronization with one clock cycle of the clock inputted to the clock input terminal, and the selection voltage or the non-selection voltage is output based on the data position in the gate driver circuit, and when the setting circuit is set to the second mode, the data is shifted in the gate driver circuit in synchronization with n clock cycles of the clock inputted to the clock input terminal, and the selection voltage or the non-selection voltage is output based on the data position in the gate driver circuit, n being an integer of at least 2.

Advantageous Effects of Invention

According to the present disclosure, it is possible to provide a gate driver IC (i.e., gate driver circuit) which is highly versatile and can be used irrespective of the number and arrangement of the gate signal lines and irrespective of the specification or the like of the image display apparatus, and an image display apparatus which includes the gate driver IC.

Figure 1:
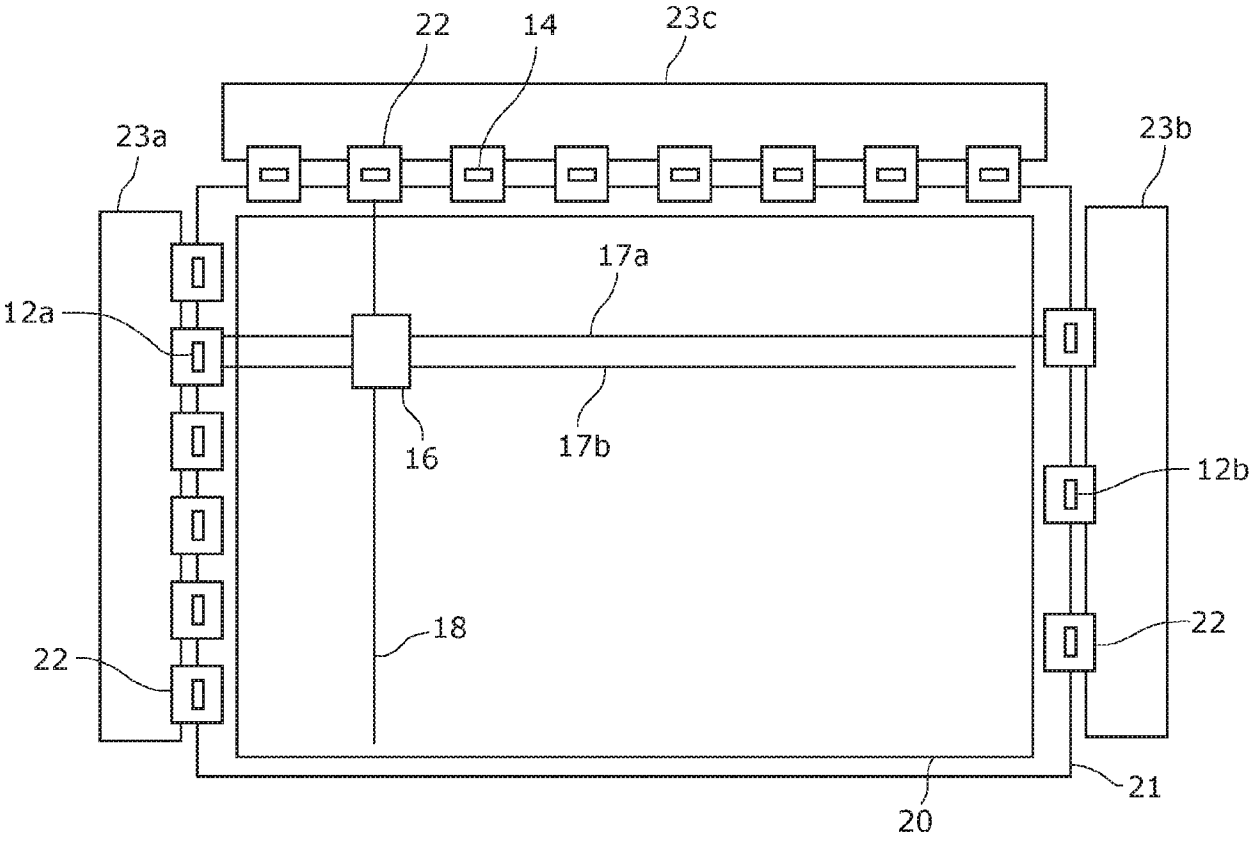
FIG. 1 is a schematic diagram illustrating a configuration of an image display apparatus according to Embodiment 1.

DESCRIPTION OF EMBODIMENTS (Underlying Knowledge Forming the Basis of the Present Disclosure)

Underlying knowledge forming the basis of the present disclosure is described below prior to describing details of the present disclosure.

As described above, a pixel includes gate signal lines each disposed for a corresponding one of transistors included in a pixel circuit. Accordingly the more the total number of the transistors per pixel circuit increases, the more the types of the gate signal lines increases. It should be noted that when the types of gate signal lines differ, the gate signal lines are applied with different pulses (voltage values for applying an ON voltage or an OFF voltage, time periods, cycles, etc.).

Furthermore, the total number of the gate signal lines per type is equal to the total number of the pixel circuits in a vertical direction. For example, the total number of the gate signal lines included in an image display panel of Extended Graphics Array (XGA) is 768, and an image display panel of Super-XGA (SXGA) is 1024. Thus, for example, the image display panel of SXGA including four types of gate signal lines has in total 1024×4=4096 of the gate signal lines.

The image display apparatus includes gate signal line driving circuits for driving such a large number of the gate signal lines. The gate signal line driving circuits are integrated as the gate driver IC, and mounted near terminals of the gate signal lines drawn from the image display panel.

However, in the case where both of the gate signal line to which the bilateral driving is applied and the gate signal line to which the bilateral driving is not applied (i.e., the gate signal line to which the unilateral driving is applied) are included, the number and the arrangement of the terminals of the gate signal lines drawn from one side of the image display panel are, in general, different from the number and the arrangement of the terminals of the gate signal lines drawn from the other side of the image display panel.

The image display apparatus including the EL element involves various pixel configurations, and the total number of the gate signal lines per pixel varies. For that reason, there has been a need to develop gate driver ICs respectively complying with the pixel configurations.

In addition, with different specifications or the like of the image display apparatus, the total number of pixels differs and the total number of transistors per pixel circuit also differs, and therefore the total number of gate signal lines to be driven differs as well. Furthermore, the total number of gate signal lines which should be driven through the bilateral driving also differs.

There is a problem that tremendous amounts of money and time are required for generating a dedicated gate driver IC according to the number and arrangement of the gate signal lines drawn from the image display panel, and further according to the specifications or the like of the image display apparatus.

In view of the above, the inventors of the present disclosure has conceived an image display apparatus which includes a gate driver IC which is highly versatile and can be used irrespective of the number and arrangement of terminals of the gate signal lines and irrespective of the specification or the like of the image display apparatus.

Hereinafter, embodiments are described in greater detail with reference to the accompanying Drawings as necessary. However, description that is too detailed will be omitted in some cases. For example, there are instances where detailed description of well-known matter and redundant description of substantially identical components are omitted. This is for the purpose of preventing the following description from being unnecessarily redundant and facilitating understanding of those skilled in the art.

It should be noted that the accompanying Drawings and subsequent description are provided by the inventors to allow a person of ordinary skill in the art to sufficiently understand the present disclosure, and are thus not intended to limit the scope of the subject matter recited in the Claims.

Embodiment 1

Hereinafter, Embodiment 1 shall be described with reference to the Drawings.

1-1 Configuration 1-1 Overall Configuration

FIG. 1 is a schematic diagram illustrating a configuration of an image display apparatus according to Embodiment 1.

The image display apparatus illustrated in the diagram includes: a display panel 21 including a display screen 20; printed circuit boards 23*a* to 23*c*; COFs 22 which connect the display panel 21 and the printed circuit boards 23*a* to 23*c*. The display screen 20 includes pixels 16 each having an EL element are disposed in a matrix. The gate signal line 17*a* and the gate signal line 17*b* are connected to each of the pixels 16. The gate signal line 17*a* is connect to connecting terminals 35 of a gate driver IC 12*a* and a gate driver IC 12*b* which are mounted on the COFs 22. The gate signal line 17*b* is connected to the connecting terminal 35 of the gate driver IC 12*a* mounted on the COF 22.

A source driver IC (i.e., source driver circuit) 14 generates large amounts of heat, and thus a heatsink, a heat dissipation sheet, or a heat dissipation film is formed or disposed on the rear surfaces of the COFs. The heatsink, the heat dissipation sheet, or the heat dissipation film is directly or indirectly connected to the source driver IC 14.

In FIG. 1, the source driver IC 14 is also mounted on the COF 22. An output terminal of the source driver IC 14 is connected to the source signal line 18. The source driver circuit 14 applies a video signal or a video signal voltage to the source signal line 18.

It should be noted that the printed circuit board 23*c* illustrated in FIG. 1 is a printed circuit board on which a circuit for a video signal is formed or mounted. In addition, printed circuit boards 23*a* and 23*b* are printed circuit boards on each of which a circuit for scanning is formed or mounted.

Principle constituent elements of the image display apparatus shall be described below in detail.

1-1-2. Pixel

Figure 2:
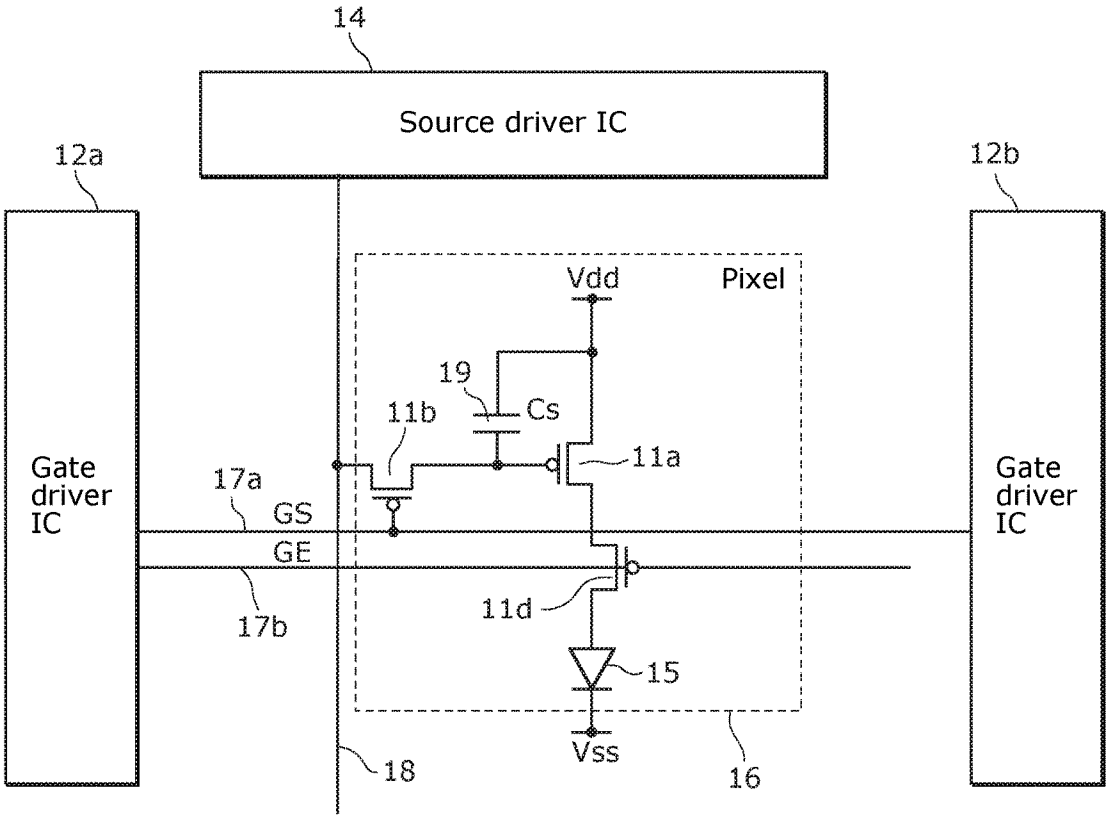
FIG. 2 is a circuit diagram illustrating a pixel circuit of the image display apparatus.

FIG. 2 is a circuit diagram illustrating a pixel configuration of the image display apparatus.

In the present disclosure, although a driving transistor 11 and a switching transistor 11 are described as thin-film transistors, the transistors are not limited to the thin-film transistors. The transistors can be formed of a thin-film diode (TFD), a ring diode, etc. as well. It should be noted that the driving transistor 11*a*, the switching transistor 11*b*, and the switching transistor 11*d* are also referred to as a transistor 11*a*, transistor 11*b*, and transistor 11*d*, respectively. Or, the driving transistor 11*a*, the switching transistor 11*b*, and the switching transistor 11*d* are not specifically distinguished and referred to as a transistor 11 in some cases.

In addition, the transistors are not limited to thin-film elements but may be transistors formed on silicon wafers. For example, a transistor formed using a silicon wafer, removed and transferred onto a glass substrate is exemplified. In addition, a display panel on which a transistor chip formed using a silicon wafer is mounted by bonding on a glass substrate is exemplified.

The transistor 11 may, of course, be an FET, a MOS-FET, a MOS transistor, or a bipolar transistor. These are also, basically, thin-film transistors. It should be understood that the transistor may be a varistor, a thyristor, a ring diode, a photodiode, a photo transistor, a PLZT element, etc.

In addition, it is preferable that a lightly doped drain (LDD) structure is employed for the transistor 11 according to the present disclosure, for both cases of an N-channel transistor and a P-channel transistor.

Furthermore, the transistor 11 may be formed using any of high-temperature poly-silicon (HTPS), low-temperature poly-silicon (LTPS), continuous grain silicon (CGS), transparent amorphous oxide semiconductors (TAOS, IZO), amorphous silicon (AS), and infrared rapid thermal annealing (RTA).

In FIG. 2, all of the transistors 11 included in a pixel are the P-channel transistors. However, the transistors 11 of the pixel are not limited to the P-channel transistors according to the present disclosure. All of the transistors 11 of the pixel may be the N-channel transistors. Furthermore, the transistors 11 may be composed of both of the N-channel transistor and the P-channel transistor.

It is preferable that the transistor 11 has a top gate structure. This is because the top gate structure reduces parasitic capacitance, and a gate electrode pattern of the top gate serves as a light shielding layer to shield light emitted from the EL element 15, making it possible to reduce malfunction of a transistor or an off-leakage current.

It is preferable, in the process to be carried out, that a copper line or a copper alloy line can be employed as a line material for the gate signal line 17 or the source signal line 18, or for both of the gate signal line 17 and the source signal line 18. This is because it is possible to reduce wiring resistance between the signal lines and to implement a larger EL display panel.

It is preferable that the gate signal line 17 which is driven (controlled) by the gate driver IC 12 has low impedance. Accordingly, the same holds true for a composition or a structure of each of the gate signal lines 17.

In particular, it is preferable that a low-temperature poly-silicon (LTPS) is employed. With the low-temperature poly silicon, the transistor has a top gate structure and small parasitic capacitance, and it is possible to manufacture the N-channel and P-channel transistors, and to use the copper line or the copper alloy line in the processes. It is preferable that, for the copper line, a three-layer structure of Ti—Cu—Ti is employed.

For the lines, it is preferable that a three-layer structure of molybdenum (Mo)—Cu—Mo is employed in the case of the transparent amorphous oxide semiconductors (TAOS).

In the image display apparatus according to the present disclosure, color filters including red (R), green (G), and blue (B) are formed so as to correspond to the positions of the pixels 16. It should be noted that the color filter is not limited to RGB, and a pixel including cyanogen (C), magenta (M), and yellow (Y) may be formed. Furthermore, a pixel of white (W) may be formed. More specifically, pixels of R, G, B, and W are disposed in the display panel 20 in a matrix.

Pixels are manufactured so as to be square with three pixels of RGB. Accordingly, each pixel of R, G, and B has an elongated pixel shape. It is thus possible to prevent characteristic variations among the transistors 11 in one pixel, by performing annealing with a laser irradiation spot being elongated.

It should be noted that R, G, and B may each have a different pixel aperture ratio. With the different aperture ratios, it is possible to have different current densities between currents flowing through the EL element 15 of the respective RGB. With the different current densities, it is possible to equalize the deterioration rate of the EL elements 15 of the RGB. With the same deterioration rate, white balance shift does not occur in the image display apparatus.

Furthermore, a white (W) pixel is formed, as necessary. In other words, a pixel includes R, G, B, and W. With R, G, B, and W being included, high-luminance can be obtained. In addition, a configuration including R, G, B, and G is also exemplified.

According to the present disclosure, a pixel including white (W) in addition to three primary colors of RGB is included. An excellent color peak luminance can be implemented by forming or disposing the pixel 16. In addition, high-luminance display can be implemented.

Colorization of the image display apparatus is performed by mask evaporation; however, colorization according to the present disclosure is not limited to the mask evaporation. For example, an EL layer which emits blue light is formed, and emitted blue light may be converted to light of R, G, and B, through a color conversion layer; that is, color change medium (CCM) of R, G, and B.

An electric field from each of the source signal line 18 and the gate signal line 17 is shielded by an anode electrode or a cathode electrode, by disposing or forming the anode electrode or the cathode electrode above the source signal line 18 and the gate signal line 17. It is possible, by the shield, to reduce noise in an image display.

An insulating film or an insulating film formed of an acrylic material (planarization film) is formed on the source signal line 18 and the gate signal line 17 to insulate the source signal line 18 and the gate signal line 17, and a pixel electrode 40 is formed on the insulating film.

As described above, the structure in which the pixel electrode 40 is stacked on at least part of the gate signal line 17, etc., is referred to as a high aperture (HA) structure. This structure reduces unnecessary interfering light or the like, and thus realizes an excellent light emitting condition.

It is possible to use a transparent electrode including, for example, ITO, indium (IGZO), gallium, zinc, oxygen, IZO, transparent amorphous oxide semiconductor (TAOS), or the like, for the pixel electrode of the pixel circuit 16.

It should be noted that a circularly polarizing plate (circularly polarizing film) (not illustrated) is disposed on the light emitting face of the image display apparatus. A polarization plate and a phase film are integrated into a circularly polarizing plate (circularly polarizing film).

The display apparatus according to an aspect of the present disclosure includes: the display screen 20 including EL elements disposed in a matrix; the gate signal lines 17 disposed for each pixel row of the display screen; the source signal line 18 disposed for each pixel column of the display screen; the gate driver circuits (gate driver ICs) 12 which drive the gate signal lines 17; and the source driver IC (source driver circuit) 14 which drives the source signal line 18.

It should be noted that the source driver IC (circuit) 14 may have a multi-delay function which enables setting an output timing of a video signal for each terminal or for each block.

FIG. 2 illustrates a pixel configuration in which the switching transistor 11*d* is disposed in a current pathway of current generated by the driving transistor 11*a*. The current generated by the driving transistor 11*a* is supplied to the EL element 15, and the EL element 15 emits light with luminance proportional to the supplied current.

The switching transistor 11*b* has a function of applying, to the driving transistor of the pixel 16, a video signal voltage generated by the source driver IC 14 and applied to the source signal line 18. The capacitor 19 has a function of holding the applied video signal for one frame period.

As illustrated in FIG. 2, the gate driver IC 12*a* and the gate driver IC 12*b* are connected to the ends of the gate signal line 17*a*. Only the gate driver IC 12*a* is connected to the gate signal line 17*b*.

The gate signal line 17*a* which drives the transistor 11*b* that applies a video signal voltage (video signal) to the pixel 16 is connected to the gate driver IC 12*a* and the gate driver IC 12*b*. For example, the gate driver IC 12*a* is disposed on the left side of the display screen 20, and the gate driver IC 12*b* is disposed on the right side of the display screen 20.

The following describes the reason why two gate driver ICs 12 (12*a* and 12*b*) are disposed for the gate signal line 17*a*. It should be noted that there are instances where the gate driver ICs 12*a* and 12*b* are not specifically distinguished and referred to as the gate driver ICs 12.

The gate signal line 17*a* is connected to the transistor 11*b*. The transistor 11*b* is a transistor for writing a video signal onto the pixel 16, and thus it is necessary to turning ON and OFF the transistor 11*b* at high speed (high slew rate operation). The high slew rate operation can be implemented by driving the gate signal line 17*a* with the two gate driver ICs 12 (12*a* and 12*b*).

The gate signal line 17*a* is driven by the two gate driver ICs 12, thereby eliminating, for example, luminance inclination of the right and left sides with respect to the center of the display screen 20 and implementing an excellent image display. In addition, even when the load capacities of the gate signal lines 17 are large, it is possible to smoothly drive the gate signal lines 17.

As described above, the gate signal line 17*a* is connected to the switching transistor 11*b* which applies a video signal to the pixel 16. Accordingly, the gate signal line 17*a* is applied with the bilateral driving by the two gate driver ICs 12.

In contrast, the switching transistor 11*d* has a function of interrupting current flowing through the EL element 15, and it is not necessary to perform the operation of interrupting current at high speed. Accordingly, high slew rate operation is not necessary, and thus the switching transistor 11*d* is applied with the unilateral driving by only the gate driver IC 12*a*.

The image display apparatus according to the present embodiment includes the display screen 20 including a plurality of EL elements 15. In addition, the image display apparatus includes, as peripheral circuits of the display screen 20, the gate driver ICs 12 which drive the gate signal lines 17, the source driver IC 14 which generates and outputs video signals, and a control circuit (not illustrated) which controls the gate driver ICs 12, etc.

The display screen 20 includes the EL elements disposed in a matrix. The display screen 20 displays an image according to a video signal inputted to the image display apparatus from an external source.

1-1-3. Gate Driver IC 1-1-3-1. Detailed Configuration

Figure 3:
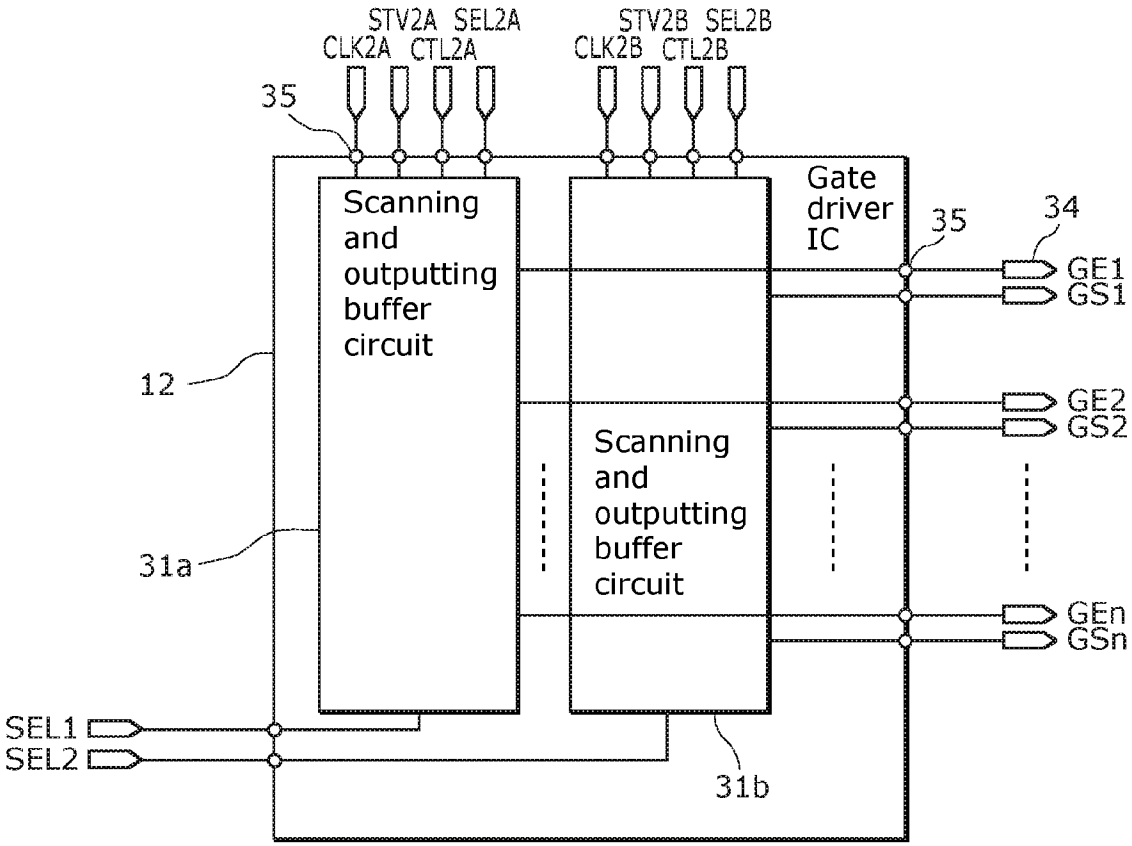
FIG. 3 is a block diagram illustrating a configuration of a gate driver IC.

As described above, the gate driver ICs 12*a* and 12*b* apply the bilateral driving to the gate signal line 17*a*, and the unilateral driving to the gate signal line 17*b*. FIG. 3 is a block diagram illustrating a configuration of the gate driver ICs 12.

As illustrated in FIG. 3, the gate driver ICs 12 each include a plurality of scanning and outputting buffer circuits 31. Each of the gate driver ICs 12 is a driving circuit which is connected to the gate signal lines 17, and has a function of controlling conduction (ON, selection) and non-conduction (OFF, non-selection) of the switching transistors 11 (11*b* and 11*d*) included in the EL element 15, by outputting a selection signal to the gate signal lines 17. It should be noted that there are instances where the scanning and outputting buffer circuits 31*a* and 31*b* are not specifically distinguished from each other and described simply as scanning and outputting buffer circuits 31.

The gate driver ICs 12 (gate driver ICs 12*a* and 12*b*) are disposed on the left side and the right side of the display screen 20, and the gate signal lines 17 of each of the pixels 16 is connected to at least the gate driver IC 12*a* or the gate driver IC 12*b*.

In particular, the gate signal line 17*a* (gate signal line GS) is connected to both of the gate driver ICs 12.

The gate driver ICs 12 are capable of outputting voltages of three different values (Von, Voff1, and Voff2) from the output terminals 34. In addition, it is possible to set an output mode (gate voltage binary driving) for outputting voltages of two different values (Von and Voff1) and an output mode (gate voltage ternary driving) for outputting voltages of three different values (Von, Voff1, and Voff2), using selection signal line (terminal SEL).

The settings using the terminal SEL can be performed for each of the scanning and outputting buffer circuits 31 formed or disposed in the gate driver ICs 12.

The gate driver ICs 12 each include two scanning and outputting buffer circuits 31. The scanning and outputting buffer circuits 31 are each mainly composed of a shift register circuit and an outputting buffer circuit (see FIG. 9). It should be noted that although the scanning and outputting buffer circuits 31 each mainly composed of the shift register circuit and the outputting buffer circuit, the shift register circuit and the outputting buffer circuit may be separately disposed or formed, or a plurality of shift register circuits may be formed and a single outputting buffer circuit which amplifies or buffers outputs of the plurality of shift register circuits may be formed or disposed. In addition, it should be understood that the outputting buffer circuit may be omitted when the shift register circuits are capable of sufficiently driving the respective gate signal lines 17.

It should be noted that the scanning and outputting buffer circuits 31 are described in an embodiment of the present disclosure, however, the shift register circuit and the outputting buffer circuit are not limited to this. The shift register circuit and the outputting buffer circuit are not necessarily integrated, and may be separately disposed. According to an embodiment of the present disclosure, the circuit is not limited to the shift register circuit, but any circuit may be employed as long as the gate driver circuit or the like which can apply a selection voltage or a non-selection voltage is connected to one gate signal line and the circuit has a function of selecting an intended gate signal line. In addition, the shift register circuit is not limited to a shift register circuit having a shift register function, but may be a decoder circuit which, for example, selects a gate signal line based on k-bit data. Furthermore, the gate driver circuit according to an embodiment of the present disclosure includes a plurality of shift register circuits, etc., and is capable of selecting a shift register circuit, etc. from among the plurality of shift register circuits, etc., and the gate signal lines 17 in a pixel row different from pixel rows of the another shift register circuits.

The scanning and outputting buffer circuit 31*a* applies a selection voltage (ON voltage) or a non-selection voltage (OFF voltage) to the gate signal line 17*a* (gate signal line GS).

The scanning and outputting buffer circuit 31*b* applies the selection voltage (ON voltage) or the non-selection voltage (OFF voltage) to the gate signal line 17*b* (gate signal line GE).

The scanning and outputting buffer circuits 31 include terminals to which a clock signal is inputted (CLK2A and CLK2B), terminals to which a data signal (start pulse) is inputted (STV2A and STV2B), terminals to which a logic signal for selecting between the binary voltage driving and the ternary voltage driving (SEL2A and SEL2B), and terminals to which a control signal is inputted (CTL2A and CTL2B). Terminals CTL2A and CTL2B have a function of controlling an output state of the scanning and outputting buffer circuits 31.

Figure 4:
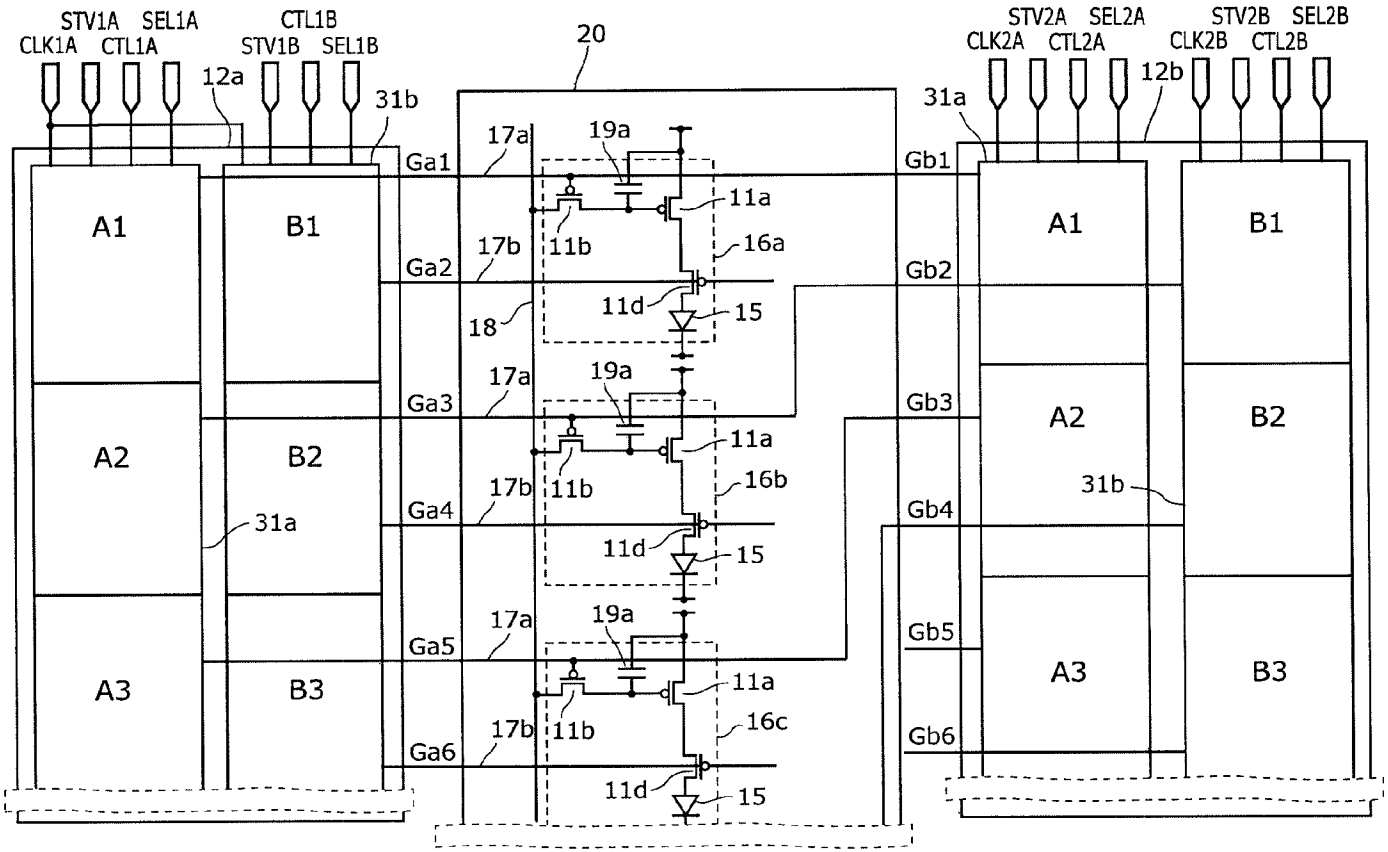
FIG. 4 is a configuration diagram of the image display apparatus on which the gate driver IC is mounted, according to Embodiment 1.

It should be noted that the numerical values assigned to the terminals are provided for descriptive purposes. The numerical values may be any values as long as terminal names are explicitly described as illustrated in FIG. 4 and the like.

Terminals STV (STV2A and STV2B) are data input terminals, and data which has been inputted to the terminals are inputted to the shift registers with rise of a clock inputted to terminals CLK (CLK2A and CLK2B).

The terminals CLK (CLK2A and CLK2**B) are clock input terminals, and the data in the shift register circuits is shifted in synchronization with the clock inputted to the terminals.

1-1-3-2. Binary Driving and Ternary Driving

Figure 5:
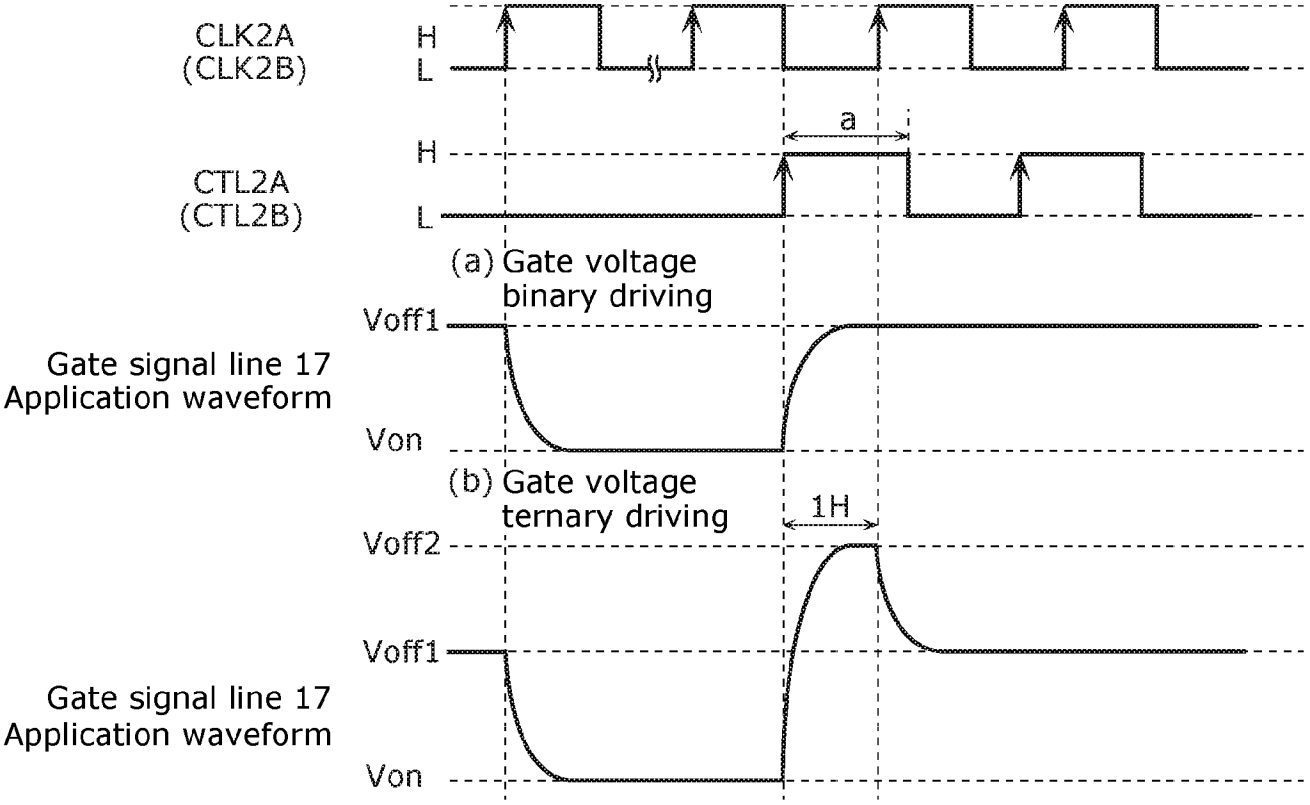
FIG. 5 is a diagram for explaining each of gate voltage binary driving and gate voltage ternary driving in the case of a P-channel transistor.

Terminals SEL (SEL2A and SEL2B) are terminals for switching between the gate voltage binary driving and the gate voltage ternary driving illustrated in FIG. 5. The gate voltage ternary driving is selected when the logic data inputted to the terminals SEL (SEL2A and SEL2B) is "H". The gate voltage binary driving is selected when the logic data inputted to the SEL terminals (SEL2A and SEL2B) is "L". The ternary driving is applied to the gate signal lines 17 which require a high slew rate, and the binary driving is applied to the gate signal lines 17 which do not require the high slew rate. The gate signal line 17***a* which requires the high slew rate is applied with the ternary driving, and the gate signal line 17*b* which does not require the high slew rate is applied with the binary driving.

Figure 35:
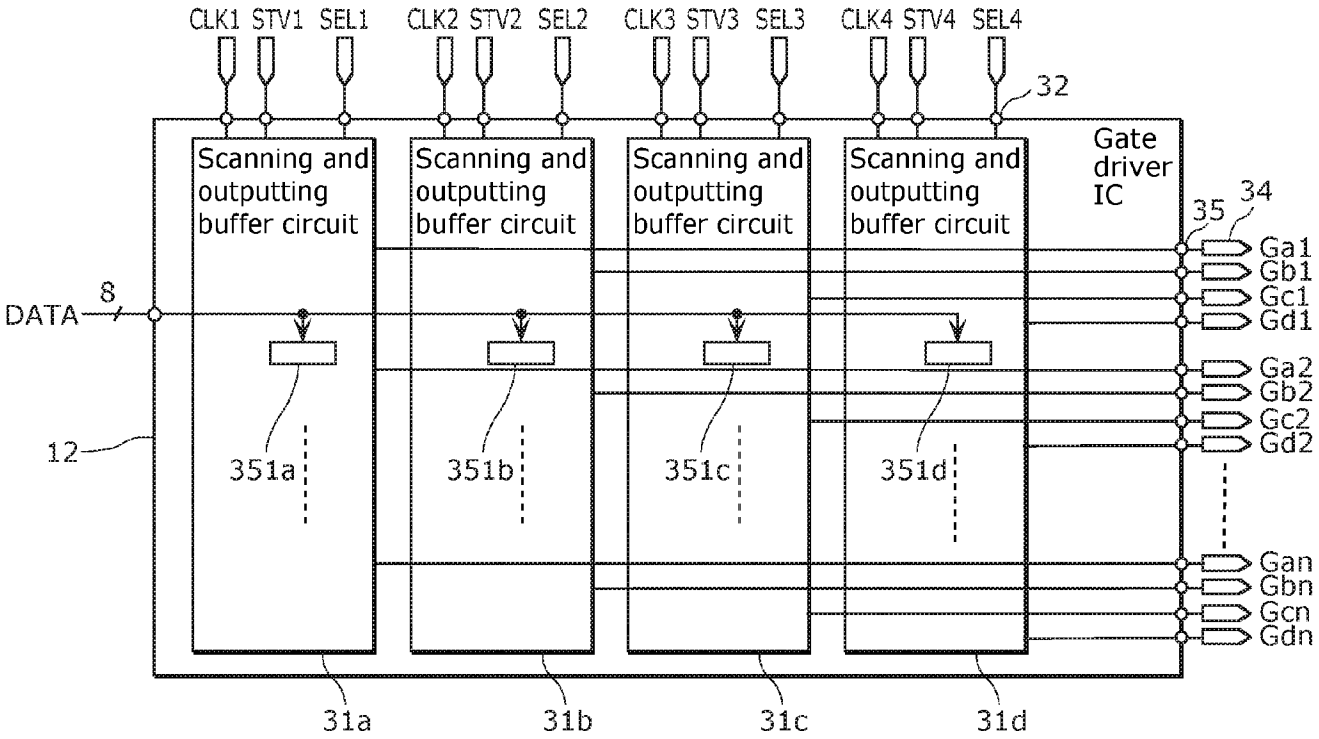
FIG. 35 is a block diagram illustrating a configuration of the gate driver IC according to a modification of Embodiment 1.

For example, selection between the gate voltage ternary driving and the gate voltage binary driving is implemented in a hardware manner based on the logic voltage provided to the input terminal disposed or formed on the gate driver ICs 12. Alternatively, selection between the gate voltage ternary driving and the gate voltage binary driving is implemented by a software process performed based on a command inputted to the gate driver ICs 12. For example, as illustrated in FIG. 35, DATA is inputted to the gate driver IC 12 as a command from outside, and the input DATA is converted to a setting command in command decoder circuits 351*a* to 351*d* to set an operation or a function. It should be noted that there are instances where the command decoder circuits 351*a* to 351*d* are not specifically distinguished from each other and described as command decoder circuits 351.

The gate voltage binary driving is a mode in which a selection voltage (Von voltage, i.e., ON voltage) and a first non-selection voltage (Voff1 voltage or OFF voltage 1) are applied to the gate signal lines 17.

The gate voltage ternary driving is a mode in which a selection voltage (Von voltage, i.e., ON voltage), the first non-selection voltage (Voff1 voltage, i.e., OFF voltage 1), and a second non-selection voltage (Voff2 voltage, i.e., OFF voltage 2) are applied to the gate signal lines 17. A period in which the second non-selection voltage (Voff2 voltage) is applied to the gate signal lines is one horizontal scanning period (period of 1H), or a period in which one pixel row is selected or shorter. A period in which the ON voltage is applied is set as an arbitrary period greater than or equal to the period of 1H, based on the data applied to the terminals STV (STV2A and STV2**B).

Figure 23:
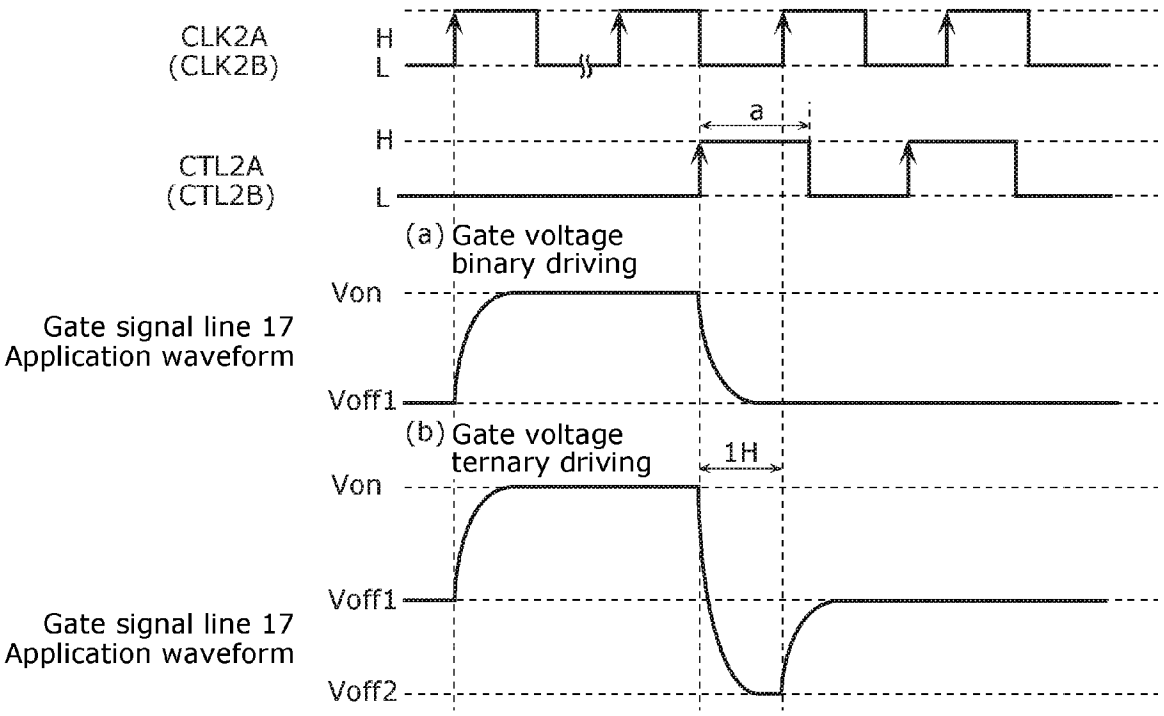
FIG. 23 is a diagram for explaining each of gate voltage binary driving and gate voltage ternary driving in the case of an N-channel transistor.

It should be noted that FIG. 5 is a timing chart illustrating the voltage binary driving and the voltage ternary driving in the case where the switching transistor 11*b* is a P-channel transistor as in FIG. 2. In contrast, in the case where the switching transistor 11*b* is an N-channel transistor as in FIG. 21, the voltage polarity is inverted as illustrated in FIG. 23.

Likewise, FIG. 7, FIG. 8, FIG. 12, FIG. 13, FIG. 14, FIG. 15, FIG. 16, and FIG. 17 are diagrams illustrating timing charts related to the P-channel transistor, FIG. 24, FIG. 25, FIG. 26, FIG. 27, FIG. 28, FIG. 29, FIG. 30, and FIG. 31 are diagrams illustrating timing charts related to the N-channel transistor.

Figure 7:
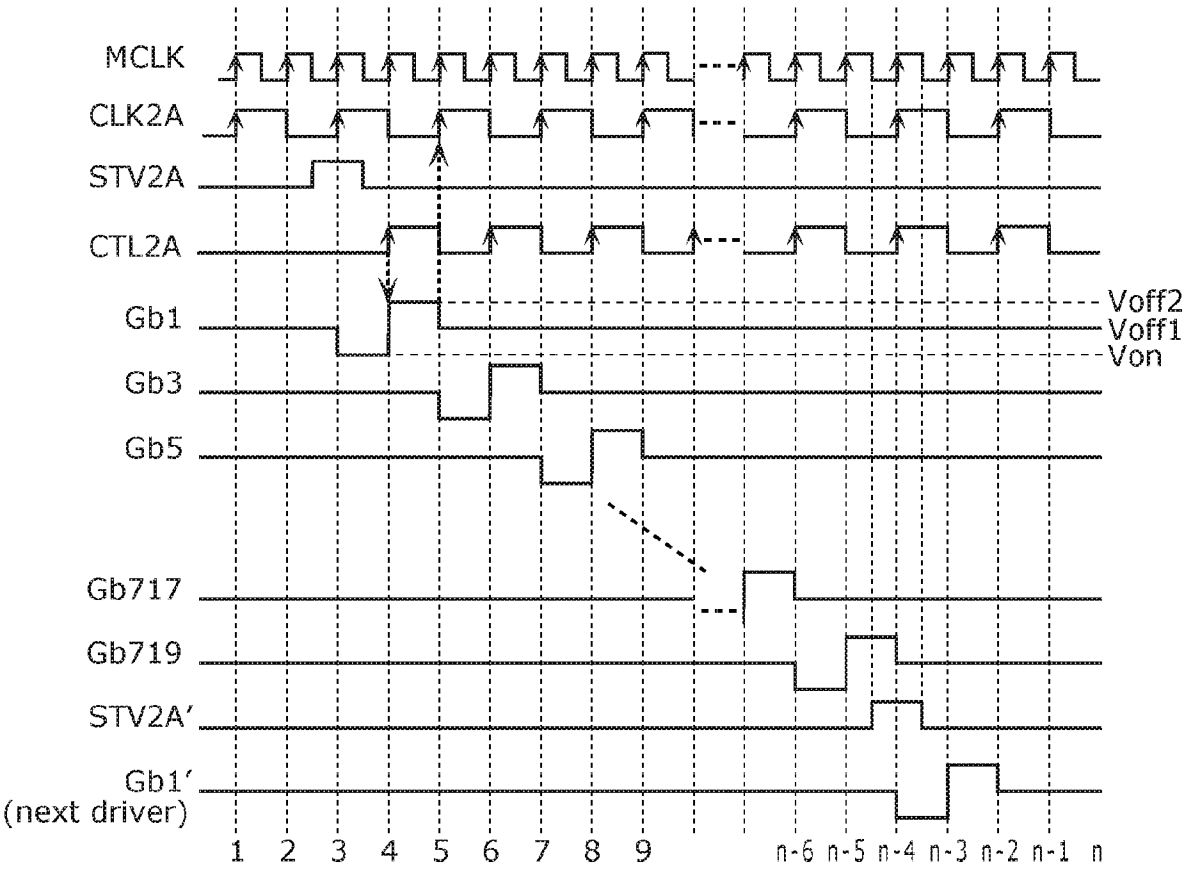
FIG. 7 is a timing chart illustrating an operation of a scanning and outputting buffer circuit of the gate driver IC.
Figure 12:
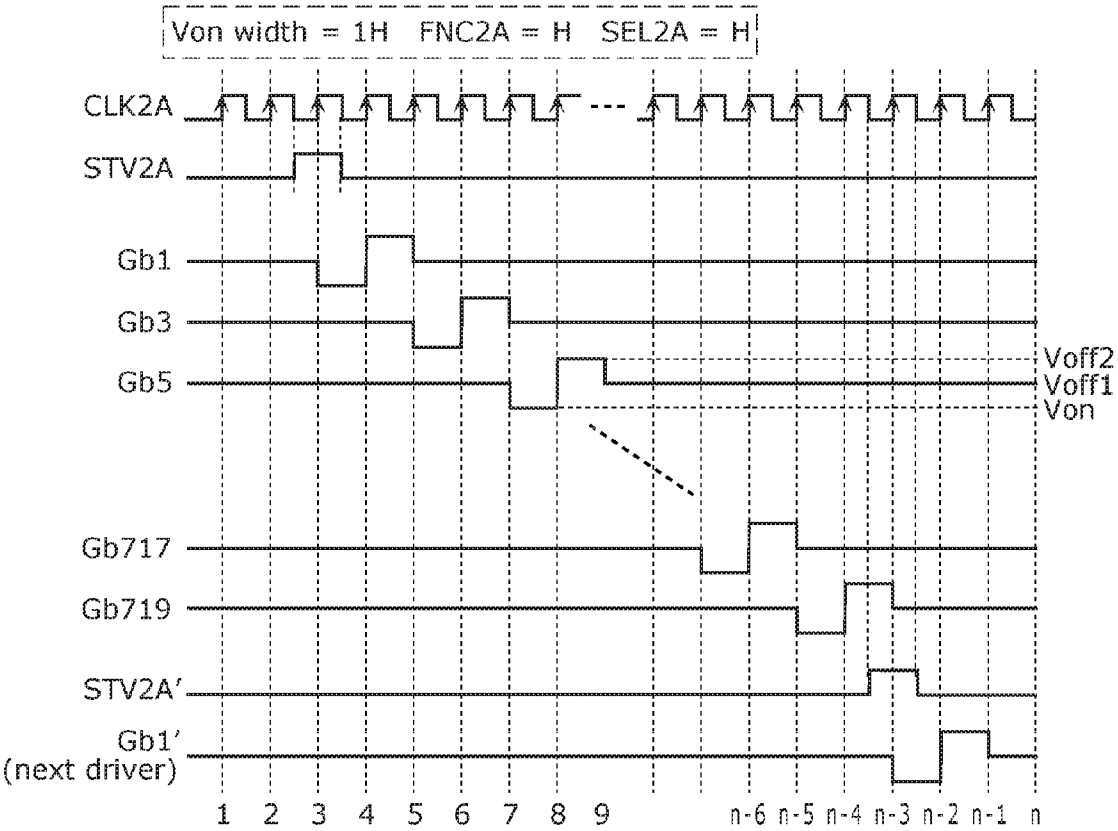
FIG. 12 is a timing chart illustrating an operation of a scanning and outputting buffer circuit included in the gate driver IC illustrated in FIG. 11.
Figure 24:
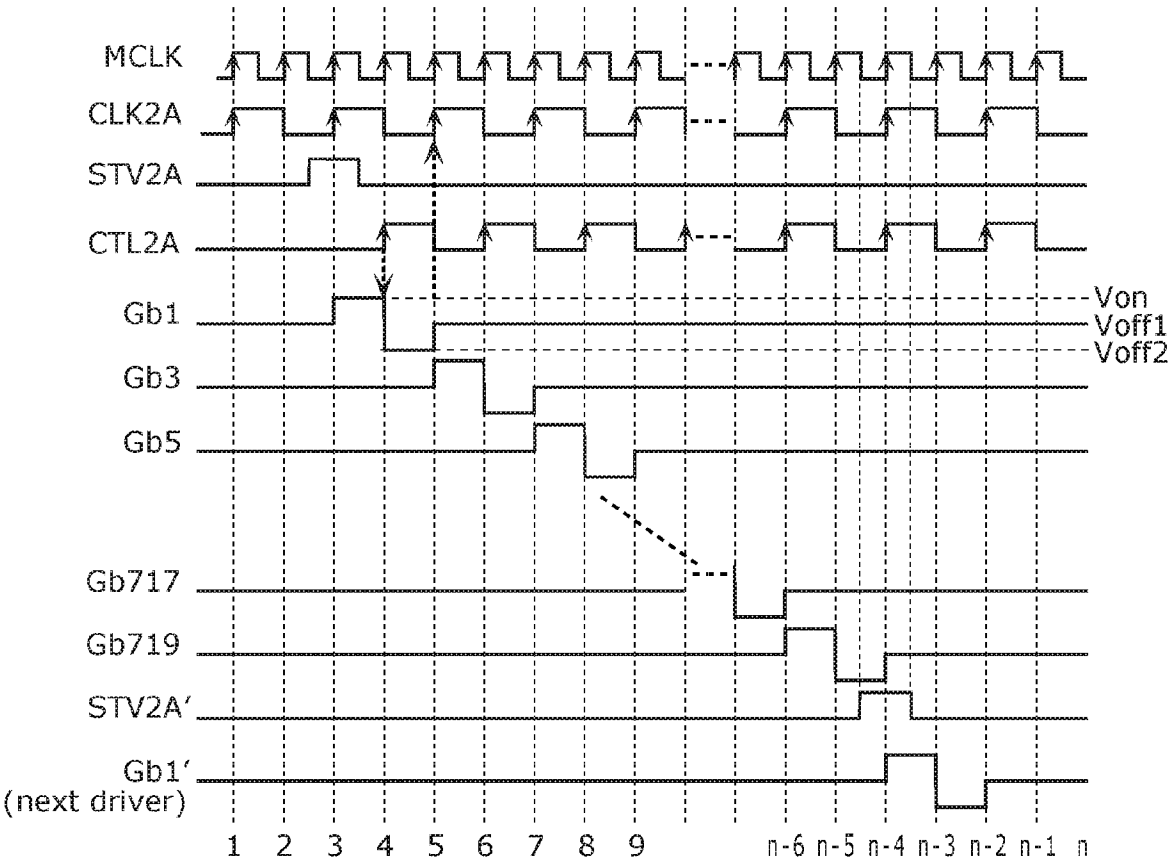
FIG. 24 is a timing chart related to the N-channel transistor.
Figure 25:
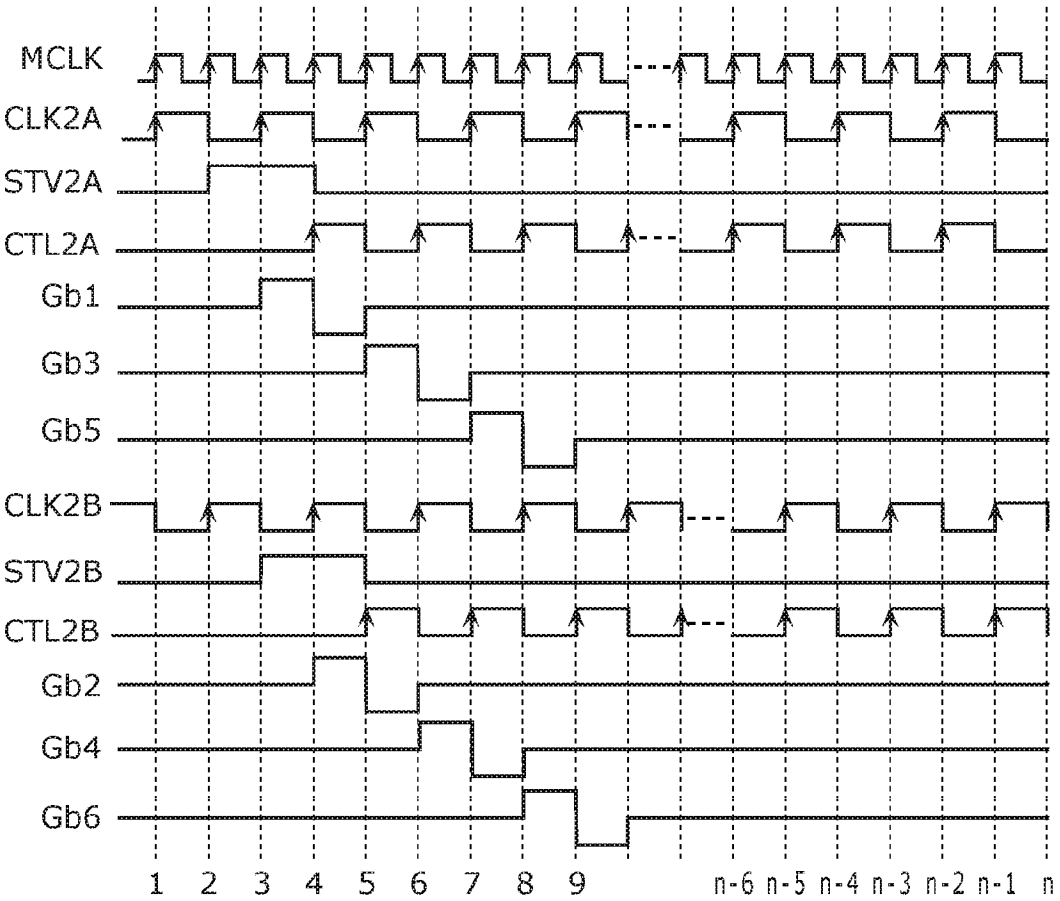
FIG. 25 is a timing chart related to the N-channel transistor.
Figure 26:
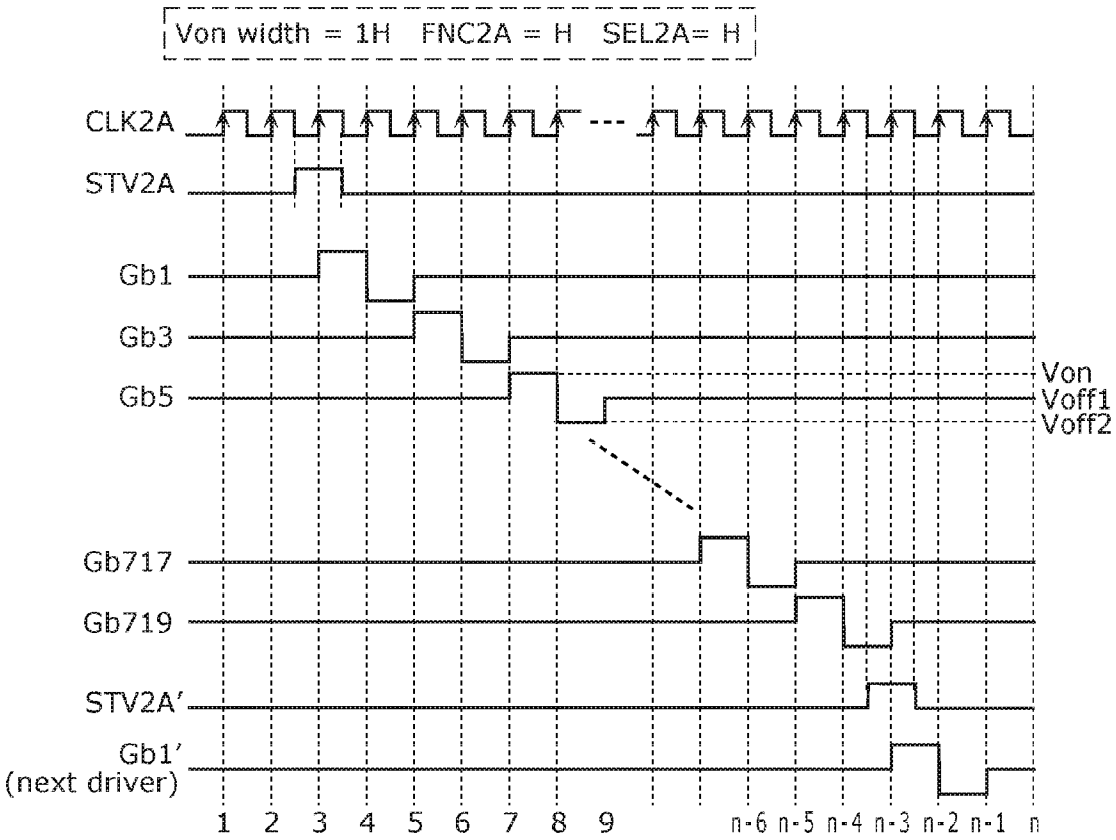
FIG. 26 is a timing chart related to the N-channel transistor.
Figure 27:
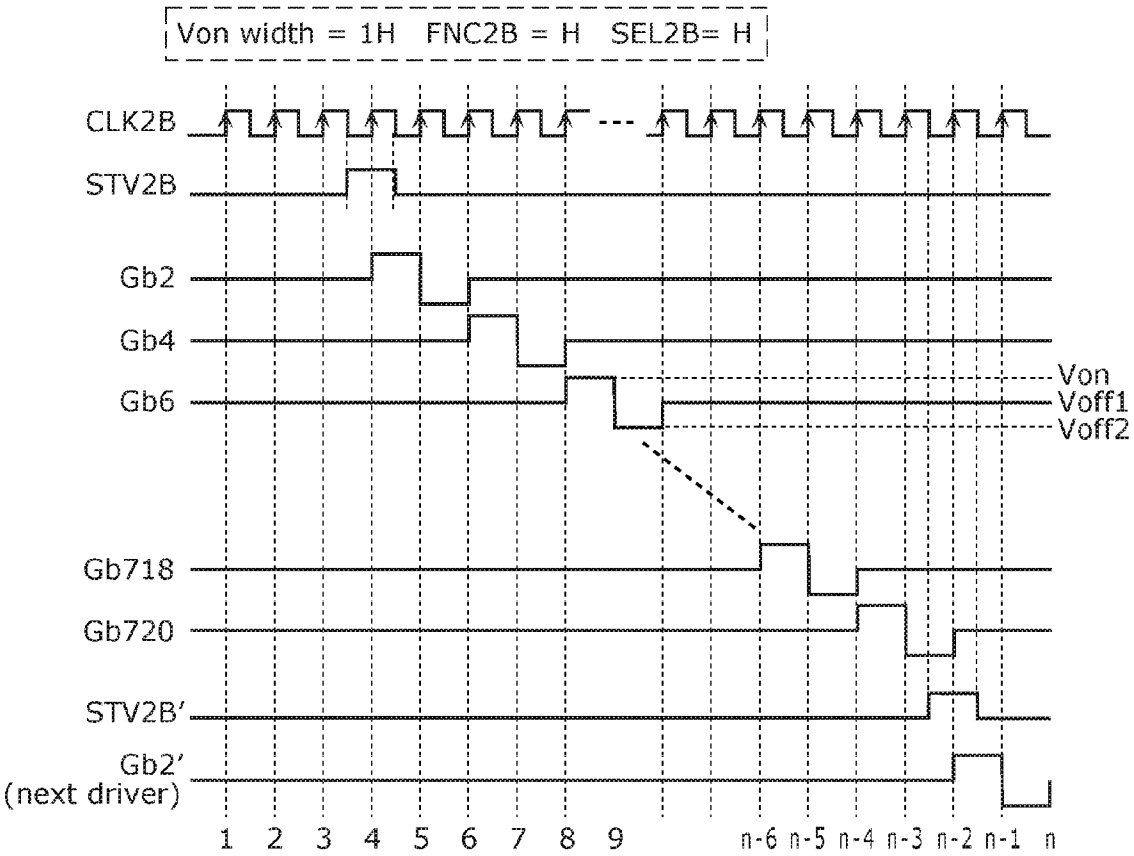
FIG. 27 is a timing chart related to the N-channel transistor.
Figure 28:
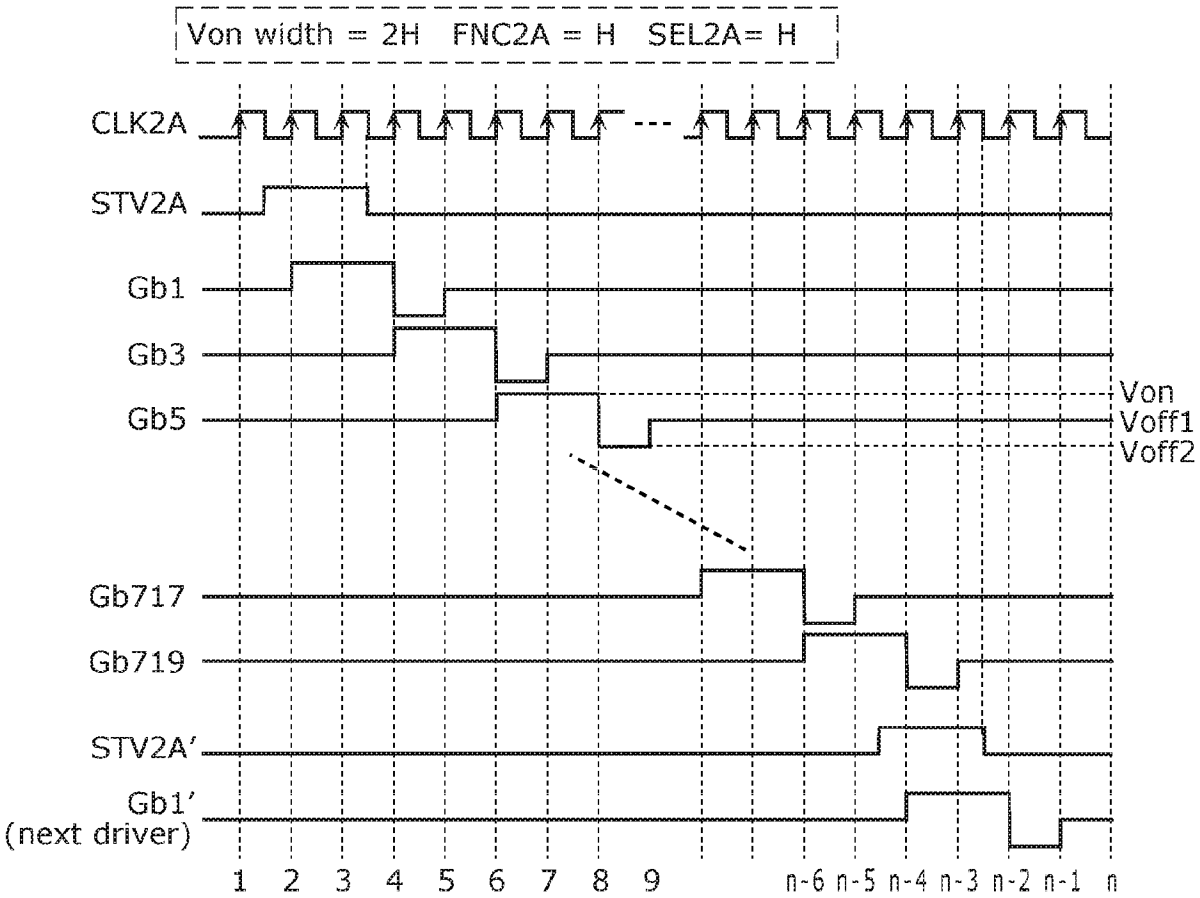
FIG. 28 is a timing chart related to the N-channel transistor.
Figure 29:
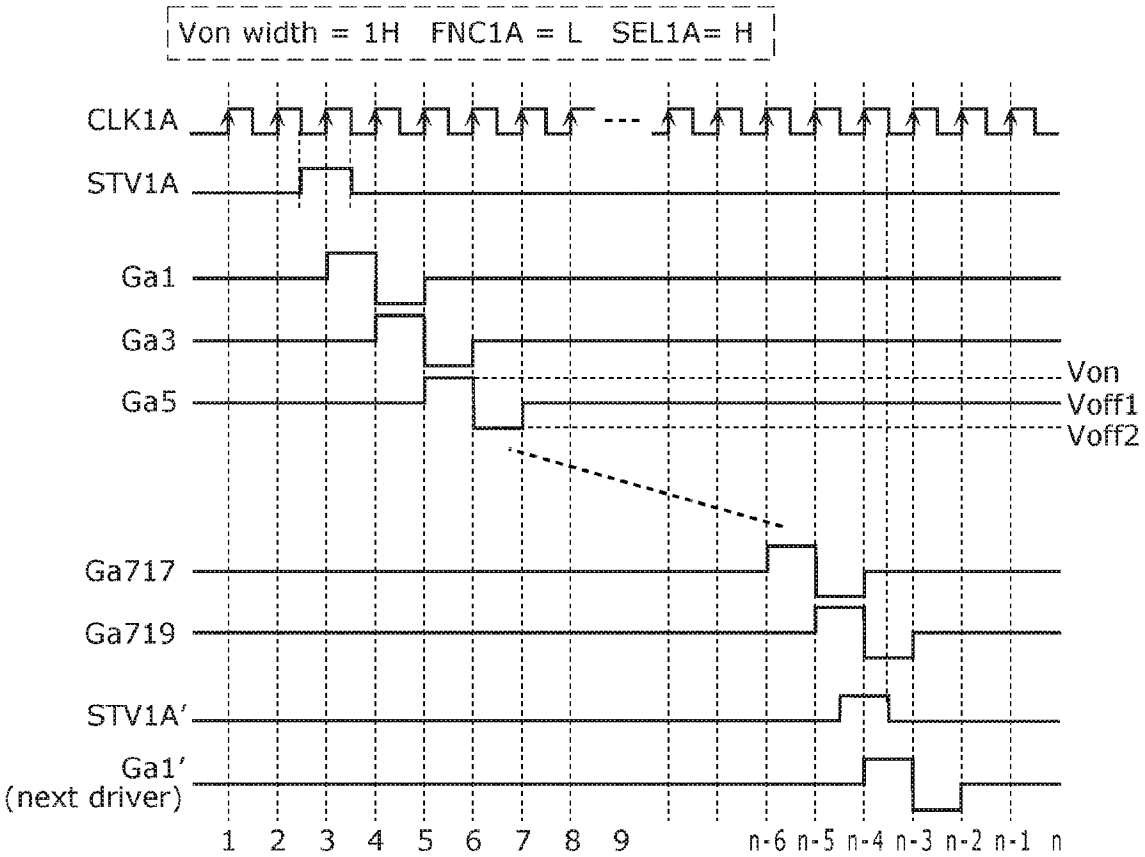
FIG. 29 is a timing chart related to the N-channel transistor.
Figure 30:
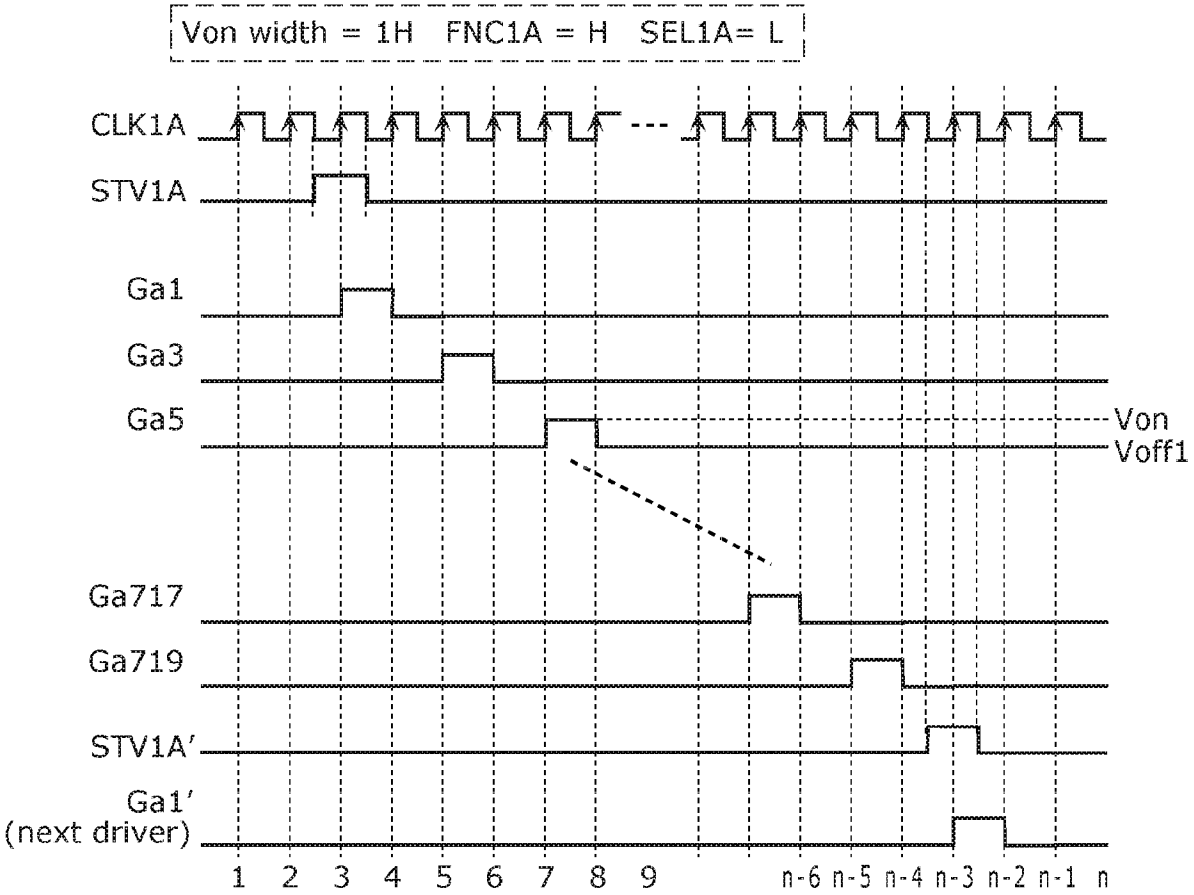
FIG. 30 is a timing chart related to the N-channel transistor.
Figure 31:
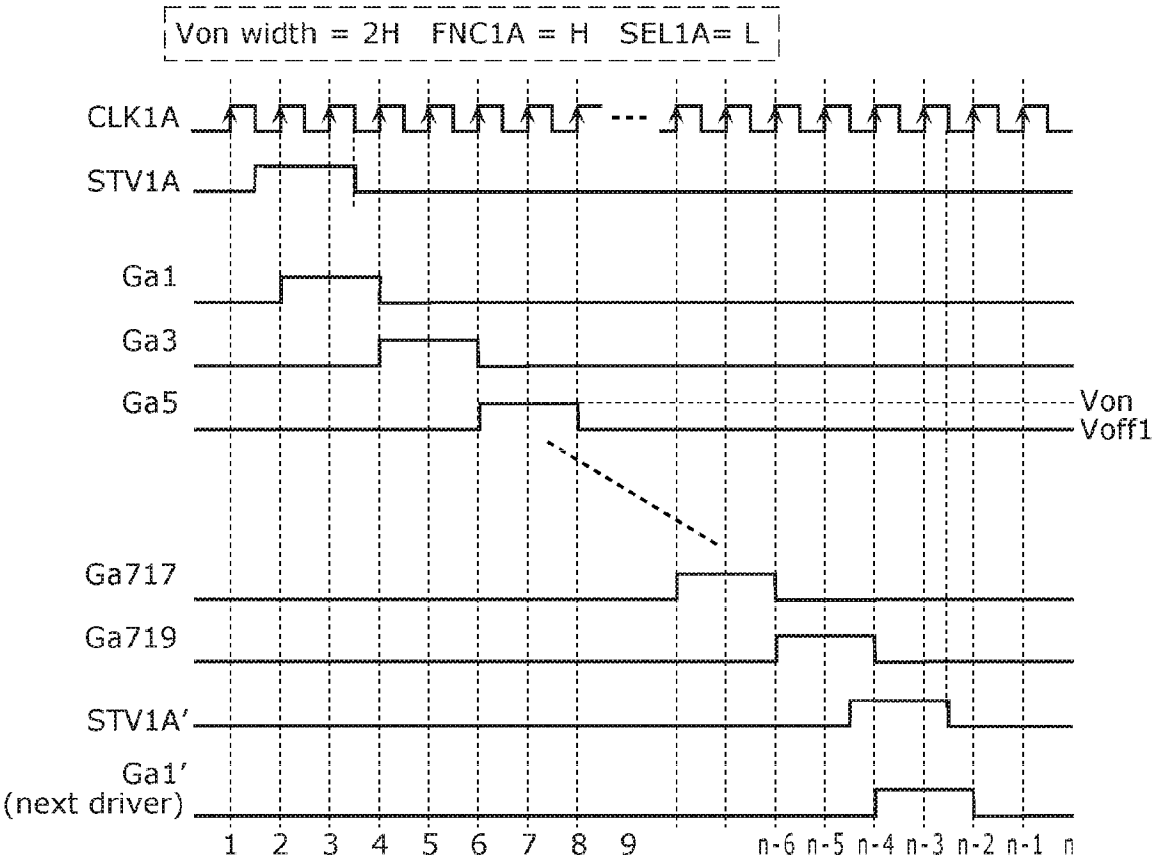
FIG. 31 is a timing chart related to the N-channel transistor.

FIG. 7 illustrates the case where the switching transistors are the P-channel transistors, and FIG. 24 illustrates the case where the switching transistors are the N-channel transistors. Accordingly, FIG. 7 corresponds to FIG. 24. Likewise, FIG. 8 corresponds to FIG. 25. FIG. 12 corresponds to FIG. 26, and FIG. 13 corresponds to FIG. 27. FIG. 14 corresponds to FIG. 28, and FIG. 15 corresponds to FIG. 29. FIG. 16 corresponds to FIG. 30, and FIG. 17 corresponds to FIG. 31.

Figure 6:
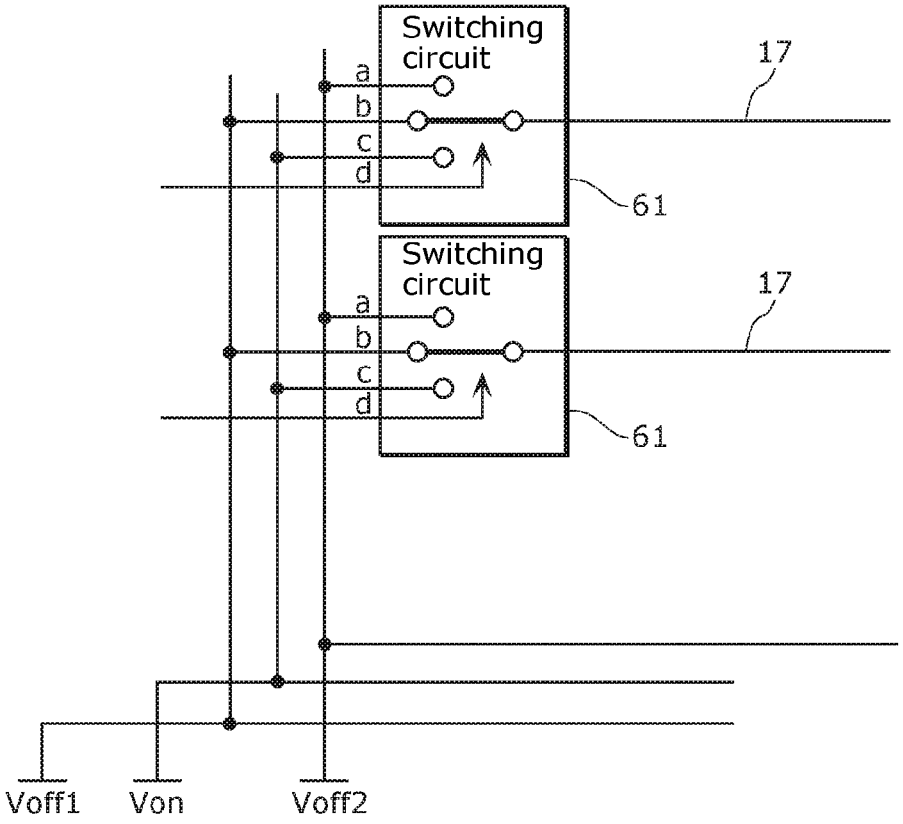
FIG. 6 is a diagram illustrating application of the gate voltage binary driving and the gate voltage ternary driving to gate signal lines.

FIG. 6 is a diagram illustrating application of the gate voltage binary driving and the gate voltage ternary driving to the gate signal lines 17. Switching circuits 61 include analog switches. The OFF voltage 1 (Voff1) is applied to terminals b of the switching circuits 61. The OFF voltage 2 (Voff2) is applied to terminals a of the switching circuits 61. The ON voltage (Von) is applied to terminals c of the switching circuits 61.

Terminals d of the switching circuits 61 each are applied with a 2-bit logic signal, thereby selecting one of the terminals a, b, and c, and a selected voltage (Von, Voff1, or Voff2) is applied to the gate signal lines 17.

As illustrated in FIG. 3, the gate driver ICs 12 according to the present disclosure each include two scanning and outputting buffer circuits so as to correspond to the gate signal lines 17 of two types of each of the pixels. The scanning and outputting buffer circuits are two scanning and outputting buffer circuits each including a shift register.

In FIG. 3, the connecting terminals 35 are connecting terminals of the gate driver IC 12, and the output terminals 34 are output terminals connecting the gate signal lines 17 and the lines of the gate driver IC 12. In addition, the gate driver IC 12 is a chip on flexible (COF) IC, in other words, a driver IC is mounted on a flexible substrate.

The scanning and outputting buffer circuit 31*a* drives the gate signal line 17*a* (GS). The scanning and outputting buffer circuit 31*a* sets the terminal SEL2A to "H", and the gate voltage ternary driving is selected. The switching transistor 11*b* is a transistor which applies a video signal voltage to the pixel 16, and requires a high slew rate because switching between ON and OFF needs to be operated at high speed. In order to implement the high slew rate, the bilateral driving is applied to the gate signal line 17*a* by the gate driver IC 12*a* and the gate driver IC 12*b*.

The scanning and outputting buffer circuit 31*b* sets the terminal SEL2B to "L", and the gate voltage binary driving is selected. The switching transistor 11*d* has a function of interrupting or supplying current to be supplied to the EL element. Interrupting or supplying current to be supplied to the EL element does not require a high-speed operation. For that reason, the gate voltage binary driving is applied to the gate signal line 17*b*, and ON voltage and OFF voltage 1 are applied. In addition, the gate signal line 17*b* is driven by the unilateral driving by only the gate driver IC 12*a*.

Figure 9:
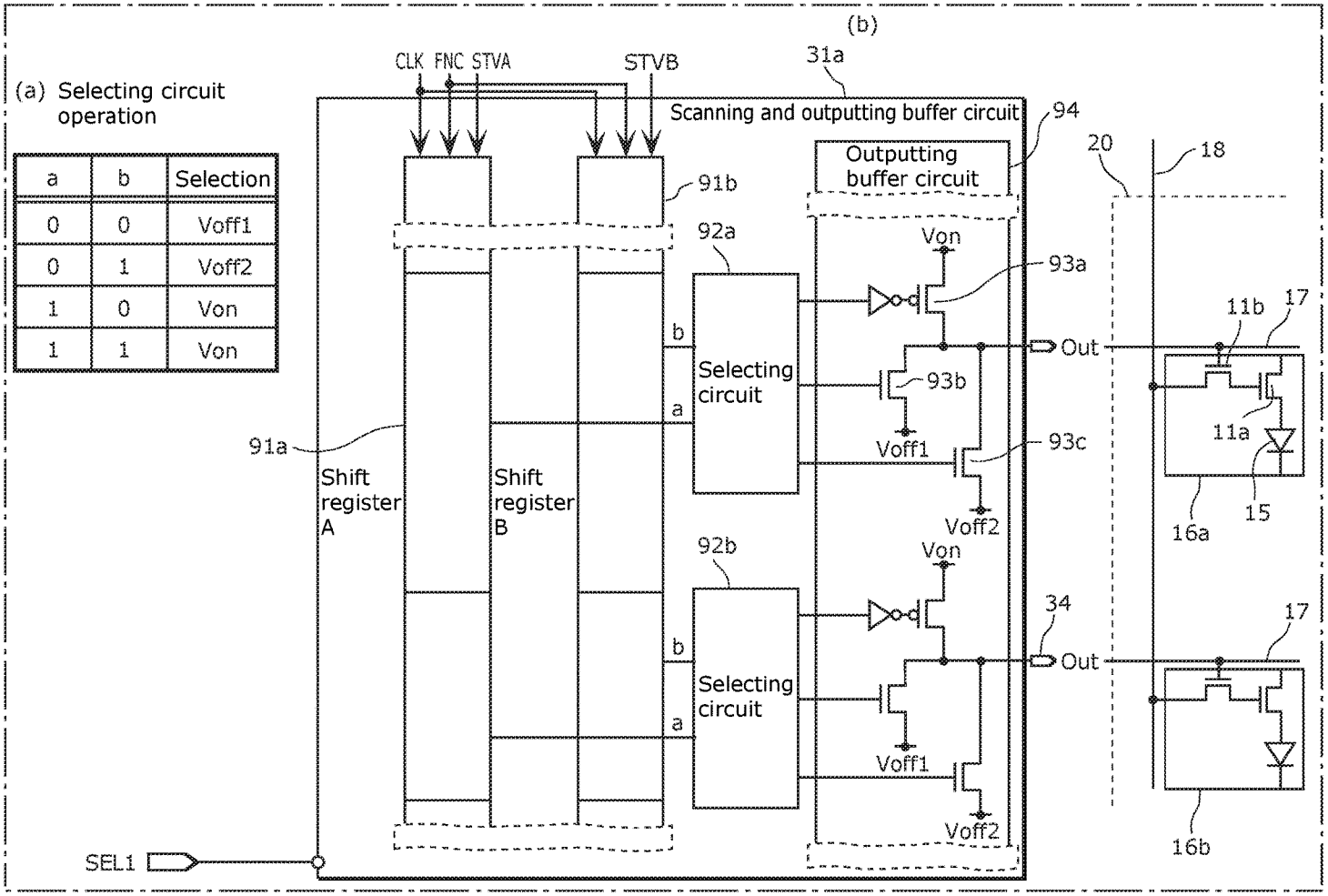
FIG. 9 is a configuration diagram of the scanning and outputting buffer circuit.

FIG. 9 is a diagram explaining the gate driver ICs 12 according to the present disclosure which implement the gate voltage ternary driving. As illustrated in FIG. 9, the scanning and outputting buffer circuits 31 each include two shift register circuits (shift register circuits 91*a* and 91*b*).

FIG. 3 illustrates one of the gate driver ICs 12 including two scanning and outputting buffer circuits. FIG. 9 illustrates one of the scanning and outputting buffer circuits 31 included in the gate driver ICs 12.

An STVA signal and an STVB signal [strobe (data) signal] are generated from the STV2A signal. In addition, an FNC signal is generated from the CTL2A signal. The CLK2A signal is inputted as a CLK signal.

The strobe (data) signal is inputted into the shift register circuit 91*a* through the terminal STVA, and the strobe (data) signal is inputted into the shift register circuit 91*b* through the terminal STVB. The same clock (CLK) is applied to the shift register circuits 91, and data in the shift register circuits 91 is shifted.

An output a of the shift register circuit 91*a* and an output b of the shift register circuit 91*b* are applied to the selecting circuits 92, the selecting circuits 92 perform a logic process and a timing process to turn ON corresponding transistors 93 of the outputting buffer circuit 94. Transistors 93*a*, 93*b*, and 93*c* are controlled so that only one of the transistors is turned ON at a time. The selecting circuits 92 are controlled by the logic of the SEL1 signal.

The Von voltage is applied to the gate signal lines 17 by turning ON the transistors 93*a* of the outputting buffer circuit 94. The Voff1 voltage is applied to the gate signal lines 17 by turning ON the transistors 93*b* of the outputting buffer circuit 94. In the same manner as above, the Voff2 voltage is applied to the gate signal lines 17 by turning ON the transistors 93*c* of the outputting buffer circuit 94.

1-1-3-3. Relation of Connection with the Display Screen

As described above, the gate signal line 17*a* in the image display apparatus according to the present disclosure is applied with the bilateral driving, and the gate signal line 17*b* is applied with the unilateral driving.

FIG. 4 is a configuration diagram of the image display apparatus according to the present disclosure, on which the gate driver ICs 12 are mounted. It should be noted that, although the pixels 16 for only one pixel column are illustrated in the display screen 20, the pixels 16 are disposed in a matrix in the display screen 20. In addition, the gate driver IC 12*a* and the gate driver IC 12*b* are driver ICs of the same specification. More specifically, the gate driver ICs 12 disposed or mounted on the right side and the left side of the display screen 20 are semiconductor chips of the same specification.

It should be noted that the gate driver ICs 12 are described as semiconductor chips in the Description, the gate driver ICs 12 are not limited to the semiconductor chips. For example, the gate driver ICs 12 may each be formed by directly forming a gate driver circuit on a glass substrate through a low-temperature poly silicon technique.

The gate signal lines 17*a* are applied with the bilateral driving and the gate signal lines 17*b* are applied with the unilateral driving. The scanning and outputting buffer circuit 31*a* of the gate driver IC 12*a* drives the gate signal lines 17*a*, and the scanning and outputting buffer circuit 31*b* of the gate driver IC 12*a* drives the gate signal lines 17*b*.

The scanning and outputting buffer circuit 31*a* drives the gate signal lines 17*a* corresponding to odd-numbered pixel rows. In FIG. 4, the pixels 16*a* and 16*c* correspond to the odd-numbered pixel rows. The scanning and outputting buffer circuit 31*b* of the gate driver IC 12*b* drives the gate signal lines 17*b* corresponding to even-numbered pixel rows. In FIG. 4, the pixel 16*b* corresponds to the even-numbered pixel row.

The scanning and outputting buffer circuit 31*b* of the gate driver IC 12*a* applies the unilateral driving to the gate signal lines 17*b*. Accordingly, data is inputted to the terminal STV1B of the scanning and outputting buffer circuit 31*b*, and a position of the data in the shift register circuit is sequentially shifted in synchronization with a clock signal inputted to the terminal CLK1B, thereby making it possible to move a position at which the ON voltage is applied to the gate signal lines 17*b*. The terminal SEL1B is applied with logic settings to "L", and the gate voltage binary driving is performed. The terminal CTL1B is set to the level "L".

According to the Description, the ON voltage is output to a position at which data is present in the shift register circuit, and the OFF voltage is output to a position at which data is not present in the shift register circuit.

The gate signal lines 17*a* are applied with the bilateral driving by the scanning and outputting buffer circuit 31*a* of the gate driver IC 12*a* and the scanning and outputting buffer circuit 31*a* or the scanning and outputting buffer circuit 31*b* of the gate driver IC 12*b*.

The scanning and outputting buffer circuit 31*a* of the gate driver IC 12*b* drives the odd-numbered pixel rows, and the scanning and outputting buffer circuit 31*b* of the gate driver IC 12*b* drives the even-numbered pixel rows. Accordingly, the gate driver IC 12*b* operates at a clock frequency of half of a clock frequency of the gate driver IC 12*a*. In the case of selecting one pixel row at a time, the ON voltage is temporally alternately applied to the gate signal lines 17*a* of the odd-numbered pixel rows selected by the scanning and outputting buffer circuit 31*a* of the gate driver IC 12*b* and the gate signal lines 17*a* of the even-numbered pixel rows selected by the scanning and outputting buffer circuit 31*b* of the gate driver IC 12*b*. The operation speed of the gate driver IC 12*b* is half of the operation speed of the gate driver IC 12*a*. The operation clock frequency of the gate driver IC 12*a* is an integral multiple of the operation clock frequency of the gate driver IC 12*b*. As described above, the scanning and outputting buffer circuit 31*a* of the gate driver IC 12*b* is in charge of driving the gate signal lines 17*a* of the odd-numbered pixel rows, and the scanning and outputting buffer circuit 31*b* of the gate driver IC 12*b* is in charge of driving the signal line 17*a* of the even-numbered pixel rows. Accordingly, the total number of the gate driver ICs 12*b* required is half of the total number of the gate driver ICs 12*a* required.

As illustrated in FIG. 1 and FIG. 4, for example, a plurality of gate signal lines 17 are formed or disposed in a pixel, the gate driver ICs 12*a* and 12*b* are connected to the both ends of at least one of the gate signal lines 17, and the gate driver IC 12*a* is connected to only one end of at least one of the gate signal lines 17 according to an embodiment of the present disclosure. In addition, the image display apparatus according to an embodiment of the present disclosure includes the gate driver ICs 12*a* and 12*b* disposed on the left side and the right side of the display screen 20 which are gate driver ICs of substantially the same specification, and the total number of the gate driver ICs 12*a* disposed on the left side of the display screen 20 and the total number of the gate driver ICs 12*b* disposed on the right side of the display screen 20 are different. Furthermore, when there is an n-th (n is an integer of at least 2) difference between the clock frequency inputted to the gate driver IC 12*a* and the clock frequency inputted to the gate driver IC 12*b*, or the clock frequency inputted to the gate driver IC 12*a* and the clock frequency inputted to the gate driver IC 12*b* are substantially the same, the gate driver IC 12*b* performs n-th (n is an integer of at least 2) operations with respect to the operations performed by the gate driver IC 12*a* to implement one operation of the gate driver IC 12*a* (for example, one shift operation of the shift register).

1-2. Driving Method

Next, a driving method of the image display apparatus configured as stated above shall be described.

First, an operation of the scanning and outputting buffer circuits 31 in the case of the gate voltage binary driving and an operation of the scanning and outputting buffer circuits 31 in the case of the gate voltage ternary driving shall be described, focusing on one of the gate signal lines 17 among the plurality of gate signal lines 17 connected to the scanning and outputting buffer circuits 31.

Data is inputted to the terminal STV1B of the scanning and outputting buffer circuit 31*b* of the gate driver IC 12*a*, and a position of the data in the shift register circuit is sequentially shifted in synchronization with a clock signal inputted to the terminal CLK1B, thereby making it possible to move a position at which the ON voltage is applied to the gate signal lines 17*b*. The terminal SEL1B is applied with logic settings to "L", and the gate voltage binary driving is performed. The terminal CTL1B is set to the level "L".

FIG. 5 illustrates a timing chart indicating a signal applied to terminals CTL (CTL2A and CTL2B) and a gate voltage output to the gate signal lines 17***a* and 17*b*. More specifically, FIG. 5 illustrates each of the gate voltage binary driving and the gate voltage ternary driving. FIG. 5 illustrates an example in the case where the switching transistor 11 is the P-channel transistor. FIG. 23 illustrates an example in the case where the switching transistor 11 is the N-channel transistor. More specifically, the voltage waveform of a voltage applied to the gate signal lines 17 has a polarity opposite to a polarity of the switch transistor.

A signal to be applied to the terminal CTL (CTL2A and CTL2B) is a signal which is synchronized with a clock of the terminals CLK (CLK2A and CLK2B). Data inputted to the terminal STV2A (STV2B) is shifted in the scanning and outputting buffer circuits 31 (31*a* and 31*b*) by a clock inputted to the terminal CLK2A (CLK2B).

The timing of applying a voltage to the gate signal lines 17*a* and the type of the voltage are controlled so that they are the same between the scanning and outputting buffer circuit 31*a* of the gate driver IC 12*a* and the scanning and outputting buffer circuit 31*a* of the gate driver IC 12*b*. In addition, the timing of applying a voltage to the gate signal lines 17*a* and the type of the voltage are controlled so that they are the same between the scanning and outputting buffer circuit 31*a* of the gate driver IC 12*a* and the scanning and outputting buffer circuit 31*b* of the gate driver IC 12*b*.

The gate voltage binary driving and the gate voltage ternary driving are set by the logic signals applied to the terminal SEL (SEL1A, SEL1B, SEL2A, and SEL2B). In FIG. 4, SEL1A, SEL2A, and SEL2B are set to "H", and the gate voltage ternary driving is applied to the scanning and outputting buffer circuit 31***a* of the gate driver IC 12*a* and the scanning and outputting buffer circuit 31*a* and 31*b* of the gate driver IC 12*b*. In addition, SEL1B of the scanning and outputting buffer circuit 31*b* of the gate driver IC 12*a* is set to "L", and the gate voltage binary driving is set to be performed.

In the case of the gate voltage binary driving, a voltage applied to the gate signal lines 17 changes from Von to Voff1 in synchronization with rising of a signal applied to the terminal CTL (CTL1A, CTL1B, CTL2A, and CTL2B). The circuit configurations illustrated in FIG. 6 and FIG. 9** are used for explaining the changing of a voltage to be applied.

In the case of the gate voltage ternary driving, a voltage applied to the gate signal lines 17 changes from Von to Voff2 in synchronization with rising of a signal applied to the terminal CTL (CTL1A, CTL1B, CTL2A, and CTL2B). Subsequently, the Voff2 voltage changes to the Voff1 voltage with rising of a voltage applied to the terminal CLK (CLK1A, CLK1B, CLK2A, and CLK2B), and the voltage applied to the gate signal lines 17 is kept at Voff1 from this point forward. Here, a period of applying Voff2 is set to a period of 1H (one horizontal scanning period, selecting period for one pixel row) or shorter. A period in which a pulse applied to the terminal CTL (CTL1A, CTL1B, CTL2A, and CTL2B) is at the level H is equal to or shorter than a period in which a pulse applied to the terminal CLK (CLK1A, CLK1B, CLK2A, and CLK2B) is at the level H. A signal to be applied to the terminal CTL (CTL1A, CTL1B, CTL2A, and CTL2B) may be an inversion signal of a signal to be applied to the terminal CLK (CLK1A, CLK1B, CLK2A, and CLK2B).

The signal to be applied to the terminal CLK (CLK1A, CLK1B, CLK2A, and CLK2B) and the signal to be applied to the terminal CTL (CTL1A, CTL1B, CTL2A, and CTL2B) are generated in synchronization with an MCLK signal (clock) or by frequency-dividing the MCLK signal as illustrated in FIG. 7.

Next, an operation of the scanning and outputting buffer circuits 31 which performs the gate voltage binary driving/the gate voltage ternary driving with such timing as described above shall be described, focusing on the plurality of gate signal lines 17 connected to the scanning and outputting buffer circuits 31.

First, an operation of the scanning and outputting buffer circuit 31*a* of the gate driver IC 12*b* shall be described.

FIG. 7 illustrates a timing chart of an operation of the scanning and outputting buffer circuits 31*a* included in the gate driver IC 12*b*. The terminal SEL2A is set to "H", and set to the gate voltage ternary driving. The terminal SEL2B of the scanning and outputting buffer circuits 31*b* is set to "L", and set to the gate voltage binary driving.

The STV2A signal is a data signal (strobe signal). The STV2A signal is inputted to the scanning and outputting buffer circuit 31*a* in synchronization with the rising of the CLK2A signal. Gb1 denotes an output waveform of the gate signal line Gb1, Gb3 denotes an output waveform of the gate signal line Gb3, and Gb5 denotes an output waveform of the gate signal line Gb5. Likewise, Gb717 denotes an output waveform of the gate signal line Gb717, and Gb719 denotes an output waveform of the gate signal line Gb719.

The gate driver ICs 12 according to the present disclosure are each assumed to include the output terminals for 720 channels. In addition, according to the present disclosure, necessary gate driver ICs 12 to be matched to the total number of pixel rows of the display screen 20 are mounted or connected.

The gate signal line Gb1 is applied with the Von voltage in synchronization with the rising of the CLK2A signal, and applied with the Voff2 voltage in synchronization with the rising of the CTL2A signal. Then, the Voff1 voltage is applied in synchronization with a rising signal of the CLK2Ab signal, and the Voff1 voltage is kept until the next gate signal line Gb1 is selected.

In the same manner as above, the gate signal line Gb3 is applied with the Von voltage in synchronization with the rising of the CLK2A signal, and applied with the Voff2 voltage in synchronization with the rising of the CTL2A signal. Then, the Voff1 voltage is applied in synchronization with the rising of the CLK2A, and the Voff1 voltage is kept until the next gate signal line Gb3 is selected.

In addition, the gate signal line Gb5 is applied with the Von voltage in synchronization with the rising of the CLK2A signal, and applied with the Voff2 voltage in synchronization with the rising of the CTL2A signal. Then, the Voff1 voltage is applied in synchronization with the rising of the CLK2A, and the Voff1 voltage is kept until the next gate signal line Gb5 is selected.

In the same manner as above, the gate voltage ternary driving is sequentially applied to the odd-numbered gate signal lines 17 which correspond to the scanning and outputting buffer circuit 31*a* of the gate driver IC 12*b*. It should be noted that, when the terminal SEL2A is set to "L", the gate voltage binary driving is applied and the Von voltage and the Voff1 voltage are applied to each of the odd-numbered gate signal lines instead of the Voff2 voltage.

Next, operations of the scanning and outputting buffer circuit 31*a* and the scanning and outputting buffer circuit 31*b* of the gate driver IC 12*b* shall be described.

Figure 8:
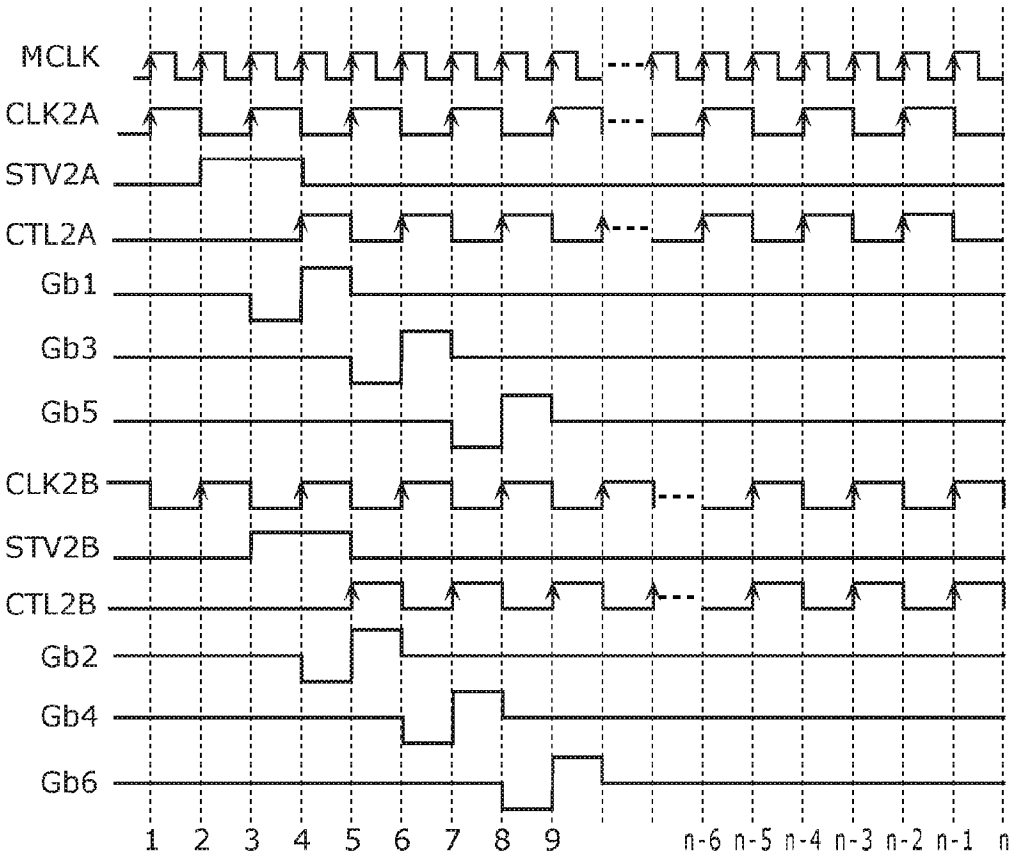
FIG. 8 is a timing chart illustrating an operation of the scanning and outputting buffer circuit of the gate driver IC.

FIG. 8 illustrates a timing chart of the scanning and outputting buffer circuits 31*a* and 31*b* included in the gate driver IC 12*b*. The scanning and outputting buffer circuit 31*a* is in charge of the gate signal lines 17*a* of the odd-numbered pixel rows, and the scanning and outputting buffer circuit 31*b* is in charge of the gate signal lines 17*a* of the even-numbered pixel rows. In other words, the scanning and outputting buffer circuit 31*a* applies the ON voltage sequentially to the gate signal lines Gb1, Gb3, Gb5, Gb7, . . . , Gb715, Gb717, and Gb719. The scanning and outputting buffer circuit 31*b* is in charge of the gate signal lines 17*a* of the even-numbered pixel rows. In other words, the scanning and outputting buffer circuit 31*b* applies the ON voltage sequentially to the gate signal lines Gb2, Gb4, Gb6, Gb8, . . . , Gb716, Gb718, and Gb720.

It should be noted that, although the period of applying the ON voltage (Von) to the gate signal lines 17 is a period of 1H according to the embodiment described above, the period of applying the ON voltage according to the present invention is not limited to this. The period of applying the ON voltage may be 2H or longer. In addition, a plurality of portions to which the ON voltage is applied may be present in the display screen 20.

The matters described above hold true for the Voff2 voltage. In addition, although the ON voltage is described as one type, the type of the ON voltage is not limited to this. For example, the ON voltage of a plurality of types, such as Von1 and Von2, may be applied to the gate signal lines 17.

The upper portion of the timing chart (CLK2A, STV2A, CTL2A, Gb1, Gb3, Gb5, . . . ) illustrated in FIG. 8 has already been described in FIG. 7, and thus description will be omitted.

The lower portion of the timing chart (CLK2B, STV2B, CTL2B, Gb2, Gb4, Gb6, . . . ) illustrated in FIG. 8 indicates an operation of the scanning and outputting buffer circuit 31*b* of the gate driver IC 12*b*.

The gate signal line Gb2 is applied with the Von voltage in synchronization with the rising of the CLK2B signal, and applied with the Voff2 voltage in synchronization with the rising of the CTL2B signal. Then, the Voff1 voltage is applied in synchronization with a rising signal of the CLK2B, and the Voff1 voltage is kept until the next gate signal line Gb2 is selected.

In the same manner as above, the gate signal line Gb4 is applied with the Von voltage in synchronization with the rising of the CLK2B signal, and applied with the Voff2 voltage in synchronization with the rising of the CTL2B signal. Then, the Voff1 voltage is applied in synchronization with a rising signal of the CLK2B, and the Voff1 voltage is kept until the next gate signal line Gb4 is selected.

In addition, the gate signal line Gb6 is applied with the Von voltage in synchronization with the rising of the CLK2B signal, and applied with the Voff2 voltage in synchronization with the rising of the CTL2B signal. Then, the Voff1 voltage is applied in synchronization with a rising signal of the CLK2B, and the Voff1 voltage is kept until the next gate signal line Gb6 is selected.

In the same manner as above, the gate voltage ternary driving is sequentially applied to the even-numbered gate signal lines 17 which correspond to the scanning and outputting buffer circuit 31*b* of the gate driver IC 12*b*.

The timing chart in FIG. 8 illustrates that a period of applying the ON voltage to the Gb1 is one cycle of MCLK, which is one horizontal scanning period. A period of applying the ON voltage to the Gb2 is one cycle of MCLK, which is one horizontal scanning period. In addition, the ON voltage positions of Gb1 and Gb2 change in a period of 1H. The same holds true for Gb2, Gb3, . . . .

In addition, the ON voltage positions of Ga1 and Ga2 of the scanning and outputting buffer circuit 31*a* of the gate driver IC 12*a* change in a period of 1H. The same holds true for Ga3, Ga4, . . . .

As described above, application of the ON voltage and the OFF voltage to the gate signal line 17*a* of each of the pixel rows is controlled in synchronization with the gate driver ICs 12*a* and 12*b*.

It should be understood that the period of applying the ON voltage (Von) may be 2H or longer. The application is controlled such that the scanning and outputting buffer circuit 31*a* of the gate driver IC 12*a* and the scanning and outputting buffer circuits 31*a* and 31*b* of the gate driver IC 12*b* are synchronized, and the same voltage is applied without delay to the gate signal lines 17 selected by the scanning and outputting buffer circuits 31 of both sides.

1-3. Advantageous Effects Etc.

As described above, a feature of the image display apparatus according to the present disclosure is to include a display screen in which pixels each having an EL element are disposed in a matrix, and a sequentially driving circuit such as a gate driver IC.

The image display apparatus according to the present disclosure includes the first gate driver IC and the second gate driver IC. The gate driver ICs each include at least first and second shift register circuits. The first gate signal line and the second gate signal line are formed on the pixels disposed in a matrix in the display screen. The first gate signal line has an end connected to the output terminal of the first gate driver IC and the other end connected to the output terminal of the second gate driver IC, the second gate signal line has an end connected to the output terminal of the first gate driver IC and the other end is opened. The first shift register circuit formed in the first gate driver IC controls the first gate signal line, and the second shift register circuit formed in the first gate driver IC controls the second gate signal line. The first shift register circuit formed in the second gate driver IC controls the first gate signal line located in the first pixel row, and the second shift register circuit formed in the second gate driver IC controls the second gate signal line located in the second pixel row.

The image display apparatus according to the present disclosure includes: the source driver circuit which outputs a video signal to be applied to the pixels; the source signal lines which transmit the video signal output by the source driver circuit; the first gate driver circuit; the second gate driver circuit; and the first gate signal line and the second gate signal line which transmit the selection voltage for selecting a pixel, the first non-selection voltage for placing a pixel in a non-selection state, or the second non-selection voltage for placing a pixel in a non-selection state.

The first gate driver circuit and the second gate driver circuit each select a voltage from among the first non-selection voltage, the second non-selection voltage, and the selection voltage, and output the selected voltage to the first gate signal line and the second gate signal line. The pixels each include: the driving transistor; the first switching transistor; and the second switching transistor. The first gate driver circuit and the second gate driver circuit each include the first scanning circuit and the second scanning circuit. The second gate driver circuit includes the first control terminal for controlling the first scanning circuit and second control terminal for controlling the second scanning circuit.

The operation clock frequency of the first gate driver circuit is an integral multiple of the operation clock frequency of the second gate driver circuit, and the scanning circuits each operate in synchronization with the clock frequency.

The display screen includes the first pixel row and the second pixel row. The first gate signal line of the first pixel row is connected to the first scanning circuit of the first gate driver circuit and the first scanning circuit of the second gate driver circuit. The second gate signal line of the first pixel row is connected to the second scanning circuit of the first gate driver circuit. The first gate signal line of the second pixel row is connected to the first scanning circuit of the first gate driver circuit and the second scanning circuit of the second gate driver circuit. The scanning circuits of the gate driver circuit each output the second non-selection voltage as a result of control of the control terminals at the time of outputting the selection voltage, and outputs the first non-selection voltage in synchronization with the clock frequency after the control of the control terminals.

With the-above described configuration, it is possible to provide an image display apparatus including a gate driver IC which is highly versatile and can be used irrespective of the total number and arrangement of the terminals of the gate signal lines and irrespective of the specification or the like of the image display apparatus. In addition, it is possible to dispose the gate driver IC or configure the panel module so as to correspond to a slew rate required by each of the gate signal lines.

It should be noted that the gate driver ICs 12*a* and 12*b* correspond to the first gate driver circuit and the second gate driver circuit, respectively. In addition, the scanning and outputting buffer circuits 31*a* and 31*b* correspond to the first scanning circuit and the second scanning circuit, respectively. The switching transistors 11*b* and 11*d* correspond to the first switching transistor and the second switching transistor, respectively. The gate signal lines 17*a* and 17*b* correspond to the first gate signal line and the second gate signal line, respectively. The terminal CTL (CTL1A and CTL2A) of the scanning and outputting buffer circuit 31***a* corresponds to the first control terminal, and the terminal CTL (CTL1B and CTL2B) of the scanning and outputting buffer circuit 31***b* corresponds to the second control terminal.

Modification Example of Embodiment 1

Next, a modification example of Embodiment 1 shall be described.

Figure 10:
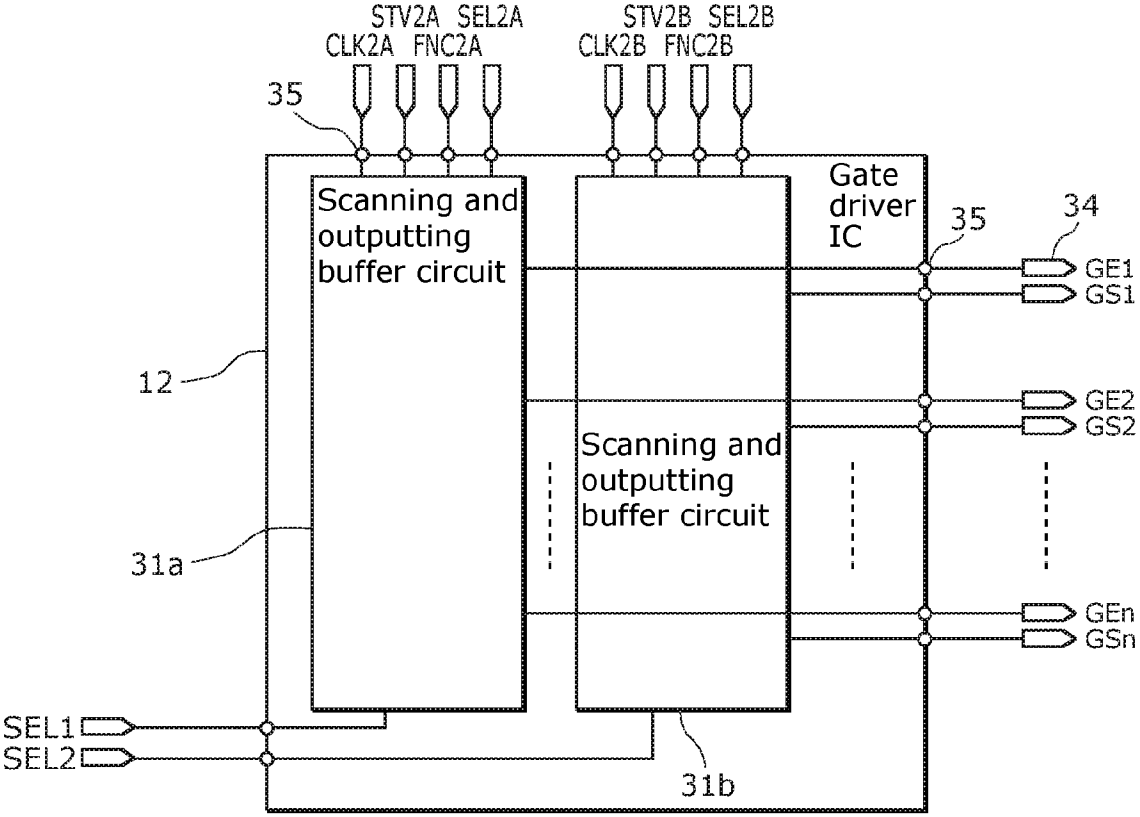
FIG. 10 is a block diagram illustrating a configuration of a gate driver IC according to a modification of Embodiment 1.
Figure 11:
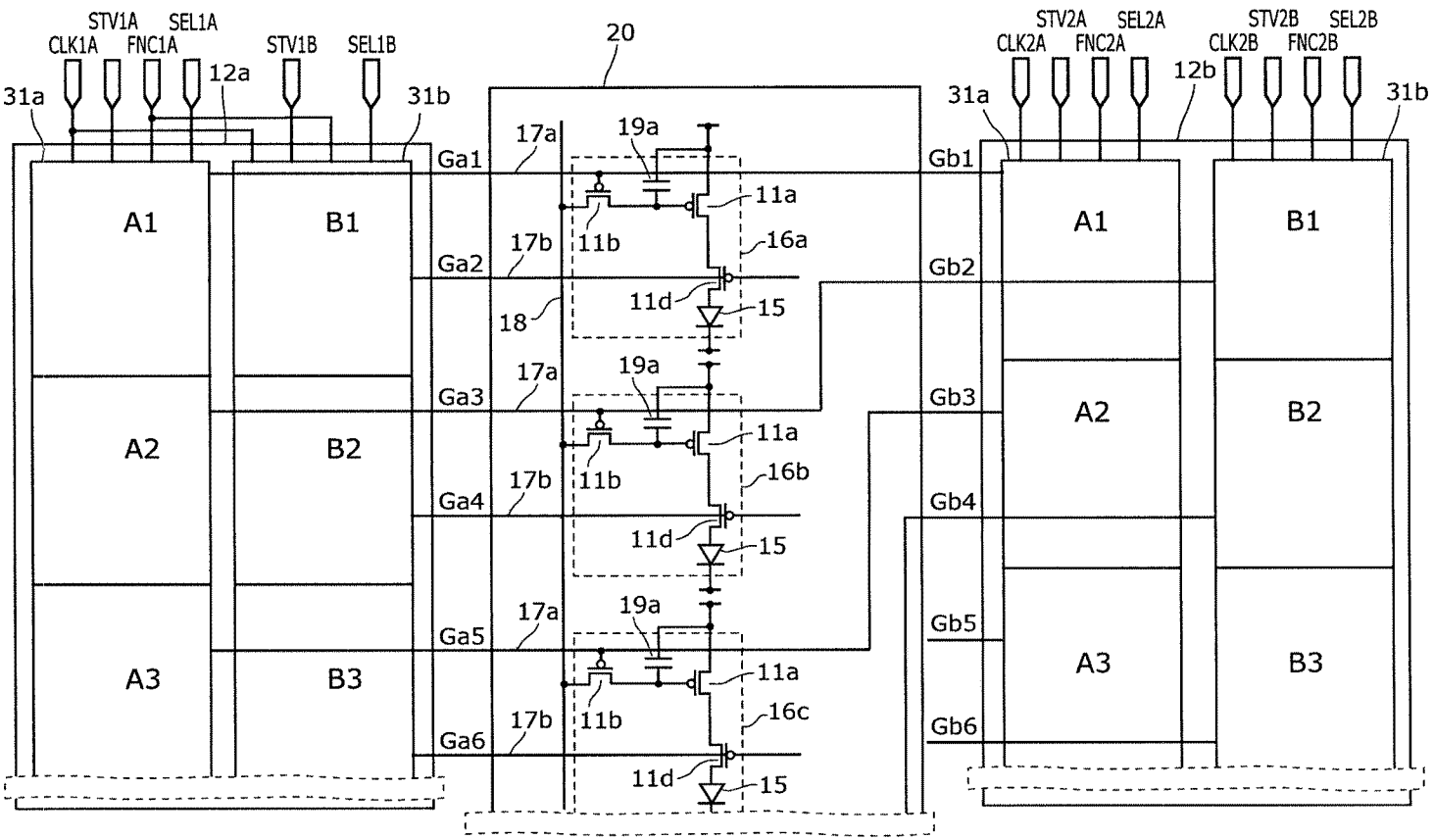
FIG. 11 is a configuration diagram of the image display apparatus according to the present disclosure, on which the gate driver IC according to the modification of Embodiment 1 is mounted.

FIG. 10 is a block diagram illustrating a configuration of a gate driver IC 12 according to a modification example of Embodiment 1 of the present disclosure. The gate driver IC 12 illustrated in FIG. 10 differs from the gate driver IC 12 illustrated in FIG. 3 in that the gate driver IC 12 illustrated in FIG. 10 includes input terminals FNC (FNC2A and FNC2B) in place of the terminals CTL (CTL2A and CTL2B). The same holds true for FIG. 4 and FIG. 11. FIG. 11 is a configuration diagram of the image display apparatus of the present disclosure, on which the gate driver ICs 12 according to the modification example of Embodiment 1 is mounted.

It should be noted that, although a period from a rising edge of an arbitrary CLK to a rising edge of the next clock is exemplified as one clock cycle of the clock CLK, the one clock cycle is not limited to this. For example, the one clock cycle may be a period from a falling edge of an arbitrary CLK to a falling edge of the next clock. In addition, when a shifting operation is performed or a change occurs at both the rising and falling of CLK, rising and falling of CLK correspond to a two clock cycle, and rising or falling of CLK corresponds to the one clock cycle. Furthermore, when a shifting operation is performed or a change occurs not at a falling edge of CLK** or a falling of a clock but with a voltage level of a clock, a clock cycle is determined based on a predetermined level.

In addition, the gate driver circuits according to an embodiment of the present disclosure, when the gate driver ICs 12*a* and 12*b* are of the same specification, and clock signals inputted have the same frequency, can be formed or set such that the shift register or the like of the gate driver IC 12*a* performs one shifting operation in one clock cycle (one operation), whereas the shift register or the like of the gate driver IC 12*b* performs one shifting operation in n (n is an integer of at least 2) clock cycle (n operation). The matters described above are applicable as appropriate to the examples of the disclosure according to the present invention. For example, the matters described above are also applicable to the examples of the disclosure illustrated in, for example, FIG. 4, FIG. 5, FIG. 7, FIG. 8, etc. It also should be understood that the matters described above are also applicable to the examples of the disclosure illustrated in FIG. 10, FIG. 11, FIG. 12 to FIG. 17, etc.

The terminals FNC (FNC2A and FNC2B) are logic terminals which perform control of data input (STVA and STVB) to the shift register circuits 91 illustrated in FIG. 9, control of clock control (CLK), and (ii) control of the selecting circuit 92. As illustrated in FIG. 7**, rising of CLK2A and rising of CTL2A are controlled by controlling the shift registers.

It should be noted that, although it is described that "one operation" is performed with rising of CLK according to an embodiment of the present disclosure, "one operation" is not limited to this, and one operation" may be performed with falling of UK. Furthermore, "one operation" may be performed with each of rising and falling of CLK. In addition, "one operation" may be performed according to a potential level. It should be understood that the matters described above are not limited to CLK but applied to other control signals as appropriate.

Although not illustrated in the shift register circuits in FIG. 9, a dividing circuit of the clock CLK, a control circuit for a shifting position of a data position in the shift register circuit 91, and the like are included in the shift register circuit 91. More specifically, the shifting state of FIG. 12 and the shifting state of FIG. 15 are switched according to the logic signal applied to the terminal FNC.

Figure 15:
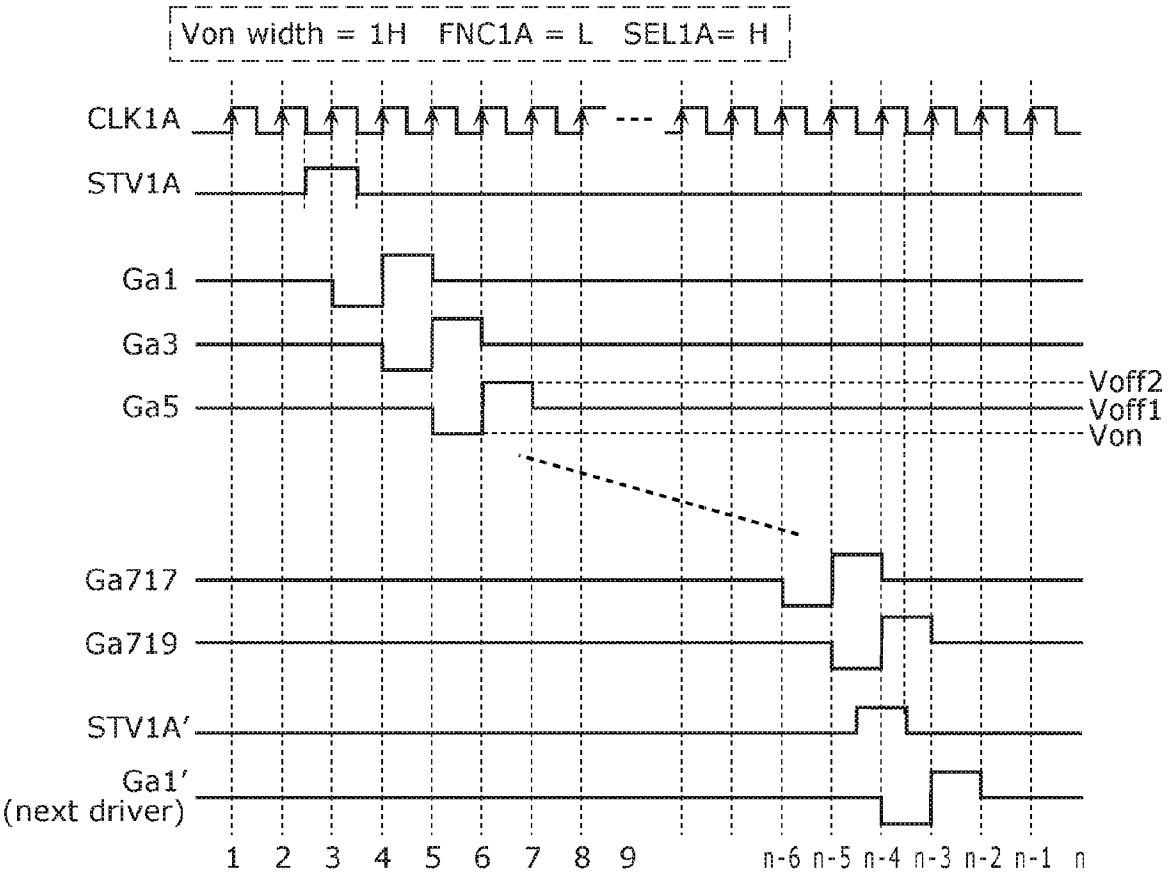
FIG. 15 is a timing chart illustrating an example of an operation of the scanning and outputting buffer circuit included in the gate driver IC illustrated in FIG. 11.
Figure 16:
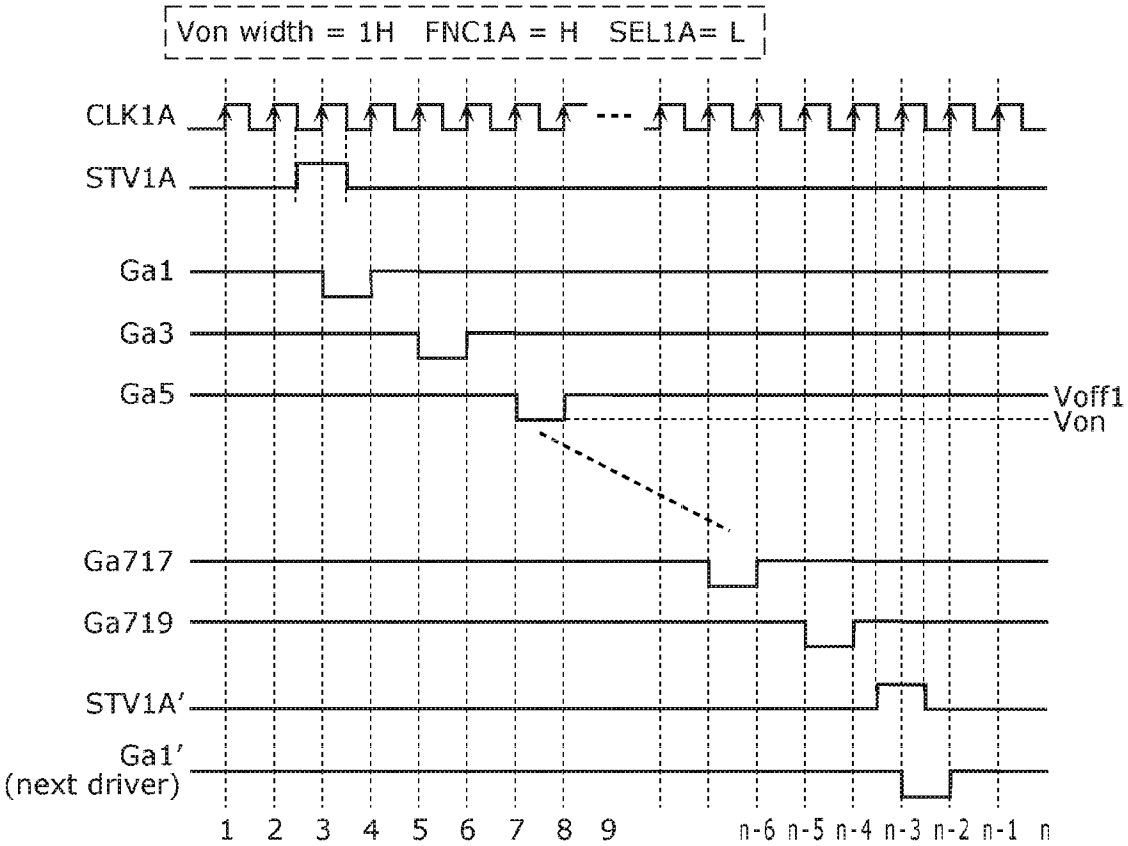
FIG. 16 is a timing chart illustrating another example of an operation of the scanning and outputting buffer circuit included in the gate driver IC illustrated in FIG. 11.
Figure 17:
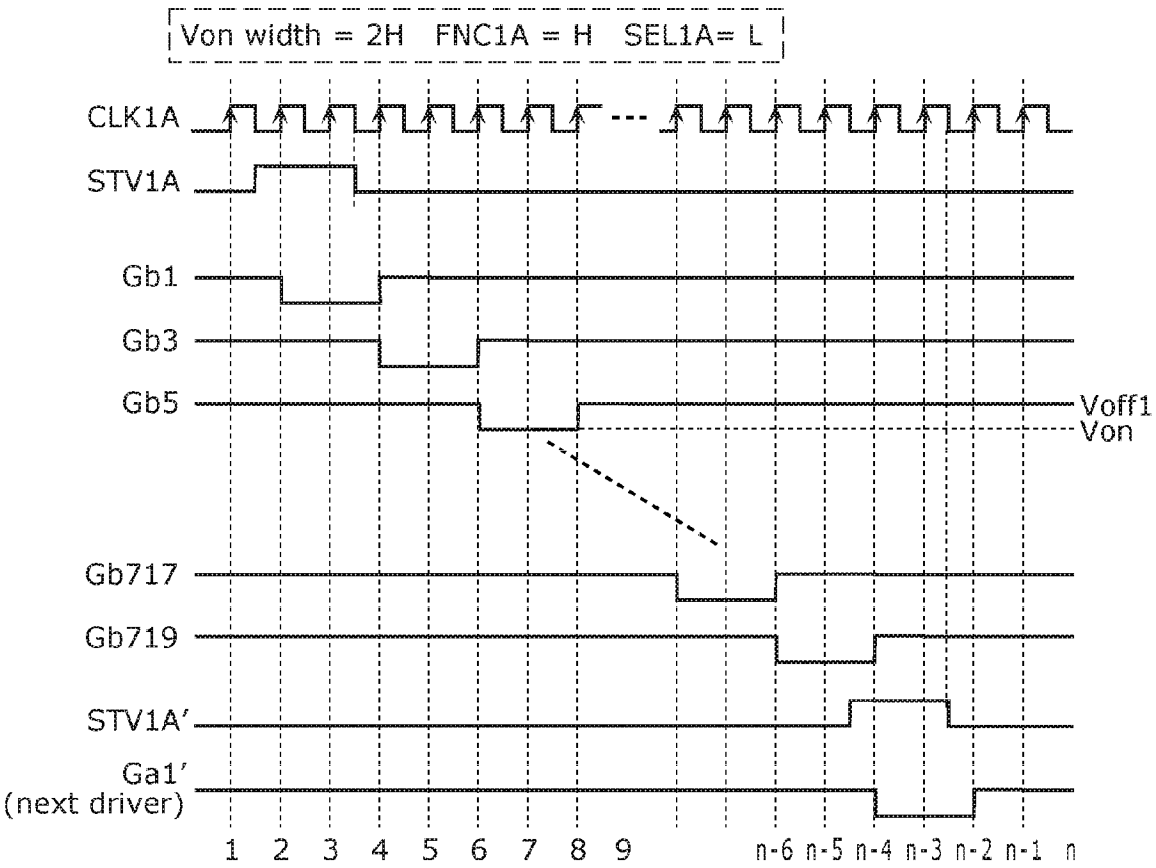
FIG. 17 is a timing chart illustrating an operation of the scanning and outputting buffer circuit included in the gate driver IC when an application period of Von is set to 2H.

The shifting state of a scanning and outputting buffer circuit 31 (or the gate driver ICs 12) in FIG. 12 is referred to as the second mode, and the shifting state of a scanning and outputting buffer circuit 31 (or the gate driver ICs 12) in FIG. 15 is referred to as the first mode. In FIG. 15, a data position in the scanning and outputting buffer circuit 31 is shifted in synchronization with one clock cycle. In FIG. 12, compared to FIG. 15, a data position in the scanning and outputting buffer circuit 31 is shifted in synchronization with n clock cycles (two clock cycles in the example of the disclosure). The same clock is inputted to the clock terminals (CLK) of the gate driver IC 12***a* and the gate driver IC12*b*. In the image display apparatus in FIG. 11 according to an embodiment of the present disclosure, the terminal FNC1A of the gate driver IC 12*a* is set to "L", and the gate driver IC 12*a* operates in the first mode. Accordingly, in the gate driver IC 12*a*, the data position in the shift register 31 is shifted with the one clock cycle. The terminal FNC1A of the gate driver circuit 12*b* is set to "H", and the gate driver IC 12*b* operated in the second mode. Accordingly, in the gate driver circuit 12*b*, the data position in the shift register 31 is shifted with the two clock cycle.

When the logic of the voltage applied to the terminal FNC is set to "H", the position at which the ON voltage (Von) is applied to each of the gate signal lines is shifted with two clocks (shifted with two clock cycle) as illustrated in FIG. 12. In other words, the shifting operation of the gate driver circuit 12*a* is twice as much as the shifting operation of the gate driver IC 12*b*. Or, the total number of clock inputs required for the shifting operation of the gate driver IC 12*b* is twice as many as the total number of clock inputs required for the shifting operation of the gate driver IC 12*a*. Accordingly, for the gate signal lines to which the ON voltage is applied, the ON voltage is applied, for every two clocks, to the gate signal lines Gb1, Gb3, Gb5, . . . . In contrast, when the logic of the voltage applied to the terminal FNC is set to "L", the position at which the ON voltage (Von) is applied to each of the gate signal lines is shifted with one clock as illustrated in FIG. 15. Accordingly, the gate signal lines to which the ON voltage is applied are the gate signal lines Gb1, Gb3, Gb5, The terminal FNC (FNC1A and FNC2A) of the scanning and outputting buffer circuit 31***a* corresponds to the first control terminal, and the terminal FNC (FNC1B and FNC2B) of the scanning and outputting buffer circuit 31***b* corresponds to the second control terminal.

As described above, when the logic of the voltage applied to the terminal FNC is set to "L", each pixel row is sequentially selected with one clock (cycle) as in a normal operation. When the logic of the voltage applied to the terminal FNC is set to "H", each pixel row is selected with two clocks (cycle).

It should be noted that, in the example of FIG. 11, the shift register 31*a* of the gate driver circuit 12*b* is in charge of the odd-numbered pixel rows, and the shift register 31*b* of the gate driver circuit 12*b* is in charge of the even-numbered pixel rows, according to the example of the present disclosure. According to the example of FIG. 11, it is possible to configure the image display apparatus with a total number of the gate driver ICs 12*b* disposed on the right side of the display screen 20 being half of the total number of the gate driver circuits 12*a* disposed on the left side of the display screen 20, as illustrated in FIG. 1. The total number of clocks (clock cycles) required for one shifting operation of the shift register 31 in the gate driver IC 12*b* is twice as many as the total number of clocks of the shift register 31 in the gate driver IC 12*a*.

In addition, as an example of the present discloser, in the case where: the gate driver IC 12*b* includes three shift registers 31 (31*a*, 31*b*, and 31*c*); the scanning and outputting buffer circuit 31*a* is in charge of the (3m−2)th pixel rows (m is an integer of at least 1); the scanning and outputting buffer circuit 31*b* is in charge of the (3m−1)th pixel rows (m is an integer of at least 1), and the scanning and outputting buffer circuit 31*c* is in charge of 3m-th pixel rows (m is an integer of at least 1); the total number of the clocks (clock cycles) required for the shifting operation of the shift register 31 of the gate driver IC 12*b* is three times as many as the total number of the clocks required for the shifting operation of the shift register 31 of the gate driver IC 12*a*. In this case, it is possible to configure the image display apparatus with a total number of the gate driver IC 12*b* disposed on the right side of the display screen 20 being one third of the total number of the gate driver circuits 12*a* disposed on the left side of the display screen 20. It should be understood that the matters described above are also applicable to other examples of the disclosure according to the present invention, such as FIG. 2, FIG. 4, FIG. 20 to FIG. 22, etc.

It should be understood that the logic of the voltage applied to the terminal FNC may be reversed between "H" and "L". In addition, although each pixel row is selected with two clocks (cycles) when the terminal FNC is set to H, the clocks (cycles) are not limited to two clocks (cycles), and each pixel row may be selected with three clocks (cycle) or four clocks (cycle), for example.

With the clock inputted to the terminal clock (CLK), data in the scanning and outputting buffer circuit 31 of the gate driver IC 12 is shifted. The total number of clock inputs for implementing the shifting operation of the scanning and outputting buffer circuit 31 of the gate driver IC 12***b* is n times as many as the total number of clock inputs (n is an integer of at least 2) of the gate driver IC 12*a*. The matters described above are applicable as appropriate to the examples of the disclosure of the present invention. For example, the matters described above are also applicable to the examples of the disclosure such as FIG. 4, FIG. 5, FIG. 7, and FIG. 8. In addition, the matters described above are also applicable to the examples of the disclosure such as FIG. 10, FIG. 11, FIG. 12 to FIG. 17, etc.

When the logic signal to the terminal FNC? is set to "H", the shifting operation illustrated in FIG. 12 (second mode) is performed. This is an operation of the gate driver IC 12***b*. When the logic signal to the terminal FNC is set to "L", the shifting operation illustrated in FIG. 15 (first mode) is performed. This is an operation of the gate driver IC 12*a*. The terminal FNC is a terminal connected to a setting circuit for setting the operation mode (the first mode or the second mode). According to the logic setting to the terminal FNC, the setting circuit selects between the first mode and the second mode to set the operation of the scanning and outputting buffer circuit 31.

It should be noted that, although the first mode or the second mode is set according to the logic setting to the terminal FNC, the setting is not limited to this. For example, the first mode or the second mode may be set by command setting to the setting circuit. For example, it is exemplified that DATA is inputted via a command transmitting line to the gate driver IC 12 as a command from outside, and the input DATA is converted to a setting command in command decoder circuits 351 to set an operation or a function, as illustrated in FIG. 35. The command decoder circuits 351** serve as the setting circuits for setting the first mode or the second mode.

FIG. 12 illustrates a timing chart of the scanning and outputting buffer circuit 31*a* included in the gate driver IC 12*b* illustrated in FIG. 11. The logic of the voltage applied to the terminal FNC2A is set to "H". The period of time of applying the Von voltage is 1H (selecting period for one pixel row). The terminal SEL2A is set to "H", and applied with the gate voltage ternary driving. It should be noted that switching or setting of the gate voltage binary driving and the gate voltage ternary driving may be performed using a hard terminal as with the terminal FNC, or may be set via a command transmitting signal DATA as illustrated in FIG. 35. The same holds true for other terminals (STV, CLK, SEL, etc.) or settings.

The scanning and outputting buffer circuit 31*a* is controlled by the clock input to the terminal CLK2A and a data (strobe) signal to the terminal STV2A. The voltages (Von, Voff1, and Voff2) to be applied to the gate signal lines Gb1, Gb3, . . . , Gb717, and Gb719 and the timing thereof are the same as those illustrated in FIG. 7.

Figure 13:
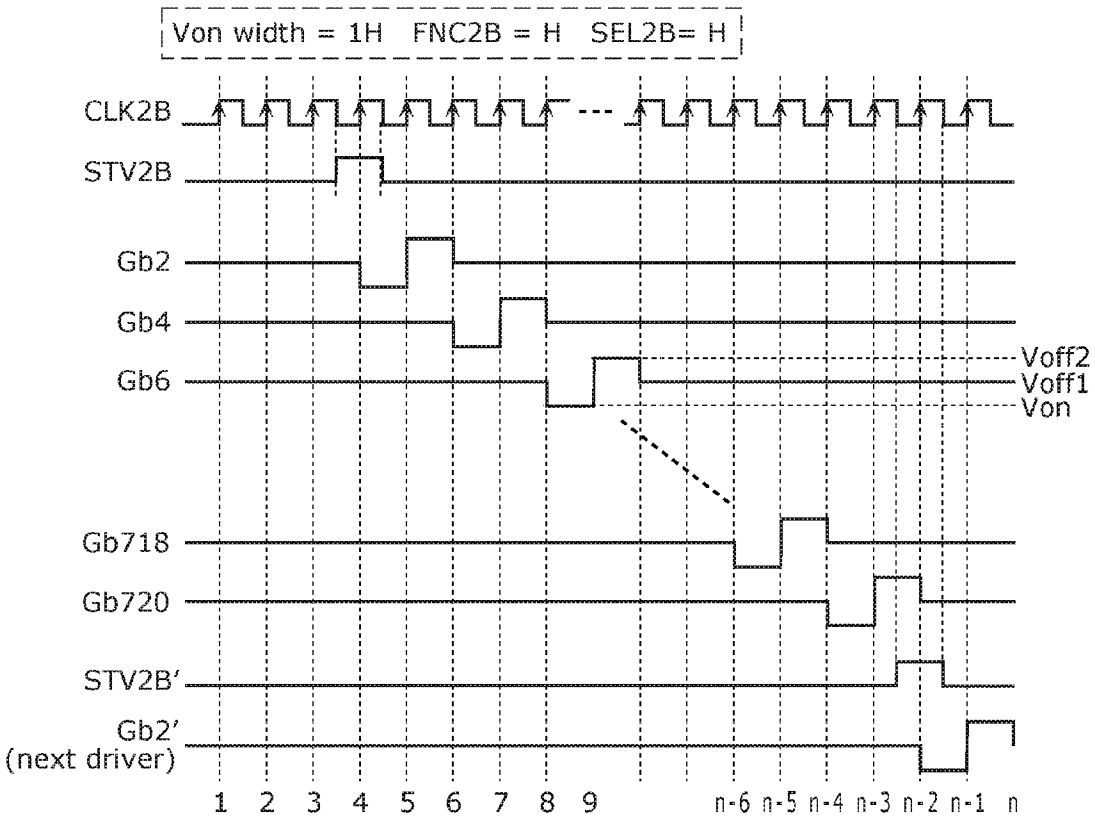
FIG. 13 is a timing chart illustrating an operation of another scanning and outputting buffer circuit included in the gate driver IC illustrated in FIG. 11.
Figure 14:
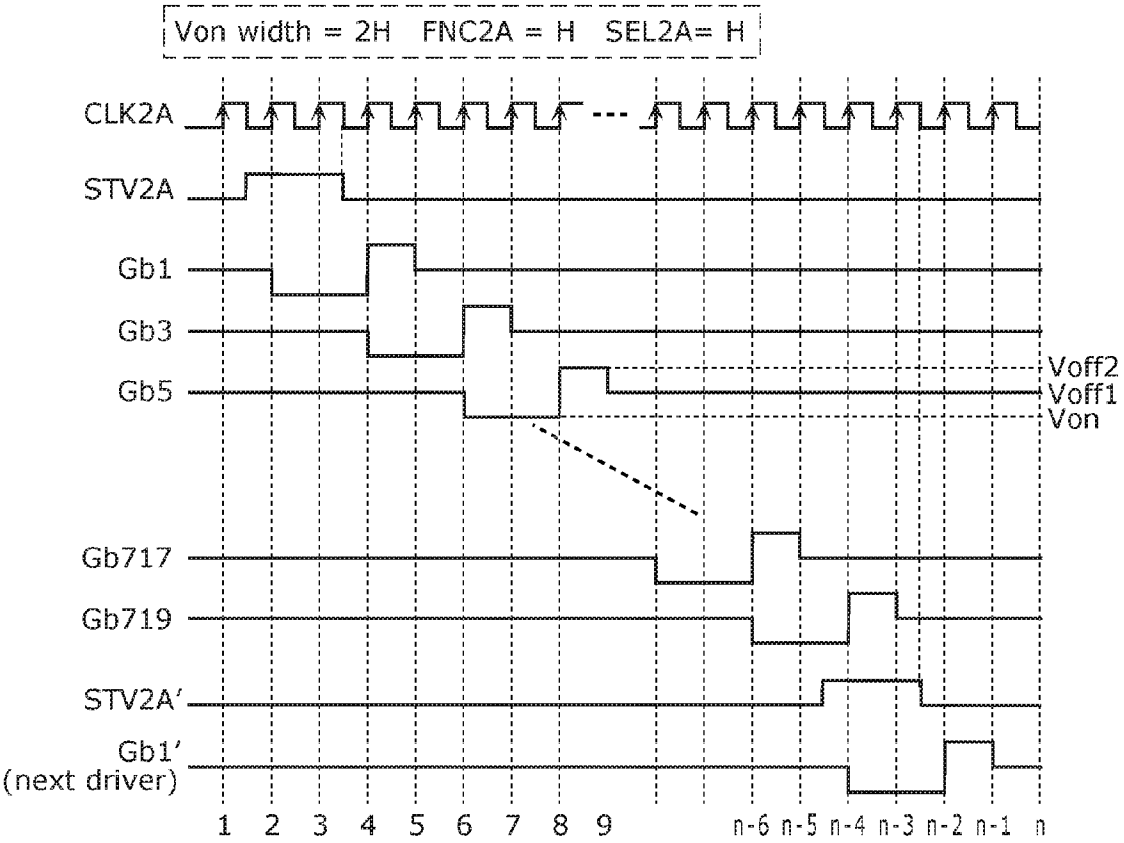
FIG. 14 is a timing chart illustrating an operation of the scanning and outputting buffer circuit included in the gate driver IC when an application period of Von is set to 2H.

FIG. 13 illustrates a timing chart of the scanning and outputting buffer circuit 31*b* included in the gate driver IC 12*b* illustrated in FIG. 11. The logic of the voltage applied to the terminal FNC2B is set to "H". The period of time of applying the Von voltage is 1H (selecting period for one pixel row). The terminal SEL2B is set to "H", and applied with the gate voltage ternary driving.

The scanning and outputting buffer circuit 31*b* is controlled by the dock input to the terminal CLK2B, and a data (strobe) signal to the terminal STV2B. The voltages (Von, Voff1, and Voff2) to be applied to the gate signal lines Gb2, Gb4, . . . , Gb718, and Gb720 and the timing thereof are the same as those illustrated in the lower portion of FIG. 8.

FIG. 14 illustrates an example of the embodiment in which the application period of Von in FIG. 12 is set to 2H. Since other configurations and operations are the same as those illustrated in FIG. 12, descriptions for them shall be omitted. The application period of Von is set to 2H, and thus the ON voltage is applied to the gate signal lines 17 consecutively for the period of 2H (the selecting period for two pixel rows). Accordingly, it is possible to apply the ON voltage sufficiently to the selected gate signal lines, and the transistors 11 connected to each of the gate signal lines can be sufficiently turned ON. For example, the ON voltage is applied to the switching transistor 11*b* illustrated in FIG. 11 for the period of 2H, thereby making it possible to successfully apply a video signal from the source driver IC 14 to each of the pixels 16. Although the period of Von is set to 2H in the above-described embodiment, the period of Von is not limited to this, and it should be understood that the period of Von may be a plurality of periods H which is at least three H.

It should be noted that, even when the period of Von is set to a plurality of periods H, the period in which the Voff2 voltage is applied is set to a period of 1H (when the terminal SEL is set to H).

FIG. 15 illustrates a timing chart of the scanning and outputting buffer circuit 31*a* included in the gate driver IC 12*a* illustrated in FIG. 11. The logic of the voltage applied to the terminal FNC1A is set to "L". In other words, a selected position is shifted for each of the pixel rows Ga1, Ga3, and Ga5. The period of time of applying the Von voltage is 1H (selecting period for one pixel row). In addition, the terminal SEL1A is set to "H", and applied with the gate voltage ternary driving. The scanning and outputting buffer circuit 31*a* is controlled by the clock input to the terminal CLK1A, and a data (strobe) signal to the terminal STV1A. Von, Voff1, and Voff2 are sequentially applied to the gate signal lines Ga1, Ga3, . . . , Ga717, and Ga719.

The operation of the timing chart illustrated in FIG. 15 is performed to the scanning and outputting buffer circuit 31*a* of the gate driver IC 12*a*, the operation of the timing chart illustrated in FIG. 12 is performed to the scanning and outputting buffer circuit 31*a* of the gate driver IC 12*b*, and the operation of the timing chart illustrated in FIG. 13 is performed to the scanning and outputting buffer circuit 31*b* of the gate driver IC 12*b*, thereby implementing the bilateral driving to the gate signal line 17*a* of each of the pixels.

In addition, the scanning and outputting buffer circuit 31*b* of the gate driver IC 12*a* implements the operation of the timing chart illustrated in FIG. 15 with the terminal SEL1B being set to "L" and the gate voltage binary driving being applied (the Voff2 period in FIG. 15 is changed to the Voff1 period. STV1A, Ga1, Ga3, Ga5, . . . , Ga717, and Ga719 are replaced with STV1B, Ga2, Ga4, Ga6, . . . , Ga718, and Ga720, respectively).

It is possible to implement the driving system illustrated in FIG. 16 by setting FNC1A to "H" and SEL1A to "L" for the scanning and outputting buffer circuit 31*a* of the gate driver IC 12*a*. It is possible to implement the driving system illustrated in FIG. 17 by setting data to be inputted to the terminal STV1A to have a width of 2H, setting FNC1A to "H", and setting SEL1A to "L" for the scanning and outputting buffer circuit 31*a* of the gate driver IC 12*a*.

Embodiment 2

According to Embodiment 1 and the modification examples described above, the total number of the gate signal lines 17 included in each of the pixels is two (two types). In contrast, an image display apparatus according to the present embodiment is different from the image display apparatus of Embodiment 1 and the modification examples in that the image display apparatus according to the present embodiment includes four gate signal lines (four types of gate signal lines) for each of the pixels. In the pixel circuit illustrated in FIG. 2, a video signal from the source signal line 18 turns ON the switching transistor 11*b*, and is galvanically applied to the gate terminal of the driving transistor 11*a*. In the pixel circuit illustrated in FIG. 18, a video signal from the source signal line 18 turns ON the switching transistor 11*b*, and is alternatingly applied to the gate terminal of the driving transistor 11*a* via the capacitor 19*b*.

Figure 18:
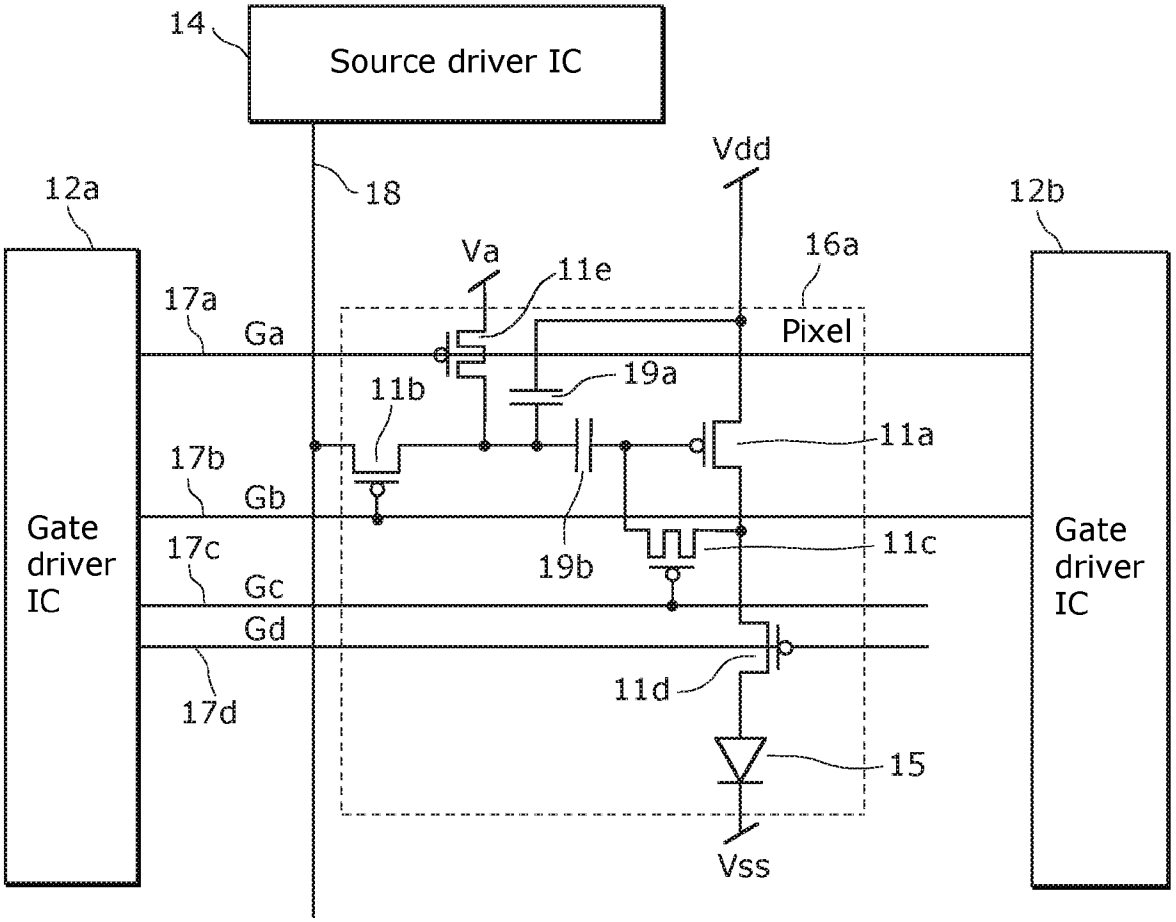
FIG. 18 is a circuit diagram illustrating a pixel circuit of an image display apparatus according to Embodiment 2.

In addition, in the pixel circuit illustrated in FIG. 18, an offset cancelling driving which chancels characteristic variations of the driving transistor 11*a* is implemented by operating the switching transistors 11*c*, 11*e*, and 11*d*, thereby realizing excellent visual quality without display unevenness. Hereinafter, Embodiment 2 shall be described with reference to the Drawings.

2-1. Configuration 2-1-1. Pixel

FIG. 18 is a diagram illustrating a pixel configuration of an image display apparatus according to the present embodiment, in which four gate signal lines 17 (four types of gate signal lines) are included in each of the pixels. It should be noted that there are instances where the gate signal lines 17*a*, 17*b*, 17*c*, and 17*d* are not specifically distinguished from each other and described as gate signal lines 17 as above.

The gate signal line 17*a* (Ga) is connected to the gate terminal of the switching transistor 11*e*, and controls ON and OFF of the switching transistor 11*e*. The gate signal line 17*b* (Gb) is connected to the gate terminal of the switching transistor 11*b*, and controls ON and OFF of the switching transistor 11*b*. The gate signal line 17*c* (Gc) is connected to the gate terminal of the switching transistor 11*c*, and controls ON and OFF of the switching transistor 11*c*. The gate signal line 17*d* (Gd) is connected to the gate terminal of the switching transistor 11*d*, and controls ON and OFF of the switching transistor 11*d*. The state of interconnection of each of the transistors 11 and the capacitor 19 is illustrated in the equivalent circuit diagram of FIG. 18, and thus description will be omitted.

With the pixel configuration illustrated in FIG. 18, gate driver ICs 12*a* and 12*b* are connected to the gate signal lines 17*a* and 17*b*, and the bilateral driving is performed. Only the gate driver IC 12*a* is connected to the gate signal lines 17*c* and 17*d*, and the unilateral driving is performed.

In FIG. 18, the source terminal of the switching transistor 11*d* is connected to the drain terminal of the driving transistor 11*a* that is the P-channel transistor, and the anode terminal of the EL element 15 is connected to the drain terminal of the switching transistor 11*d*. In addition, a cathode voltage Vss is applied to the cathode terminal of the EL element 15. An anode voltage Vdd is applied to the source terminal of the driving transistor 11*a*.

When an ON voltage is applied to the gate signal line 17*d*, the switching transistor 11*d* is turned ON, and a light-emission current is supplied to the EL element 15 from the driving transistor 11*a*. The EL element 15 emits light according to the magnitude of the light-emission current/

The source terminal and the drain terminal of the switching transistor 11*c* are connected between the gate terminal and the drain terminal of the driving transistor 11*a*. An ON voltage is applied to the gate signal line 17*c*, thereby short-circuiting (connecting) the driving transistor 11*a* between the gate terminal and the drain terminal.

One of the terminals of the capacitor 19*b* is connected to the gate terminal of the driving transistor 11*a*, and the other terminal of the capacitor 19*b* is connected to the drain terminal of the switching transistor 11*b*. The source terminal of the switching transistor 11*b* is connected to the source signal line 18. When an ON voltage is applied to the gate signal line 17*b*, the switching transistor 11*b* is turned ON, and a video signal (voltage or current) Vs applied to the source signal line 18 is applied to the pixel 16. It should be noted that, although the video signal is a video signal voltage in the present disclosure, the video signal may be a video signal current.

One of the terminals of the capacitor 19*a* is connected to the drain terminal of the transistor 11*b*, and the other terminal is connected to the anode electrode so as to be applied with an anode voltage Vdd.

It should be noted that, although the other terminal of the capacitor 19*a* is connected to the anode electrode so as to be applied with the anode voltage Vdd, the present disclosure is not limited to this. For example, the other terminal of the capacitor 19*a* may be connected to any other DC voltage.

Although the source terminal of the transistor 11*d* is connected to the anode electrode so as to be applied with the anode voltage Vdd, connection of the source terminal of the transistor 11*d* is not limited to this. For example, the other terminal of the capacitor 19*a* may be connected to any other DC voltage. In other words, the other terminal of the capacitor 19*a* and the source terminal of the transistor 11*a* may be connected to terminals of different potential.

For example, a configuration in which the source terminal of the transistor 11*a* is connected to an electrode or a line to which the anode voltage Vdd is applied, and one of the terminals of the capacitor 19*a* is connected to an electrode or a line to which a voltage of DC voltage Vb=5 (V) is applied.

The drain terminal of the transistor 11*e* is connected to the drain terminal of the transistor 11*b*, and the source terminal of the transistor 11*e* is connected to an electrode or a signal line to which a reset voltage Va is applied. The transistor 11*e* is turned ON and the reset voltage Va is applied to the capacitor 19*a*, by applying the ON voltage to the gate signal line 17*a*.

The transistor 11*c* and the transistor 11*e* are each the P-channel transistor, and have a lightly doped drain (LDD) structure. In addition, the transistors 11*c* and 11*e* each have at least a double-gate (dual gate) structure. The transistors 11*c* and 11*e* each preferably have at least a triple-gate structure. More specifically, a structure in which gates of a plurality of transistors are connected in series. It is possible to place the off-characteristics of the transistors 11*c* and 11*e* in a good condition, by employing the LDD structure or a multi-gate (dual gate, triple-gate, or more gates) structure. When the off-characteristics of the transistor 11*c* and the transistor 11*e* are not in a good condition, a charge of the capacitor 19 cannot be held in a good condition.

It is preferable that transistors other than the transistors 11*c* and 11*e* are each the P-channel transistor and have the LDD structure. In addition, the transistors have the multi-gate structure as necessary.

The multi-gate (at least the dual gate) transistors are employed, and the LDD structure is combined, thereby making it possible to suppress the off-leakage and implement excellent contrast and offset cancelling operation In addition, excellent high-luminance display and image display can be implemented.

2-1-2. Gate Driver IC

Figure 19:
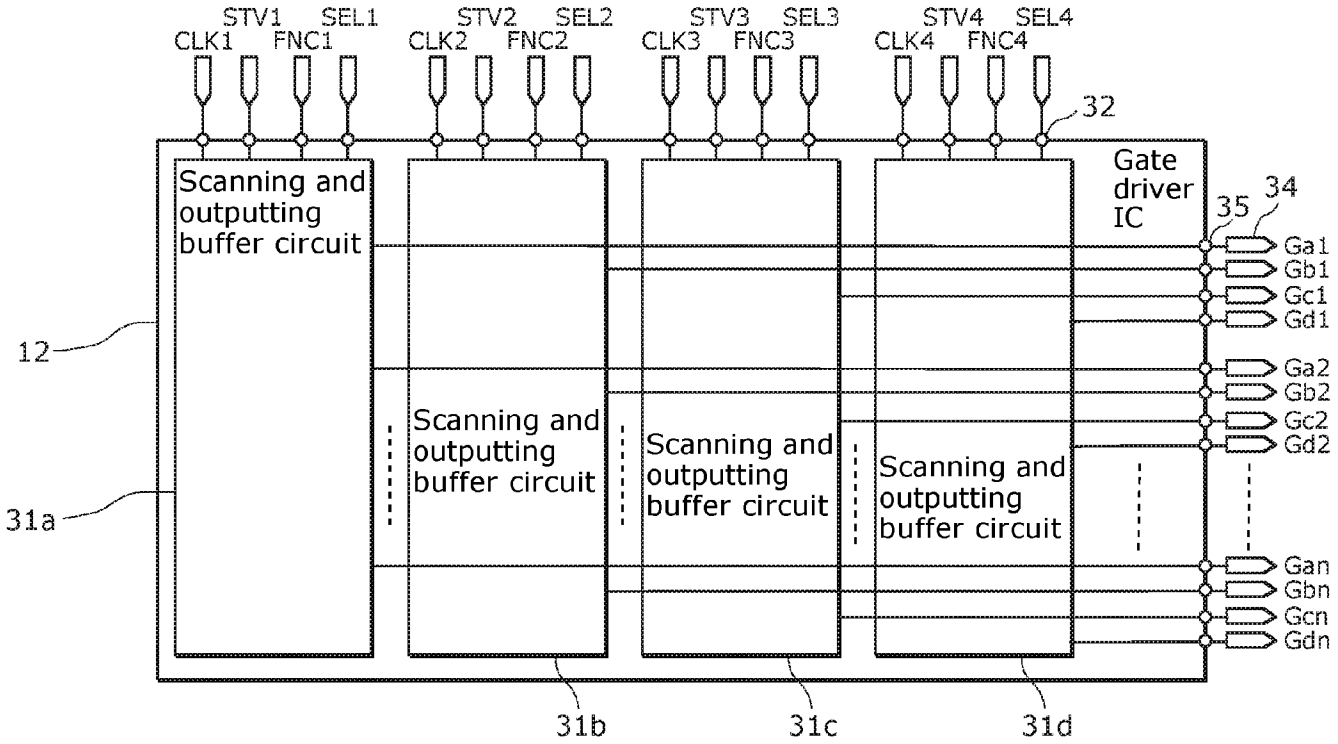
FIG. 19 is a block diagram illustrating a configuration of the gate driver IC.

FIG. 19 is a block diagram of the gate driver IC 12 according to the present disclosure, which corresponds to the case where there are four types of the gate signal line 17 (i.e., the total number of the gate signal lines 17 to be independently controlled) of a pixel as illustrated in FIG. 18.

Four scanning and outputting buffer circuits 31 (31*a*, 31*b*, 31*c*, and 31*d*) are formed or disposed in the gate driver IC 12. The scanning and outputting buffer circuit 31*a* drives the gate signal line 17*a*, and the scanning and outputting buffer circuit 31*b* drives the gate signal line 17*b*. The scanning and outputting buffer circuit 31*c* drives the gate signal line 17*c*, and the scanning and outputting buffer circuit 31*d* drives the gate signal line 17*d* . . . . Since other configurations are the same as those of other embodiments, description shall be omitted.

Next, a relation of connection between the gate driver IC 12 having a configuration described above and the display screen 20 shall be described.

Figure 20:
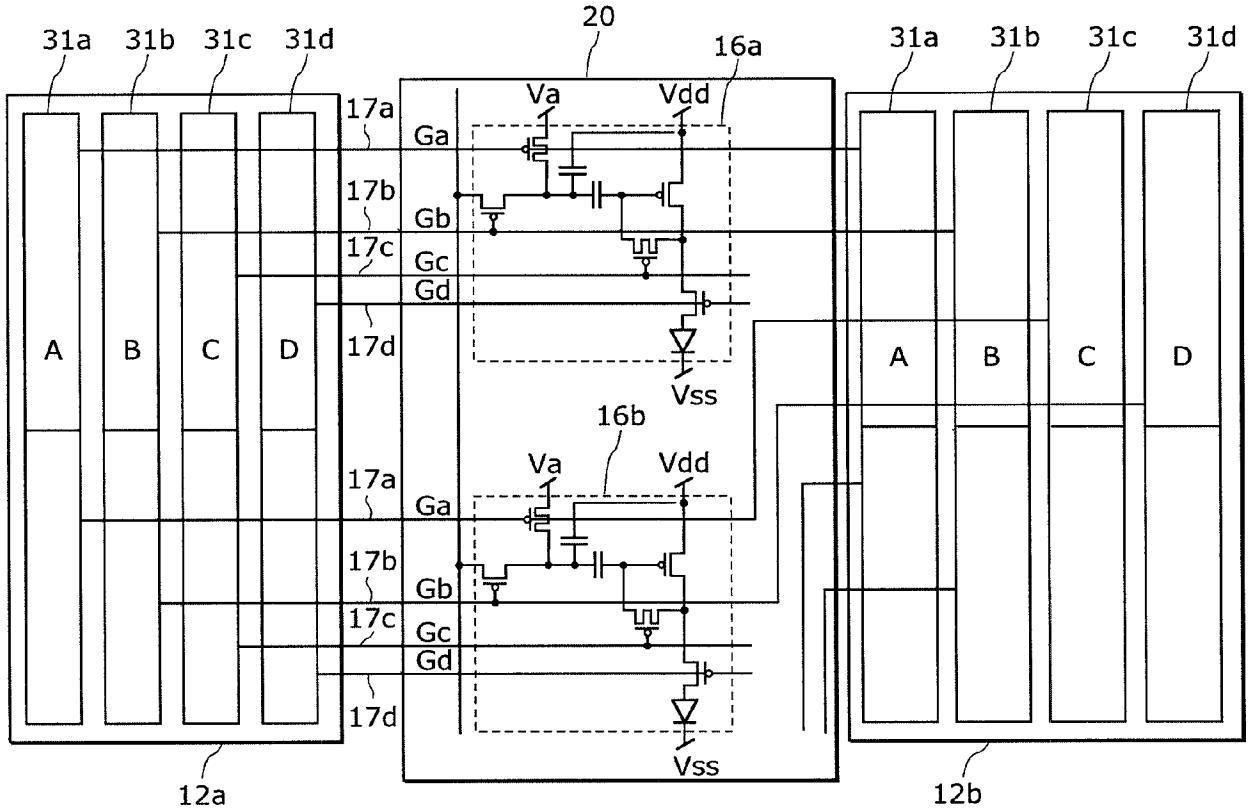
FIG. 20 is a configuration diagram of the image display apparatus on which the gate driver IC is mounted, according to Embodiment 2.

FIG. 20 is a schematic diagram of the image display apparatus according to the present disclosure, that is, a configuration diagram of an image display apparatus according to Embodiment 2, on which the gate driver IC 12 is mounted. The scanning and outputting buffer circuits 31 (31*a*, 31*b*, 31*c*, and 31*d*) of the gate driver IC 12*a* each control a different one of the gate signal lines 17 (17*a*, 17*b*, 17*c*, and 17*d*), and applies an ON voltage and an OFF voltage to the gate signal lines 17. The scanning and outputting buffer circuits 31*a* and 31*b* of the gate driver IC 12*b* each control the gate signal lines 17 (17*a* and 17*b*) of the odd-numbered pixel rows, and applies an ON voltage and an OFF voltage to the gate signal lines 17. The scanning and outputting buffer circuits 31*c* and 31*d* of the gate driver IC 12*b* each control the gate signal lines 17 (17*c* and 17*d*) of the even-numbered pixel rows, and applies an ON voltage and an OFF voltage to the gate signal lines 17.

The gate signal line 17*a* and the gate signal line 17*b* are driven by the gate driver ICs 12*a* and 12*b*. In other words, the bilateral driving is applied to the gate signal lines 17*a* and 17*b*. The switching transistor 11*e* implements the function of applying a Va voltage to the gate terminal of the driving transistor 11*a*, and the switching transistor 11*b* implements the function of supplying a video signal voltage to the driving transistor 11*a*, and thus a high-speed ON and OFF operation is required. The bilateral driving is applied to the gate signal lines 17*a* and 17*b*, thereby making it possible to operate the switching transistors 11*b* and 11*e* at an excellent slew rate. On the other hand, the switching transistors 11*c* and 11*d* do not require a high-speed operation. Accordingly, it is possible to implement a sufficiently function with the unilateral driving using only the gate driver IC 12*a*.

In the example illustrated in FIG. 20, the gate driver IC 12*a* is in charge of the gate signal lines 17 (17*a*, 17*b*, 17*c*, and 17*d*) of all of the pixel rows. The scanning and outputting circuits 31*a* and 31*b* of the gate driver IC 12*b* are in charge of the gate signal lines 17*a* and 17*b* of the odd-numbered pixel rows, and the scanning and outputting circuits 31*c* and 31*d* of the gate driver IC 12*b* are in charge of the gate signal lines 17*a* and 17*b* of the even-numbered pixel rows. Also in the configuration illustrated in FIG. 20, the total number of the gate driver ICs 12*b* used may be half of the total number of the gate driver ICs 12*a* used as with the cases illustrated in FIG. 1 and FIG. 11. Accordingly, it is possible to reduce the total number of gate driver ICs 12 used, and provide a low-cost image display apparatus.

Control and functions of the terminal FNC, the terminal CLK, the terminal SEL, and the terminal STV are described in the other embodiment, and thus description shall be omitted. In addition, the timing chart is also described in the other embodiment, and thus description shall be omitted.

2-2. Advantageous Effects Etc.

As described above, the image display apparatus according to the present embodiment is different from the image display apparatus according to Embodiment 1 and the modification example thereof in that the image display apparatus according to the present embodiment includes four gate signal lines (four types) for each of the pixels 16. More specifically, among the four gate signal lines 17*a*, 17*b*, 17*c*, and 17*d*, the bilateral driving is applied to the two gate signal lines 17*a* and 17*b* and the unilateral driving is applied to the two gate signal lines 17*c* and 17*d*. The image display apparatus described above also produces the same advantageous effects as those of Embodiment 1 and the modification example thereof. More specifically, it is possible to use gate driver ICs 12*a* and 12*b* which are highly versatile and can be used irrespective of the total number and arrangement of the gate signal lines 17 and irrespective of the specification or the like of the image display apparatus. In addition, it is possible to reduce the total number of the gate driver ICs 12*b* used by a half of the total number of the gate driver ICs 12*a* used, making it possible to lower the costs.

It should be noted that, although the bilateral driving is applied to the gate signal lines 17*a* and 17*b* and the unilateral driving is applied to the gate signal lines 17*c* and 17*d* in the above description, the total number of the gate signal lines to which the bilateral driving is applied and the total number of the gate signal lines to which the unilateral driving is applied are not limited to those described above.

For example, although FIG. 18 illustrates the configuration of four gate signal lines per pixel, the case where the bilateral driving is applied to the gate signal line 17*a* and the unilateral driving is applied to the other gate signal lines 17 (17*b*, 17*c*, and 17*d*) is also conceivable. In this case, one fourth of the total number of gate driver ICs 12*a* used is sufficient for the total number of the gate driver ICs 12*b* used. Accordingly, it is possible to reduce the total number of gate driver ICs 12 used, and provide a low-cost image display apparatus.

Modification Example of Embodiment 2

3-1. Configuration 3-1-1. Pixel

Figure 21:
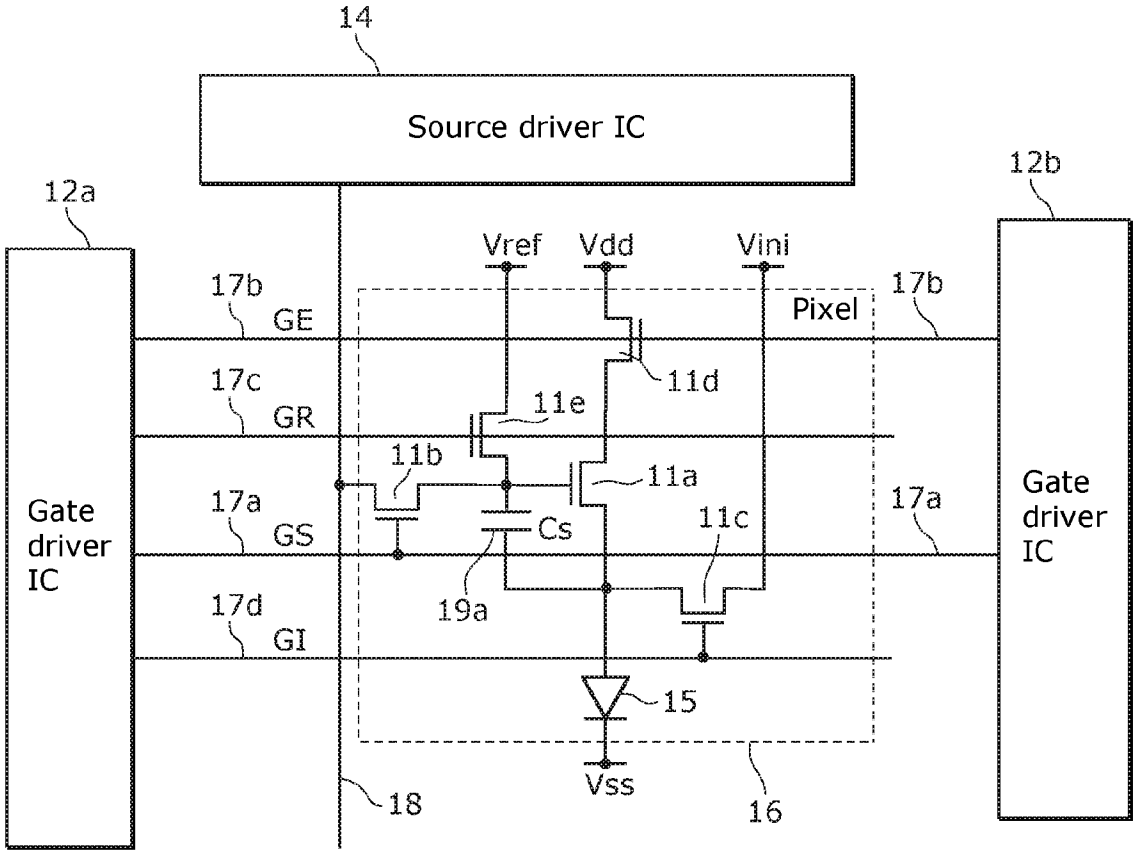
FIG. 21 is a circuit diagram illustrating a pixel circuit according to a modification of Embodiment 2.

For example, FIG. 21 illustrates a pixel configuration. FIG. 21 is a circuit diagram illustrating a pixel circuit according to a modification of Embodiment 2. In FIG. 21, the gate driver ICs 12*a* and 12*b* apply the bilateral driving to the gate signal lines 17*a* and 17*b*. The gate driver IC 12*a* applies the unilateral driving to the gate signal lines 17*c* and 17*d*.

The source driver IC 14 is a driving circuit which is connected to the source signal line 18 and has a function of outputting a video signal voltage corresponding to a display image to the EL element 15.

The control circuit of which illustration is omitted is a control circuit which has a function of controlling the gate driver ICs 12 and the source driver IC 14. The control circuit includes a memory (not illustrated) on which correction data, etc. of each of the EL elements 15 is recorded, which reads the correction data, etc. written on the memory, corrects a video signal inputted from outside based on the correction data, and outputs the corrected video signal to the source driver IC 14.

In addition, although it is not illustrated in FIG. 21, the anode voltage Vdd, the cathode voltage Vss, and the reference voltage (Vref and Vini) are each commonly supplied to all of the pixels 16, and connected to a voltage generating circuit (not illustrated). Furthermore, when a voltage resulting from adding a luminescence production starting voltage of the EL element 15 to the threshold voltage of the driving transistor 11*a* is greater than 0 V, the voltage Vini may be substantially the same voltage as the cathode voltage Vss. With this, the types of an output voltage of the voltage generating circuit (not illustrated) is reduced and the circuit are more simplified.

The gate terminal of the switching transistor 11*e* is connected to the gate signal line 17*c*, and one of the source and the drain is supplied with Vref. The switching transistor 11*c* has a function of determining a timing of applying *Vini* to an electrode of the capacitor 19*c*. The switching transistor 11*e* and the switching transistor 11*c* are each formed of, for example, an n-type thin film transistor (n-type TFT).

The capacitor 19*a* is a capacitor having the first electrode connected to the gate terminal of the driving transistor 11*a* and the second electrode connected to the source terminal of the driving transistor 11*a*.

The capacitor 19*a* has a function of holding a voltage corresponding to the signal voltage supplied from the source signal line 18, stably holding a potential between the gate electrode and the source electrode of the driving transistor 11*a* after the switching transistor 11*b* is turned OFF, for example, and stabilizing current supplied to the EL element 15 from the driving transistor 11*a*.

The driving transistor 11*a* is a driving element including a drain connected via the switching transistor 11*d* to the first power line and supplied with an anode voltage Vdd, and a source connected to an anode of the EL element 15. The driving transistor 11*a* converts a voltage corresponding to a signal voltage applied between the gate and source into a drain current corresponding to the signal voltage. Then, the driving transistor 11*a* supplies this drain current as a signal current to the EL element 15. The driving transistor 11*a* is formed of, for example, an n-type thin film transistor (n-type TFT).

The EL element 15 is a light-emitting element including a cathode connected to the second power line and supplied with a cathode voltage Vss, and emits light according to the flow of the above-described signal current via the driving transistor 11*a*.

The switching transistor 11*d* is a switching transistor including a gate connected to the gate signal line 217*b*, and a source and a drain terminal one of which is connected to the drain terminal of the driving transistor 11*a*. The switching transistor 11*d* is formed of, for example, an n-type thin film transistor (n-type TFT).

The capacitor 19*a* first stores a source potential of the driving transistor 11*a* (potential of the source signal line 18) in a steady state, while the switching transistor 11*b* is in a conducting state. After that, the potential of the capacitor 19*a* is determined even when the switching transistor 11*b* is brought into an OFF state, and thus a gate voltage of the driving transistor 11*a* is determined.

It should be noted that the capacitor 19*a* is formed or disposed so as to overlap (stack) with the source signal line 18 and the gate signal line 17. In this case, layout flexibility is improved, a wider space can be secured between elements, and yield is improved.

Furthermore, the image display apparatus includes the source signal lines 18 for the total number of pixel columns. The gate signal lines 17 are connected to the gate driver ICs 12 and each of the EL elements 15 which belong to pixel rows including the EL elements 15. With this, the gate signal lines 17 each have a function of supplying each of the EL elements 15 which belong to the pixel row including the pixel 16 with a timing of writing the above-described signal voltage, and a function of supplying a timing of applying the reference voltage to the gate of the driving transistor ha included by the EL element 15.

There are instances where the image display apparatus (EL display panel) requires the ON voltage (Von) of plural types, and the OFF voltage (Voff) of plural types. Other than that, an initial voltage (Vini), a reference voltage (Vref), and the like are required.

Such a configuration of the image display apparatus allows the image display apparatus to simultaneously perform writing and deleting of video on and from the display screen 20. Accordingly, there is no need to collectively display video after the end of writing as conventionally performed, and it is possible to display video for each row on the display screen 20 before the end of the writing.

In the pixel 16 illustrated in FIG. 21, the drain terminal of the N-channel driving transistor 11*a* is connected to the source terminal of the switching transistor 11*d*, and the drain terminal of the switching transistor 11*d* is connected to the anode terminal of the EL element 15. An anode voltage Vdd is applied or supplied to the anode terminal.

It should be noted that the channel of the transistors 11 are bidirectional and the names of the source terminal and the drain terminal are for facilitating the explanation, and thus the source terminal and the drain terminal may be switched with each other. In addition, the names of the source terminal and the drain terminal are for convenience or for facilitating the explanation, and the source terminals and the drain terminals of transistors other than the driving transistor 11*a* may be referred to as the first terminal and the second terminal, for example. Furthermore, although the transistors 11 are explained as the N-channel transistors, the transistors 11 may be the P-channel transistors.

In addition, a cathode voltage Vss is applied to the cathode terminal of the EL element 15. The source terminal of the driving transistor 11*a* is electrically connected to the anode voltage terminal of the EL element 15. The source terminal of the switching transistor 11*c* is electrically connected to the source terminal of the driving transistor 11*a*. Furthermore, the drain terminal of the switching transistor 11*c* is applied or supplied with the initial voltage Vini.

It should be noted that an electrically connected state is a state in which a voltage pathway or a current pathway is formed or can be formed. For example, the first transistor and the second transistor are electrically connected even when a third transistor is disposed between the first transistor and the second transistor. In addition, in the Description of the present disclosure, there are instances where the term connect means electrically connect.

The source terminal of the switching transistor 11*b* is connected to the gate terminal of the driving transistor 11*a*, and the drain terminal of the switching transistor 11*b* is connected to the source signal line 18. The source terminal of the switching transistor 11*e* is connected to the gate terminal of the driving transistor 11*a*, and the drain terminal of the switching transistor 11*e* is applied or supplied with the reference voltage Vref.

The capacitor 19 is connected between the gate terminal of the driving transistor 11*a* and the source terminal of the driving transistor 11*a*.

It should be noted that, in the embodiment as illustrated in FIG. 21 and the like, the following relationship is preferable: anode voltage Vdd>reference voltage Vref>cathode voltage Vss>initial voltage Vini. More specifically, for example, anode voltage Vdd=10 to 18 (V), reference voltage Vref=1.5 to 3 (V), cathode voltage Vss=0.5 to 2.5 (V) and initial voltage Vini=0 to −3 (V).

It should be noted that the switching transistor 11*d* may be disposed or formed between the source terminal of the driving transistor 11*a* and the anode terminal of the EL element 15.

The gate terminal of the switching transistor 11*d* is connected to the gate signal line 17*b*. The gate terminal of the switching transistor 11*e* is connected to the gate signal line 17*c*. The gate terminal of the switching transistor 11*b* is connected to the gate signal line 17*a*. The gate terminal of the switching transistor 11*c* is connected to the gate signal line 17*d*.

When an ON voltage is applied to the gate signal line 17*b* (GE), the switching transistor 11*d* is turned ON, and a light-emission current is supplied from the driving transistor 11*a* to the EL element 15. The EL element 15 emits light according to the magnitude of the light-emission current. The magnitude of the light-emission current is determined by applying a video signal that is applied to the source signal line 18, to the pixel 16 by the second switching transistor 11*b*.

One of the terminals of the capacitor 19 is connected to the gate terminal of the driving transistor 11*a*, and the other terminal of the capacitor 19 is connected to the source terminal of the driving transistor 11*a*. The drain terminal of the switching transistor 11*b* is connected to the source signal line 18. The source driver circuit 14 applies a video signal to the source signal line 18.

The gate signal lines 17*a* and 17*b* are connected to the gate driver ICs (12*a* and 12*b*) disposed on the left side and on the right side of the display screen 20. Furthermore, the gate signal lines 17*c* and 17*d* are connected to the gate driver IC 12*a* disposed on the left side of the display screen 20.

The gate driver ICs 12 apply a selection voltage (ON voltage Von) of a pixel to the gate signal line 17. When an ON voltage of the gate signal line 17*b* is applied, the switching transistor 11*b* is turned ON, and a video signal applied to the source signal line 18 is applied to the pixel 16.

The EL display panel includes the display screen 20 including pixels 16 each having the EL element 15 are disposed in a matrix.

The gate driver ICs 12 (12*a* and 12*b*) are connected to the ends of the gate signal lines 17*a* and 17*b*. The gate driver IC 12*a* is connected to one side of the gate signal lines 17*c* and 17*d*. The gate driver ICs 12 are each mounted on a chip of film (COF) which is not illustrated.

In the same manner as above, the source signal line 18 is connected to each of the pixels 16. One end of the source signal line 18 is connected to the source driver IC (source driver circuit) 14. The source driver IC 14 is mounted on the chip on Film (COF) 22 which is not illustrated.

The source driver IC 14 outputs the video signal and the video signal is applied or supplied to the source signal line 18.

3-1-2. Overall Configuration

Figure 22:
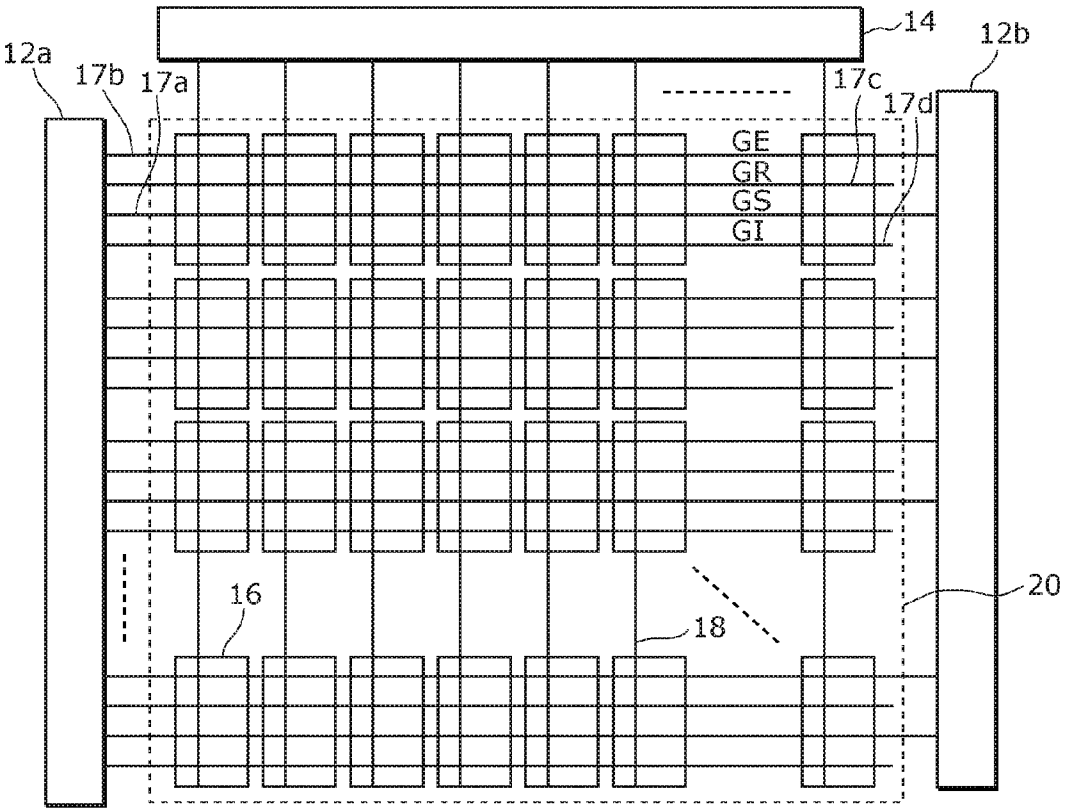
FIG. 22 is a schematic diagram illustrating a configuration of an image display apparatus according to the modification of Embodiment 2.

FIG. 22 is a diagram explaining the image display apparatus according to the present disclosure, in the case of the pixel configuration illustrated in FIG. 21. The gate driver ICs 12*a* and 12*b* apply the bilateral driving to the gate signal lines 17*a* and 17*b*. The gate driver IC 12*a* applies the unilateral driving to the gate signal lines 17*c* and 17*d*. The source driver circuit 14 generates a video signal voltage and applies the video signal voltage to the source signal line 18. The switching transistor 11*b* applies the video signal voltage applied to the source signal line 18, to the driving transistor 11*a* of the pixel 16.

3-2. Advantageous Effects Etc.

As described above, the image display apparatus according to the present modification which has the pixel configuration illustrated in FIG. 21 produces the same advantageous effect as Embodiment 2. More specifically, it is possible to use the gate driver ICs 12*a* and 12*b* which are highly versatile and can be used irrespective of the total number and arrangement of the gate signal lines 17 and irrespective of the specification or the like of the image display apparatus. In addition, it is possible to reduce the total number of the gate driver ICs 12*b* used, by a half of the total number of the gate driver ICs 12*a* used, making it possible to lower the costs.

Other Embodiments

It should be noted that, although the bilateral driving is described as driving with the two gate driver ICs 12 disposed on the left side and the right side of the display screen 20, according to an embodiment of the present disclosure, the bilateral driving is not limited to this. The bilateral driving may be driving using a plurality of gate driver ICs 12. For example, a system in which two gate driver ICs 12 are connected or disposed on one side of the gate signal line 17 and perform driving.

In other words, the bilateral driving is a system of driving one gate signal line 17 using a plurality of gate driver ICs 12. In addition, the gate signal lines 17 are described as being driven by the gate driver ICs 12, driving of the gate signal lines 17 is not limited to this. For example, a gate driver circuit (not illustrated) may be directly formed or disposed on an array substrate by a polysilicon technique and the gate signal lines 17 may be driven using the gate driver circuit.

Accordingly, a configuration in which the gate driver circuits are connected to the both ends of one gate signal line 17 is also included in a scope of the present disclosure. Furthermore, a configuration in which the gate driver IC 12 is connected to one end of one gate signal line 17, and the gate driver circuit is connected to the other end of the one gate signal line 17 is also included in a scope of the present disclosure. Furthermore, a configuration in which two gate driver circuits are connected to one end of one gate signal line 17 is also included in a scope of the present disclosure.

Furthermore, the present disclosure is not limited to the above-described image display apparatus, and may be implemented as a gate driver circuit for use in an image display apparatus including the display screen 20 in which the pixels 16 are disposed in a matrix.

More specifically, the gate driver IC 12 (gate driver circuit) according to an aspect of the present disclosure includes: a terminal CLK (clock input terminal); a terminal STV (data input terminal); a plurality of output terminals 34 connected to the gate signal lines 17 of the image display apparatus; and a setting unit (setting terminal FNC and setting circuit 351) for setting a first mode or a second mode. In the first mode, the shift register circuit, etc. performs one shifting operation according to one clock input. In the second mode, the shift register circuit, etc. performs one shifting operation according to n clock inputs (n is an integer of at least 2). Here, the gate signal lines 17 are applied with a selection voltage (ON voltage) or a non-selection voltage (OFF voltage) output from the output terminals 34. The gate driver IC 12 (gate driver circuit) according to an aspect of the present disclosure is provided with, at the terminal STV (data input terminal), data set at the terminal STV (data input terminal) according to a clock inputted to the terminal CLK (clock input terminal), the data is shifted in the gate driver IC 12 (gate driver circuit) in synchronization with the clock inputted into the terminal CLK (clock input terminal), and a selection voltage or a non-selection voltage is output from the output terminal based on a data position in the gate driver IC 12 (gate driver circuit). When the terminal FNC or the setting circuit 351 is set to the first mode, the data is shifted in the gate driver IC 12 (gate driver circuit) in synchronization with the clock inputted into the terminal CLK (clock input terminal), and a selection voltage or a non-selection voltage is output based on a data position in the gate driver IC 12 (gate driver circuit). In contrast, when the terminal FNC or the setting circuit 351 is set to the second mode, the data is shifted in the gate driver IC 12 (gate driver circuit) in synchronization with n clock cycles (n is an integer of at least 2) of a clock inputted to the terminal UK (clock input terminal), and a selection voltage or a non-selection voltage is output based on a data position in the gate driver IC 12** (gate driver circuit).

In addition, the non-selection voltage may include a first non-selection voltage (Voff1 voltage, i.e., OFF voltage 1) and a second non-selection voltage (Voff2 voltage and OFF voltage 2), and an arbitrary output terminal 34 may output the second non-selection voltage (Voff2 voltage, i.e., OFF voltage 2) in a period of one clock cycle after the selection voltage is output, and the first non-selection voltage (Voff1 voltage, i.e., OFF voltage 1) after the second non-selection voltage (Voff2 voltage, i.e., OFF voltage 2) is output.

Furthermore, the gate driver IC 12 (gate driver circuit) may includes a plurality of scanning and outputting buffer circuits 31*a* and 31*b* (scanning circuits), and the scanning and outputting buffer circuits 31*a* and 31*b* (scanning circuits) may each include terminal CLK (clock input unit) and the terminal STV (data input unit).

Furthermore, the present disclosure may be implemented as an image display apparatus including the gate driver IC 12 (gate driver circuit) described above. More specifically, an image display apparatus according to another aspect of the present disclosure includes: the display screen 20 in which the pixels 16 are disposed in a matrix; the gate driver IC 12*a* (the first gate driver circuit) that is the above-described gate driver IC 12 (gate driver circuit) disposed on the first side of the display screen 20; and the gate driver IC 12*b* (the second gate driver circuit) that is the above-described gate driver IC 12 (gate driver circuit) disposed on the second side of the display screen 20. In addition, the gate driver IC 12 (gate driver circuit) includes the scanning and outputting buffer circuit 31*a* (the first scanning circuit) and the scanning and outputting buffer circuit 31*b* (the second scanning circuit). The scanning and outputting buffer circuit 31*a* (the first scanning circuit) is electrically connected to the terminal GE* (the first output terminal), and the scanning and outputting buffer circuit 31*b* (the second scanning circuit) is electrically connected to the terminal GS* (the second output terminal). Furthermore, the pixels 16 each include the gate signal line 17*a* (the first gate signal line) and the gate signal line 17*b* (the second gate signal line). The pixels 16 include the first pixel and the second pixel. The terminal GE* (the first output terminal) of the gate driver IC 12*a* (the first gate driver circuit) is electrically connected to the gate signal line 17*a* (the first gate signal line) of the first pixel. The terminal GE* (the first output terminal) of the gate driver IC 12*a* (the first gate driver circuit) is electrically connected to the gate signal line 17*a* (the first gate signal line) of the second pixel. The terminal GS* (the second output terminal) of the gate driver IC 12*a* (the first gate driver circuit) is electrically connected to the gate signal line 17*b* (the second gate signal line) of the first pixel. The terminal GS* (the second output terminal) of the gate driver IC 12*a* (the first gate driver circuit) is electrically connected to the gate signal line 17*b* (the second gate signal line) of the second pixel. The terminal GE* (the first output terminal) of the gate driver IC 12*b* (the second gate driver circuit) is electrically connected to the gate signal line 17*a* (the first gate signal line) of the first pixel. The terminal GS* (the second output terminal) of the gate driver IC 12*b* (the second gate driver circuit) is electrically connected to the gate signal line 17*a* (the first gate signal line) of the second pixel.

In addition, the present disclosure may be implemented as an image display apparatus as described below. An image display apparatus according to yet another aspect of the present disclosure is an image display apparatus of an active matrix type which includes the display screen 20 in which the pixels 16 are disposed in a matrix. The image display apparatus includes the gate driver IC 12*a* (the first gate driver circuit) and the gate driver IC 12*b* (the second gate driver circuit). Furthermore, the gate signal line 17*a* (the first gate signal line) and the gate signal line 17*b* (the second gate signal line) are formed on each of the pixels 16. The gate signal line 17*a* (the first gate signal line) has one end connected to the output terminal of the gate driver IC 12*a* (the first gate driver circuit) and the other end connected to the output terminal of the gate driver IC 12*b* (the second gate driver circuit). The gate signal line 17*b* (the second gate signal line) has one end connected to the output terminal of the gate driver IC 12*a* (the first gate driver circuit) and the other end is opened.

In addition, the present disclosure may be implemented as an image display apparatus as described below. An image display apparatus according to yet another aspect of the present disclosure includes: the display screen 20 in which the pixels 16 are disposed in a matrix; the source driver IC 14 (the source driver circuit) which outputs a video signal to be applied to the pixels 16; the source signal lines 18 which transmit the video signal output by the source driver IC 14 (source driver circuit); the gate driver IC 12*a* (the first gate driver circuit); the gate driver IC 12*b* (the second gate driver circuit); and the gate signal line 17*a* (first gate signal line) and the gate signal line 17*b* (the second gate signal line) each of which transmits a selection voltage for selecting a pixel from among the pixels 16 or a non-selection transmit for placing a pixel among the pixels 16 in a non-selection state. In addition, the gate driver IC 12*a* (the first gate driver circuit) and the gate driver IC 12*b* (the second gate driver circuit) select one of the non-selection voltage and the selection voltage, and output the selected voltage to the gate signal line 17*a* (the first gate signal line) and the gate signal line 17*b* (the second gate signal line). The scanning and outputting buffer circuits 31*a* and 31*b* (scanning circuits) of the gate driver IC 12*a* (the first gate driver circuit) operate in synchronization with one clock cycle of an input clock. The scanning and outputting buffer circuits 31*a* and 31*b* (scanning circuits) of the gate driver IC 12*b* (the second gate driver circuit) operate in synchronization with n clock cycles (n is an integer of at least 2) of an input clock.

For example, the gate driver IC 12*a* (the first gate driver circuit) may be disposed on the first side of the display screen 20, and the gate driver IC 12*b* (the second gate driver circuit) may be disposed on the second side of the display screen 20 which is different from the first side of the display screen 20.

In addition, for example, the non-selection voltage may include the first non-selection voltage (Voff1 voltage and, i.e., OFF voltage 1) and the second non-selection voltage (Voff2 voltage, i.e., OFF voltage 2), and the second non-selection voltage (Voff2 voltage, i.e., OFF voltage 2) may be output to one of the output terminals 34 in a period of one clock cycle after the selection voltage has been output to the one of the output terminals 34, and the first non-selection voltage (Voff1 voltage, i.e., OFF voltage 1) may be output to the one of the output terminals 34 after the second non-selection voltage (Voff2 voltage, i.e., OFF voltage 2) has been output to the one of the output terminals 34.

In addition, for example, the EL element 15 and the driving transistor 11*a* for supplying current to the EL element 15 may be formed on the each of the pixels 16.

Furthermore, for example, the gate driver IC 12*a* (the first gate driver circuit) may be disposed on the first side of the display screen 20, and the gate driver IC 12*b* (the second gate driver circuit) may be disposed on the second side of the display screen 20 which is different from the first side of the display screen 20. The gate driver ICs 12 (the gate driver circuits) may be driver ICs. The total number of the gate driver ICs 12*a* (the first gate driver circuits) may be larger than the total number of the gate driver ICs 12*b* (the second gate driver circuits).

The present disclosure has been described mainly illustrating the system of applying a video signal voltage to the pixels 16 (program voltage system). However, the present disclosure is not limited to this system. A system of applying a video signal current to the pixels 16 (program current system) may be employed. In addition, as in the PWM driving, a digital driving system in which the pixels 16 are caused to blink or digitally emit light for display may be employed. Moreover, other driving systems may be employed. Light-emitting area variable driving which expresses the intensity of light emission by the light-emission area may be employed.

For example, as the PWM driving, a system is exemplified which a predetermined voltage value is applied to the pixels 16 by the transistor 11*b*, and tuning ON and OFF the transistor 11*d* for a period corresponding to a bit number indicated by the gradation to implement gradation expression.

In addition, with the ON and OFF control on the transistor 11*d*, a belt-like black display (not illustrated) is generated on the display screen 20 and an amount of current that flows through the display screen 20 is controlled.

Furthermore, it is preferable that the anode voltage Vdd is variable based on the magnitude of current flowing through the display screen 20. When the current flowing through the display screen 20 is greater than a predetermined value, the anode voltage Vdd is decreased so that the power consumption of the panel is suppressed. When the current flowing through the display screen 20 is smaller than a predetermined value, the anode voltage Vdd is increased or caused to hold a predetermined voltage so that a specified current flows through the EL element 15 of each of the pixels 16.

It is possible to apply, to various electronic devices, the details (or part of the details) described in each of the diagrams of the above-described embodiments. To be specific, it is possible to apply them to display units of electronic devices.

Examples of such electronic devices include: a video camera, a digital camera, a head mounted display, a navigation system, an audio reproducing device (a car audio, an audio component, etc.), a computer, a gaming device, a mobile information terminal (a mobile computer, a mobile phone, a mobile gaming device, a digital book, etc.), an image reproducing apparatus including a recording medium [to be specific, a device including a display capable of reproducing a recording medium of a digital versatile disc (DVD) or the like and displaying the image thereof], etc.

Figure 32:
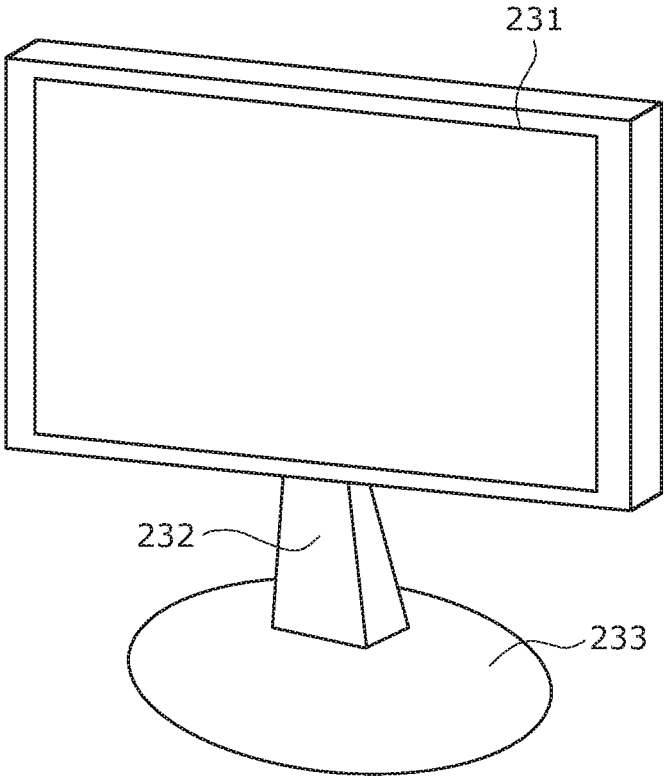
FIG. 32 illustrates an external view of a display to which the image display apparatus according to the present disclosure is employed.

FIG. 32 illustrates a display (image display apparatus) including: a support column 232; holding base 233; and the image display apparatus (EL display panel) 231 according to the present disclosure. The display illustrated in FIG. 32 has a function of displaying various information items (a still image, video, a text image, etc.) on a display portion. It should be noted that the function of the display illustrated in FIG. 32 is not limited to this, and the display can have various functions.

Figure 33:
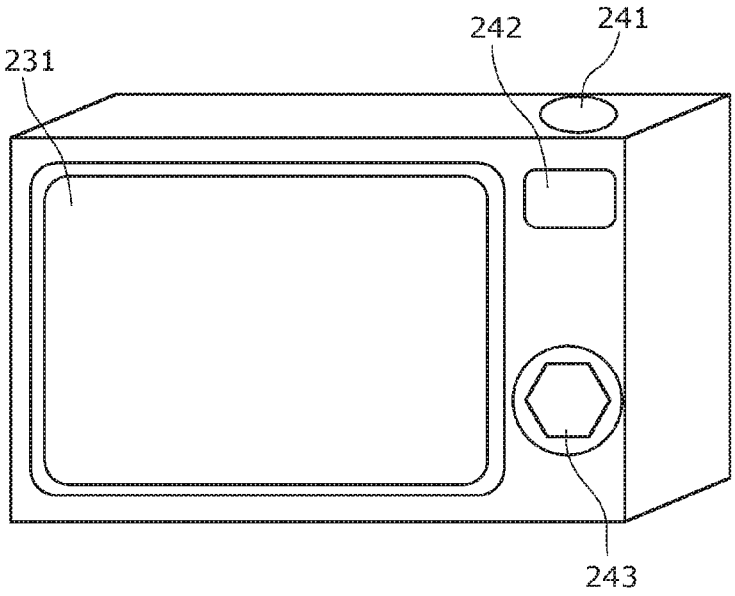
FIG. 33 illustrates an external view of a camera to which the image display apparatus according to the present disclosure is employed.

FIG. 33 illustrates a camera including: a shutter 241; a viewfinder 242; and a cursor 243. The camera illustrated in FIG. 33 has a function of capturing a still image. The camera also has a function of capturing video. It should be noted that the functions of the camera illustrated in FIG. 33 are not limited to these functions, and the camera can have various functions.

Figure 34:
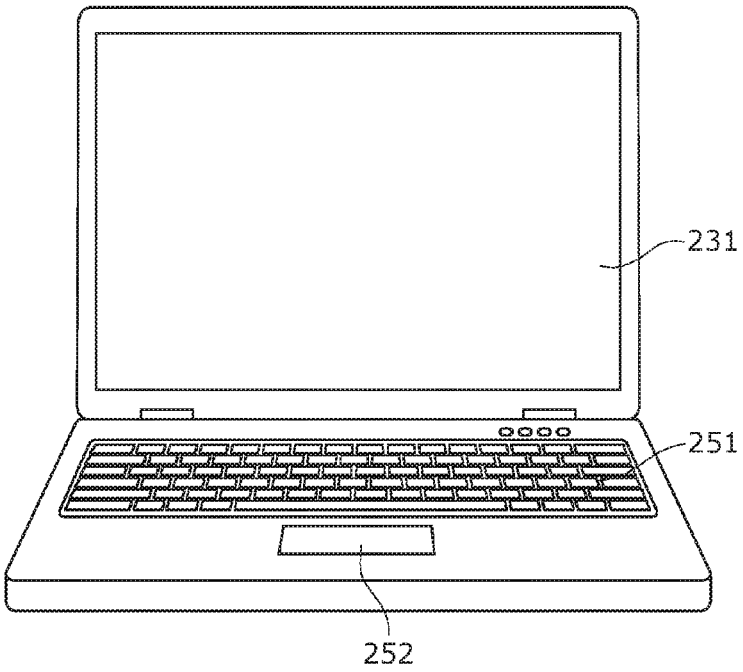
FIG. 34 illustrates an external view of a computer to which the image display apparatus according to the present disclosure is employed.

FIG. 34 illustrates a computer including: a keyboard 251; and a touch-pad 252. The computer illustrated in FIG. 34 has a function of displaying various information items (a still image, video, a text image, etc.) on a display portion. It should be noted that the function of the computer illustrated in FIG. 34 is not limited to this, and the computer can have various functions.

It should be understood that the above-described embodiment can also be applied to the other embodiments according to the present disclosure. It should also be understood that it is possible to combine the above-described embodiment and modification with other embodiments.

It is possible to upgrade the image quality of the above-described information devices illustrated in the above-described FIG. 32 to FIG. 34, by employing the image display apparatus (EL display panel) or the driving system described in the above-described embodiments in the configuration of the display portion of the present embodiment. In addition, it is possible to easily perform a test or adjustment.

It is possible to arbitrarily combine the above-described embodiments with other embodiments.

In the present disclosure, each drawings has a portion which is omitted, enlarged, or reduced, for facilitating understanding or facilitating drawing of the figures.

Items or details illustrated or described in each of the embodiments of the present disclosure are applied to other embodiments as well. In addition, the EL display panel described or illustrated in the embodiments of the present disclosure can be adopted as the image display apparatus of the present disclosure.

For example, it should be understood that the image display apparatus (EL display panel) illustrated or explained in the above-described embodiments of the present disclosure can be employed as the image display apparatus 231 of the laptop personal computer illustrated in FIG. 34, or can be included in information devices.

Furthermore, portions to which the same numbers or symbols are assigned have the same or similar forms, materials, functions, operations, related items, effects, etc.

The details described in each of the diagrams or the like can be combined with other embodiments, etc., without notification. For example, it is possible to form an information display apparatus or the like illustrated in FIG. 32, FIG. 33 and FIG. 34, by adding a touch panel or the like to the EL display panel according to the present disclosure illustrated in FIG. 1.

The image display apparatus according to the present disclosure is a concept which includes a system device such as an information device. The concept of the EL display panel includes, in a broad sense, a system device such as an information device.

In addition, although it is stated, in the embodiments and the modifications described above, that the total number of the gate driver ICs 12*b* required may be half of the total number of the gate driver ICs 12*a* required, the total number of the gate driver ICs 12*b* is not limited to this.

For example, in the case where four types of the gate signal lines 17 (17*a*, 17*b*, 17*c*, and 17*d*) are disposed or formed in each of the pixels, four scanning and outputting buffer circuits 31 (31*a*, 31*b*, 31*c*, and 31*d*) are formed in each of the gate driver ICs 12, the bilateral driving is applied to the gate signal line 17*a*, and the unilateral driving is applied to the other gate signal lines 17 (17*b*, 17*c*, and 17*d*), the total number of the gate driver ICs 12*b* is one fourth of the total number of the gate driver ICs 12*a* according to the configuration illustrated in FIG. 1.

As described above, according to the present disclosure, the total number of the gate driver ICs 12 is determined based on the types (total numbers) of the gate signal lines 17 in each of the pixels, whether the bilateral driving or the unilateral driving is applied to the gate signal lines 17, and the total number of the scanning and outputting buffer circuits 31 included in the gate driver ICs 12.

The scanning and outputting buffer circuit 31*a* in the gate driver IC 12*b* drives the gate signal line 17*a* in the 4n−3th pixel row (n is an integer of at least 1), the scanning and outputting buffer circuit 31*b* drives the gate signal line 17*a* in the 4n−2th pixel row (n is an integer of at least 1), the scanning and outputting buffer circuit 31*c* drives the gate signal line 17*a* in the 4n−1th pixel row (n is an integer of at least 1), and the scanning and outputting buffer circuit 31*d* drives the gate signal line 17*a* in the 4n-th pixel row (n is an integer of at least 1).

As described above, the total number of the gate driver IC 12*a*; that is, one of the gate driver ICs is equal to the integral multiple of the total number of the gate driver IC 12*b*; that is, the other of the gate driver ICs.

In addition, when the types of the gate signal lines 17 in each of the pixels is m, and the total number of the gate signal lines 17, among the m types of the gate signal lines 17, to which the bilateral driving is performed is n (n<m), the total number of one of the gate driver ICs 12*a* used is equal to the m n multiple of the total number of the gate driver ICs 12*b*; that is, the other of the gate driver ICs.

As described above, the embodiments are described as exemplifications of the technique according to the present disclosure. The accompanying drawings and detailed description are provided for this purpose.

Therefore, the constituent elements described in the accompanying drawings and detailed description include, not only the constituent elements essential to solving the problem, but also the constituent elements that are not essential to solving the problem but are included in order to exemplify the aforementioned technique. As such, description of these non-essential constituent elements in the accompanying drawings and the detailed description should not be taken to mean that these non-essential constituent elements are essential.

Furthermore, since the foregoing embodiments are for exemplifying the technique according to the present disclosure, various changes, substitutions, additions, omissions, and so on, can be carried out within the scope of the Claims or its equivalents.

INDUSTRIAL APPLICABILITY

The present disclosure can be applied to an image display apparatus (EL display panel) and a driving method thereof, and more specifically, to a television set, a camera, and a display of a computer, etc.

REFERENCE SIGNS LIST

11, 11*a*, 11*b*, 11*c*, 11*d*, 11*e*, 93, 93*a*, 93*b*, 93*c*, transistor (TFT)
12, 12*a*, 12*b* gate driver IC (i.e., gate driver circuit)
14 source driver IC (i.e., source driver circuit)
15 EL element
16, 16*a*, 16*b*, 16*c*, pixel
17, 17*a*, 17*b*, 17*c*, 17*d*, gate signal line
18 source signal line
19, 19*a*, 19*b* capacitor
20 display screen
21 display panel
22 COF
23, 23*a* to 23*c* printed circuit board
31, 31*a*, 31*b*, 31*c*, 31*d*, scanning and outputting buffer circuit
34 output terminal
35 connecting terminal
61 switching circuit
91, 91*a*, 91*b* shift register circuit
92 selecting circuit
94 outputting buffer circuit
231 EL display panel (i.e., image display apparatus)
232 support column

233 holding base
241 shutter
242 viewfinder
243 cursor
251 keyboard
252 touch-pad

The invention claimed is:

1. An image display apparatus, comprising:

a display screen including pixels disposed in a matrix; and a plurality of gate driver circuits, each gate driver circuit of the plurality of gate driver circuits including:

a clock input terminal;

a data input terminal;

a plurality of output terminals connected to gate signal lines of the image display apparatus; and a setting circuit for setting a first mode or a second mode, wherein a selection voltage or a non-selection voltage output from an arbitrary one of the plurality of output terminals is applied to a corresponding one of the gate signal lines, data set at the data input terminal is provided to the gate driver circuit according to a clock inputted to the clock input terminal, the data is shifted in the gate driver circuit in synchronization with the clock inputted to the clock input terminal, the arbitrary one of the plurality of output terminals outputs the selection voltage or the non-selection voltage based on a data position in the gate driver circuit, when the setting circuit is set to the first mode, the data is shifted in the gate driver circuit in synchronization with one clock cycle of the clock inputted to the clock input terminal, and the selection voltage or the non-selection voltage is output based on the data position in the gate driver circuit, and when the setting circuit is set to the second mode, the data is shifted in the gate driver circuit in synchronization with n clock cycles of the clock inputted to the clock input terminal, and the selection voltage or the non-selection voltage is output based on the data position in the gate driver circuit, n being an integer of at least 2, wherein the plurality of gate driver circuits includes a first number of gate driver circuits which are set to the first mode and a second number of gate driver circuits which are set to the second mode, the first number being different than the second number.

2. The image display apparatus according to claim 1, wherein, for each gate driver circuit of the plurality of gate driver circuits, the non-selection voltage includes a first non-selection voltage and a second non-selection voltage, and the arbitrary one of the plurality of output terminals outputs the second non-selection voltage in a period of the one clock cycle after the selection voltage has been output, and outputs the first non-selection voltage after the second non-selection voltage has been output.

3. The image display apparatus according to claim 1, wherein each gate driver circuit of the plurality of gate driver circuits further includes:

a plurality of scanning circuits each including a clock input and a data input.

4. The image display apparatus according to claim 1, wherein a first gate driver circuit of the plurality of gate driver circuits is disposed on a first side of the display screen, a second gate driver circuit of the plurality of gate driver circuits is disposed on a second side of the display screen which is different from the first side of the display screen, each gate driver circuit of the plurality of gate driver circuits further includes a first scanning circuit and a second scanning circuit, for each gate driver circuit of the plurality of gate driver circuits:

the plurality of output terminals include a first output terminal and a second output terminal;

the first scanning circuit is electrically connected to the first output terminal; and the second scanning circuit is electrically connected to the second output terminal, the pixels each include a first gate signal line and a second gate signal line, the pixels include a first pixel and a second pixel, the first output terminal of the first gate driver circuit is electrically connected to the first gate signal line of the first pixel, the first output terminal of the first gate driver circuit is electrically connected to the first gate signal line of the second pixel, the second output terminal of the first gate driver circuit is electrically connected to the second gate signal line of the first pixel, the second output terminal of the first gate driver circuit is electrically connected to the second gate signal line of the second pixel, the first output terminal of the second gate driver circuit is electrically connected to the first gate signal line of the first pixel, and the second output terminal of the second gate driver circuit is electrically connected to the first gate signal line of the second pixel.

5. The image display apparatus according to claim 4, wherein the non-selection voltage includes a first non-selection voltage and a second non-selection voltage, and the second non-selection voltage is output to an arbitrary one of the plurality of output terminals in a period of one clock cycle after the selection voltage has been output to the arbitrary one of the plurality of output terminals, and the first non-selection voltage is output to the arbitrary one of the plurality of output terminals after the second non-selection voltage has been output to the arbitrary one of the plurality of output terminals.

6. The image display apparatus according to claim 4, wherein the pixels each include an electroluminescence (EL) element and a driving transistor which supplies current to the EL element.

7. The image display apparatus according to claim 1, wherein each of the plurality of gate driver circuits includes a plurality of shift register circuits.

8. An image display apparatus of an active matrix type which includes a display screen in which pixels are disposed in a matrix, the image display apparatus comprising:

a first gate driver circuit; and a second gate driver circuit, wherein the pixels each include a first gate signal line and a second gate signal line, the first gate signal line includes a first end connected to a first output terminal of the first gate driver circuit, the first gate signal line includes a second end connected to an output terminal of the second gate driver circuit, the second gate signal line includes a first end connected to a second output terminal of the first gate driver circuit, the second gate signal line includes a second end that is open, the first gate driver circuit includes a scanning circuit which operates in synchronization with one clock cycle of a clock, and the second gate driver circuit includes a scanning circuit which operates in synchronization with n clock cycles of a clock, the n being an integer of at least 2.

9. The image display apparatus according to claim 8, wherein the first gate driver circuit is disposed on a first side of the display screen, and the second gate driver circuit is disposed on a second side of the display screen which is different from the first side of the display screen.

10. The image display apparatus according to claim 8, wherein the first gate driver circuit is disposed on a first side of the display screen, the second gate driver circuit is disposed on a second side of the display screen which is different from the first side of the display screen, the first gate driver circuit and the second gate driver circuit are each a driver integrated circuit (IC), and a total number of the first gate driver circuit is larger than a total number of the second gate driver circuit.

11. The image display apparatus according to claim 8, wherein the first gate signal line and the second gate signal line each transmit a selection voltage for selecting a pixel from among the pixels and a non-selection voltage for placing a pixel among the pixels in a non-selection state, the non-selection voltage includes a first non-selection voltage and a second non-selection voltage, and the second non-selection voltage is output to an arbitrary one of a plurality of output terminals in a period of one clock cycle after the selection voltage has been output to the arbitrary one of the plurality of output terminals, and the first non-selection voltage is output to the arbitrary one of the plurality of output terminals after the second non-selection voltage has been output to the arbitrary one of the plurality of output terminals.

12. The image display apparatus according to claim 8, wherein the pixels each include an electroluminescence (EL) element and a driving transistor which supplies current to the EL element.

13. The image display apparatus according to claim 8, wherein each of the first gate driver circuit and the second gate driver circuit includes a plurality of shift register circuits.

14. An image display apparatus comprising:

a display screen including pixels disposed in a matrix;

a source driver circuit which outputs a video signal to be applied to the pixels;

a source signal line which transmits the video signal output by the source driver circuit;

at least one first gate driver circuit;

at least one second gate driver circuit; and a first gate signal line and a second gate signal line each of which transmits a selection voltage for selecting a pixel from among the pixels and a non-selection voltage for placing a pixel among the pixels in a non-selection state, wherein the first gate driver circuit and the second gate driver circuit each select one of the non-selection voltage and the selection voltage, and output the selected one of the non-selection voltage and the selection voltage to the first gate signal line and the second gate signal line, the first gate driver circuit includes a scanning circuit which operates in synchronization with one clock cycle of a clock inputted, the second gate driver circuit includes a scanning circuit which operates in synchronization with n clock cycles of a clock inputted, the n being an integer of at least 2, and the image display apparatus includes a first number of the first gate driver circuit and a second number of the second gate driver circuit, the first number being different than the second number.

15. The image display apparatus according to claim 14, wherein the first gate driver circuit is disposed on a first side of the display screen, and the second gate driver circuit is disposed on a second side of the display screen which is different from the first side of the display screen.

16. The image display apparatus according to claim 14, wherein the first gate driver circuit is disposed on a first side of the display screen, the second gate driver circuit is disposed on a second side of the display screen which is different from the first side of the display screen, the first gate driver circuit and the second gate driver circuit are each a driver integrated circuit (IC), and the first number of the first gate driver circuit is larger than the second number of the second gate driver circuit.

17. The image display apparatus according to claim 14, wherein the non-selection voltage includes a first non-selection voltage and a second non-selection voltage, and the second non-selection voltage is output to an arbitrary one of a plurality of output terminals in a period of one clock cycle after the selection voltage has been output to the arbitrary one of the plurality of output terminals, and the first non-selection voltage is output to the arbitrary one of the plurality of output terminals after the second non-selection voltage has been output to the arbitrary one of the plurality of output terminals.

18. The image display apparatus according to claim 14, wherein the pixels each include an electroluminescence (EL) element and a driving transistor which supplies current to the EL element.

19. The image display apparatus according to claim 14, wherein each of the first gate driver circuit and the second gate driver circuit includes a plurality of shift register circuits.

* * * * *